US010391351B2

(12) United States Patent
Carter et al.

(10) Patent No.: US 10,391,351 B2
(45) Date of Patent: Aug. 27, 2019

(54) FUNCTIONAL TRAINING EQUIPMENT WITH MULTIPLE MOVEMENT PLANES FOR BICEPS CURL EXERCISE

(71) Applicant: Tuffstuff Fitness International, Inc., Chino, CA (US)

(72) Inventors: Kenneth Evans Carter, Chino, CA (US); Sherman P. Grider, Chino, CA (US); Pastor Sanchez, Chino, CA (US)

( * ) Notice: Subject to any disclaimer, the term of this patent is extended or adjusted under 35 U.S.C. 154(b) by 217 days.

(21) Appl. No.: 15/393,966

(22) Filed: Dec. 29, 2016

(65) Prior Publication Data

US 2017/0106224 A1 Apr. 20, 2017

Related U.S. Application Data

(63) Continuation-in-part of application No. 14/494,891, filed on Sep. 24, 2014, now Pat. No. 9,750,969, and a continuation-in-part of application No. 14/494,920, filed on Sep. 24, 2014, now Pat. No. 9,539,462, and a continuation-in-part of application No. 14/494,977, (Continued)

(51) Int. Cl.

| | |
|---|---|
| ***A63B 21/06*** | (2006.01) |
| ***A63B 21/062*** | (2006.01) |
| ***A63B 23/12*** | (2006.01) |
| ***A63B 21/00*** | (2006.01) |
| *A63B 23/02* | (2006.01) |

(52) U.S. Cl.

CPC ..... *A63B 21/063* (2015.10); *A63B 21/00065* (2013.01); *A63B 21/0628* (2015.10); *A63B 21/156* (2013.01); *A63B 21/4035* (2015.10); *A63B 21/4043* (2015.10); *A63B 23/1209* (2013.01); *A63B 23/1254* (2013.01); *A63B 23/1281* (2013.01); *A63B 23/0238* (2013.01); *A63B 2225/09* (2013.01); *A63B 2225/093* (2013.01)

(58) Field of Classification Search

CPC ..... A63B 23/1281; A63B 21/063; A63B 21/0632

See application file for complete search history.

(56) References Cited

U.S. PATENT DOCUMENTS 5,304,107 A * 4/1994 Jones ..... A63B 23/0211 482/100

5,334,120 A 8/1994 Rasmussen (Continued)

*Primary Examiner* — Joshua T Kennedy

(74) *Attorney, Agent, or Firm* — Thomas D. Foster; Jon Kidney

(57) ABSTRACT

A biceps curl machine includes: a resistance element; a user support; a first movement element comprising: a first column; and a first connecting element comprising a first pivot point such that the user support is able to pivot about a first axis associated with the first connecting element, wherein the first connecting element is movably coupled to the first column such that the first connecting element is able to move along a first path defined by the first column; and a second movement element comprising: a second column; and a second connecting element comprising a second pivot point such that the user support is able to pivot about a second axis associated with the second connecting element, wherein the second connecting element is movably coupled to the second column such that the second connecting element is able to move along a second path defined by the second column.

14 Claims, 72 Drawing Sheets

Related U.S. Application Data filed on Sep. 24, 2014, now Pat. No. 9,533,188, and a continuation-in-part of application No. 15/390,307, filed on Dec. 23, 2016.

(56) References Cited

U.S. PATENT DOCUMENTS 5,352,171 A 10/1994 Lin
5,580,340 A * 12/1996 Yu ..... A63B 21/055 482/72
6,264,588 B1 7/2001 Ellis
6,287,241 B1 9/2001 Ellis
6,916,278 B2 7/2005 Webber
7,052,444 B2 5/2006 Webber
7,220,221 B2 5/2007 Mosimann et al.
7,594,880 B2 * 9/2009 Webber ..... A63B 23/1254 482/95
7,654,938 B2 2/2010 Webber et al.
7,654,940 B2 * 2/2010 Webber ..... A63B 21/00181 482/100
7,670,269 B2 3/2010 Webber et al.
7,878,953 B2 2/2011 Webber et al.
7,901,335 B2 * 3/2011 Webber ..... A63B 21/0615 482/140
7,938,760 B1 * 5/2011 Webber ..... A63B 21/0615 482/97
7,963,890 B2 6/2011 Webber et al.
7,976,440 B2 7/2011 Webber et al.
7,981,010 B1 * 7/2011 Webber ..... A63B 21/0615 482/100
7,988,603 B2 8/2011 Webber et al.
7,993,251 B1 * 8/2011 Webber ..... A63B 21/0615 482/100
8,002,679 B2 8/2011 Webber et al.
8,317,665 B2 11/2012 Webber et al.
8,425,384 B2 * 4/2013 Garner ..... A63B 21/00 482/133
9,662,531 B2 * 5/2017 Giannelli ..... A63B 21/078
2013/0324374 A1 12/2013 Ellis
2013/0331238 A1 12/2013 Ellis
2014/0121070 A1 5/2014 Ellis
2014/0371036 A1 * 12/2014 Ellis ..... A63B 23/0227 482/66

* cited by examiner

FUNCTIONAL TRAINING EQUIPMENT WITH MULTIPLE MOVEMENT PLANES FOR BICEPS CURL EXERCISE

BACKGROUND OF THE INVENTION

Functional training is a classification of exercise which involves training the body for activities performed in daily life. Functional Training leads to better joint mobility, joint stability, and more efficient motor patterns which includes strength and balance. The origins of functional training are derived from physical or occupational rehabilitation using exercises that mimic normal activities. The use of traditional strength machines delivers single plane or fixed pattern motion, which targets only a specific muscle and does not necessarily bear any relationship to the movements people make in their regular activities.

Many existing solutions subject a user to a mode of interaction and level of stress on the body that can be counterproductive or cause unnecessary injury. In addition, existing solutions may require body positions that are unnatural and/or cause a deviation from a biomechanically correct exercise position through a range of movement.

Thus there is a need for equipment that provides a natural, progressive motion that allows a user to maintain a biomechanically correct position across a circuit of exercise stations that allows a user to define a specific course of functional exercise.

BRIEF SUMMARY OF THE INVENTION

Some embodiments provide a way for a user to perform functional training. Some embodiments may provide a set of exercise machines that may be used to form a training circuit for a user. Each exercise machine may include a movement path associated with an exercise. The movement path may include a resistance path and a user movement path.

As a user proceeds through an exercise movement, the body position of the user may be automatically adjusted such that the user remains in a biomechanically correct position throughout the exercise. The body position may be maintained using a natural arc movement in some embodiments.

In addition, the body position of the user (and/or the body weight of the user) may provide an assist at various places along the resistance path such that a user is able to complete a full movement. This approach may increase gains in strength and flexibility. Furthermore, the natural, functional movement of some embodiments may engage additional muscle groups through the arc movement.

The exercise machines of some embodiments may include cable connections to resistance elements. Such an arrangement may allow each user to at least partially define a resistance path. This approach may improve user comfort and allow for a full range of motion as well as engaging additional muscle groups as compared to a fixed resistance path.

The preceding Brief Summary is intended to serve as a brief introduction to various features of some exemplary embodiments of the invention. Other embodiments may be implemented in other specific forms without departing from the spirit of the invention.

BRIEF DESCRIPTION OF THE SEVERAL VIEWS OF THE DRAWINGS

The novel features of the invention are set forth in the appended claims. However, for purpose of explanation, several embodiments of the invention are illustrated in the following drawings.

DETAILED DESCRIPTION OF THE INVENTION

Figure 1:
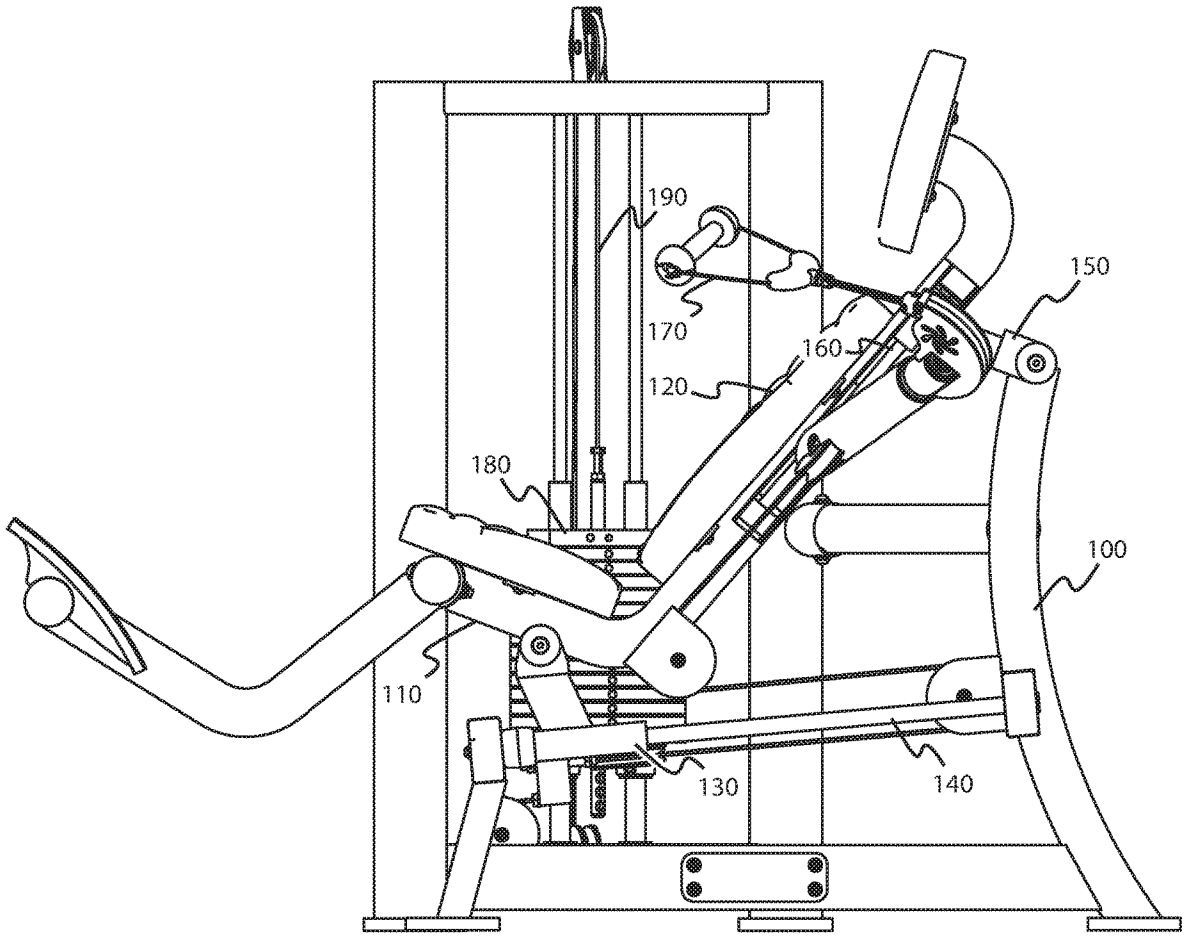
FIG. 1 illustrates a side view of a chest press machine according to an exemplary embodiment in a start position.

The following detailed description is of the best currently contemplated modes of carrying out exemplary embodiments of the invention. The description is not to be taken in a limiting sense, but is made merely for the purpose of illustrating the general principles of the invention, as the scope of the invention is best defined by the appended claims.

Various inventive features are described below that can each be used independently of one another or in combination with other features. Broadly, some embodiments of the present invention generally provide exercise equipment that puts a user through a natural, progressive motion. Such equipment may include a circuit of individual cable driven machines that allows the user to define a course of exercise.

The movement created using an arcing progression of some embodiments triggers compound muscle interaction that includes core stabilization and peripheral muscles. Coupling the arc movement of some embodiments and unrestricted cable driven action improves balance and functional movement, ensures compound muscle interaction, and supports the user in an optimal biomechanical position thought the entire exercise.

Such functional movements include activities like manually opening or closing a garage door; replacing or removing heavy objects on a high shelf; placing or pulling object in and out of the trunk of a car; getting up from or sitting down in a chair; getting in or out of a bathtub; pulling a water hose across a yard; pushing a lawnmower; or even lifting and holding a child or pet.

A first exemplary embodiment provides a biceps curl machine comprising: a resistance element; a user support coupled to the resistance element; a first movement element coupled to the user support, the first movement element comprising: a first column; and a first connecting element comprising a first pivot point such that the user support is able to pivot about a first axis associated with the first connecting element, wherein the first connecting element is movably coupled to the first column such that the first connecting element is able to move along a first path defined by the first column; and a second movement element coupled to the user support, the second movement element comprising: a second column; and a second connecting element comprising a second pivot point such that the user support is able to pivot about a second axis associated with the second connecting element, wherein the second connecting element is movably coupled to the second column such that the second connecting element is able to move along a second path defined by the second column.

A second exemplary embodiment provides a biceps curl machine comprising: a resistance element; a user support coupled to the resistance element; a first movement element coupled to the user support, the first movement element comprising: a first column; and a first carriage movably coupled to the first column such that the first movement element is able to move along a first path defined by the first column; and a second movement element coupled to the user support, the second movement element comprising: a second column; and a second carriage movably coupled to the second column such that the second movement element is able to move along a second path defined by the second column.

A third exemplary embodiment provides a lateral raise machine comprising: a cable resistance element adapted to allow for a resistance path that is at least partly defined by a user; a user support coupled to the cable resistance element; a first movement element coupled to the user support, the first movement element comprising: a column; and a first carriage movably coupled to the column such that the first movement element is able to move along a first path defined by the column; and a second movement element coupled to the user support, the second movement element comprising: a pair of columns; and a second carriage movably coupled to the pair of columns such that the second movement element is able to move along a second path defined by the pair of columns.

Several more detailed embodiments of the invention are described in the sections below. Section I provides a conceptual description of the theory of operation of some embodiments and a description of an example design process. Section II then describes various specific machines that may be provided by some embodiments.

I. Theory of Operation

Sub-section LA provides a conceptual description of various elements associated with body position in some embodiments. Sub-section I.B then describes various resistance elements included in some embodiments. Lastly, subsection I.C describes an example design implementation of a specific machine.

A. Body Position Elements

Some embodiments provide a fixed user support. Such a support may be generally "L"-shaped and may allow a user to sit or recline on an apparatus while having his or her body supported in an optimized position for performing the exercise. Different embodiments may include different specific support elements. For instance, such supports may have different angles between a seat portion and a back portion of the supports. As another example, different embodiments may include different sets of cushions or other appropriate elements.

In some embodiments, various elements of the fixed support may be adjustable (e.g., a seat height setting may be selected from among a number of options).

Some embodiments provide a first body movement element. Such an element may include a carriage system tracked via a linear stabilizing shaft or a set of fixed columns. In addition, some embodiments may include a second body movement element. Such an element may include a fixed column or other appropriate support and an attachment element that is able to move along the column such that the fixed user support maintains an appropriate body position as the support moves along the first body movement element.

The first and/or second body movement elements may include one or more pivoting attachments associated with the first or second body movement elements. Such pivoting attachments may be coupled to the support frame and/or user support.

In some embodiments, the body movement elements may be at least partially adjustable. For instance, a user may be able to set start or end points along the movement path, a user may be able to adjust the angle of a body movement element relative to the user support, etc. In some embodiments, the adjustable elements may allow a user to align a body part with a machine feature.

Such body movement elements may allow a user to sustain a natural body arcing progression during a movement. In addition, the system may provide a consistent, smooth resistance throughout the entire exercise.

By combining multiple body movement elements, users are able to benefit from an "unrestricted" progression of compound muscle movements, activating crucial core stabilization muscles, in order to replicate, "real life" functional activities.

B. Resistance Elements

Some embodiments may include a cable driven, weight stack resistance movement element. Many implementations may include a pair of handles (and/or other appropriate user interface element such as a foot plate, a bar, a roller, etc.), where each handle is attached to a cable end. The free cable ends may allow a user to move each handle along an arbitrary path, which may allow a more comfortable movement and/or engage additional muscle groups.

Each cable may utilize a set of pulleys and/or connect to one or more other cables or elements. In some embodiments, in addition to using the cable system to move selected weight stack resistance elements, the cable system may be used to move the user along a movement path defined by the body movement elements described above.

Some embodiments may be configured such that the body weight of the user provides additional resistance to the weight stack resistance. Alternatively, some embodiments may be configured such that the body weight of the user provides assistance in moving the weight stack resistance. Some embodiments may be configured such that the amount of additional resistance and/or assistance may vary across the movement path.

One of ordinary skill in the art will recognize that various other specific resistance elements or selectable loads may be included in some embodiments (e.g., body weight only, resistance bands, free weight attachment points, etc.).

C. Example Design

The features described above will be illustrated by reference to the example machines of FIGS. 1-13. The first example is a chest exercise machine 100 that may be used for chest press and/or chest fly exercises. This example will describe a chest press exercise using the chest exercise machine.

Figure 2:
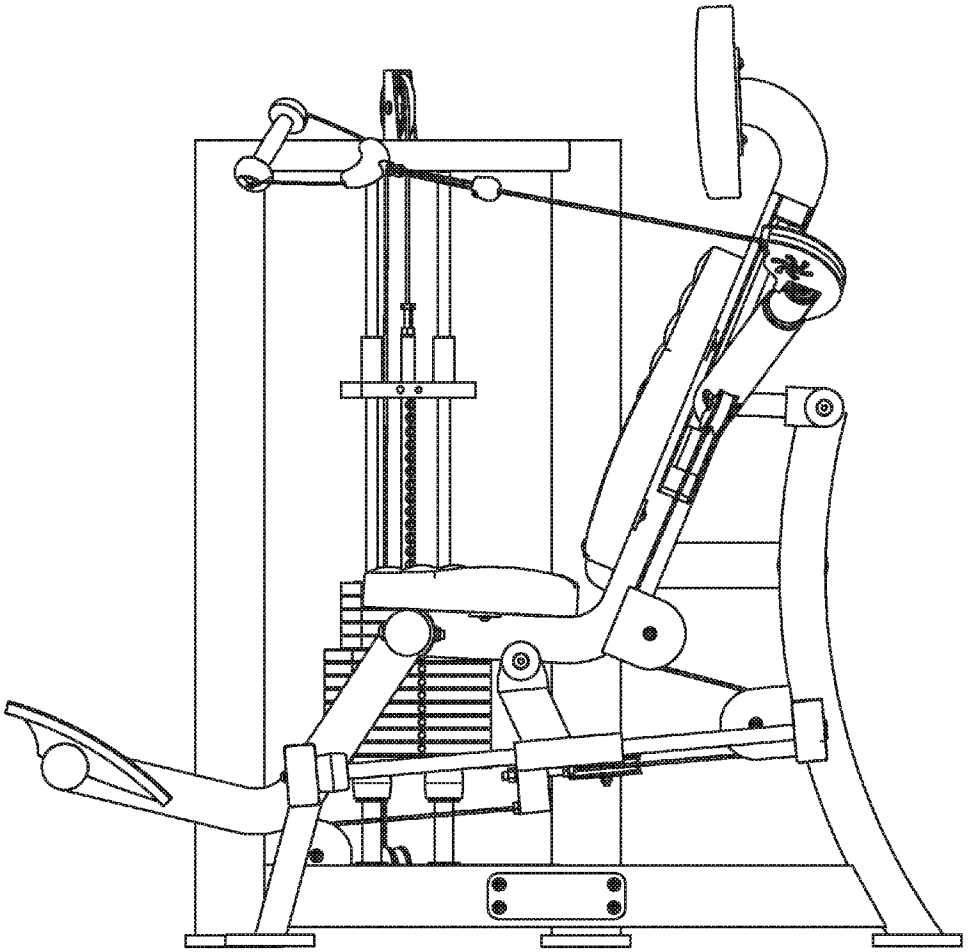
FIG. 2 illustrates a side view of the chest press machine in an end position.
Figure 3:
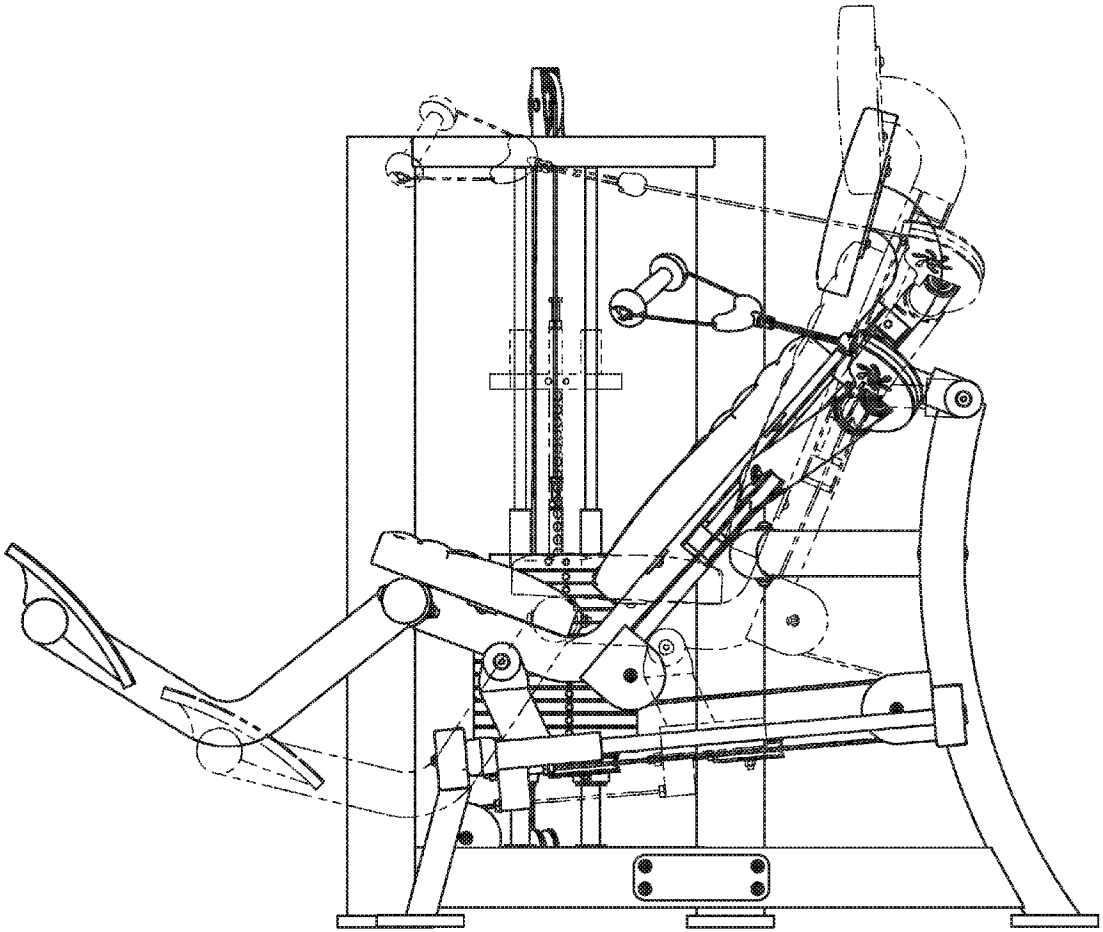
FIG. 3 illustrates a side view of the chest press machine showing the relative arrangements of the start position and end position.

FIG. 1 illustrates a side view of a chest press machine 100 according to an exemplary embodiment of the invention in a start position. Such a start position may be an exercise start position. FIG. 2 illustrates a side view of the chest press machine 100 in an end position. FIG. 3 illustrates a side view of the chest press machine 100 showing the relative arrangements of the start position and end position.

Figure 4:
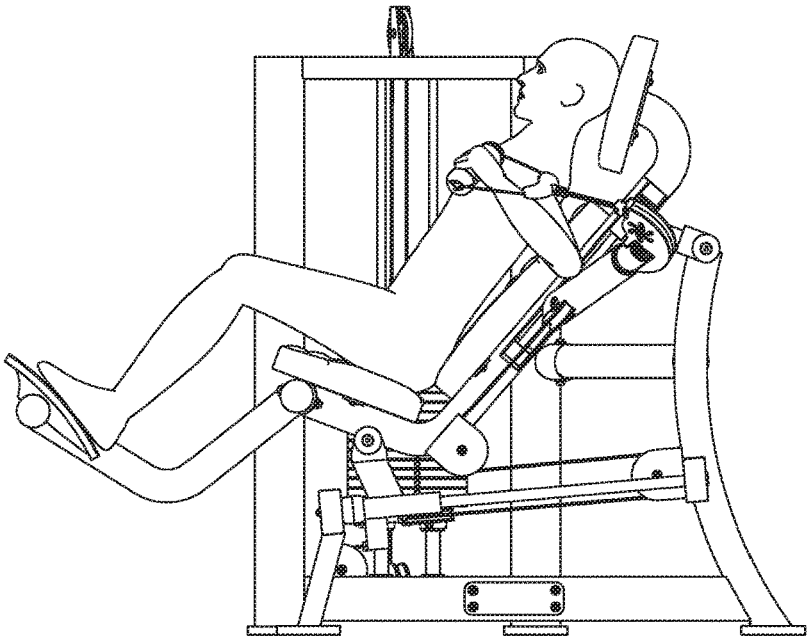
FIG. 4 illustrates a side view of the chest press machine in the start position during use.
Figure 5:
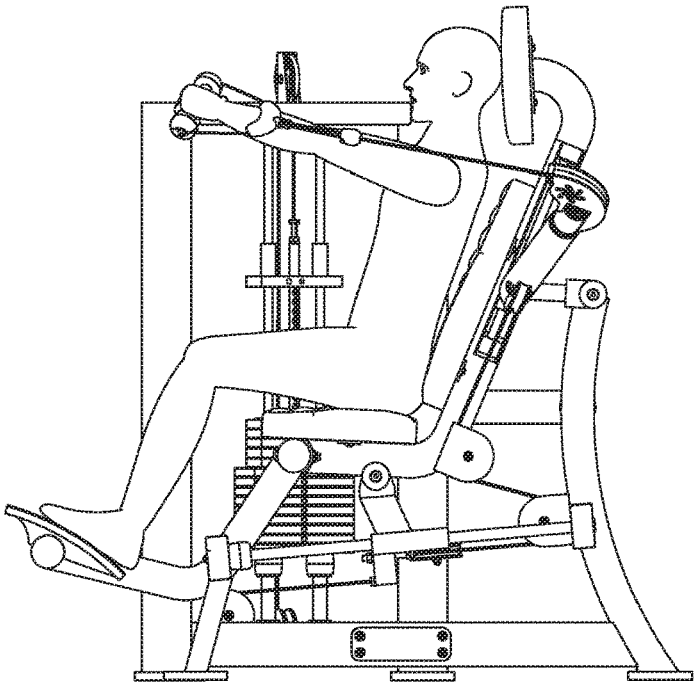
FIG. 5 illustrates a side view of the chest press machine in the end position during use.

FIG. 4 illustrates a side view of the chest press machine 100 in the start position during use. FIG. 5 illustrates a side view of the chest press machine 100 in the end position during use.

Figure 6:
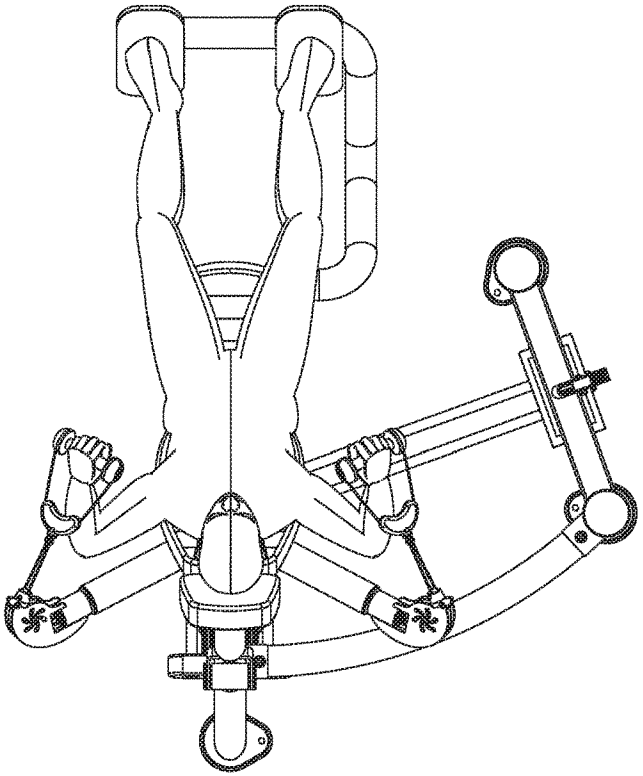
FIG. 6 illustrates a top view of the chest press machine in the start position during use.
Figure 7:
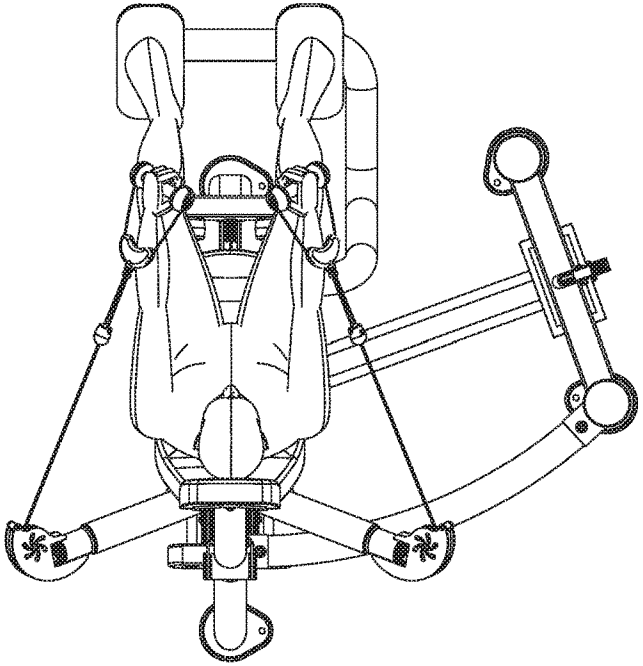
FIG. 7 illustrates a top view of the chest press machine in the end position during use.
Figure 8:
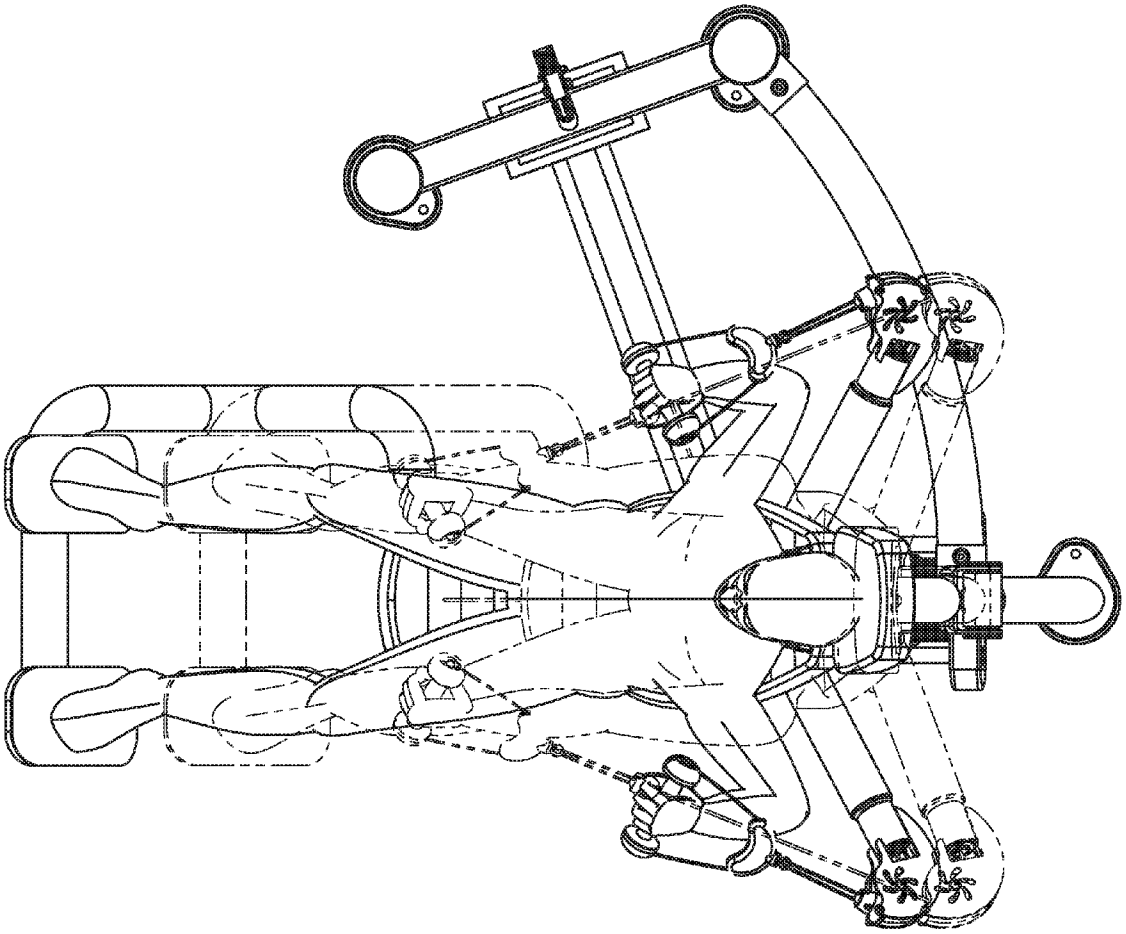
FIG. 8 illustrates a top view of the chest press machine showing the relative arrangements of the start position and end position during use.

FIG. 6 illustrates a top view of the chest press machine 100 in the start position during use. FIG. 7 illustrates a top view of the chest press machine 100 in the end position during use. FIG. 8 illustrates a top view of the chest press machine 100 showing the relative arrangements of the start position and end position during use.

Figure 9:
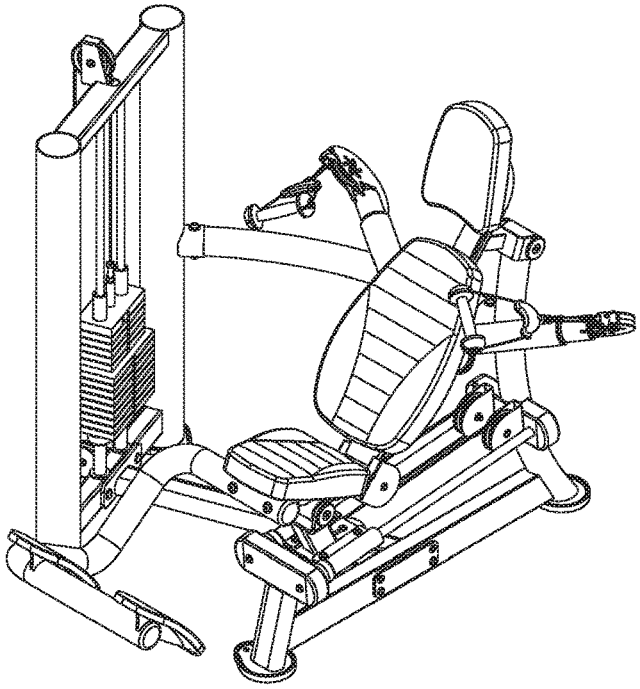
FIG. 9 illustrates a perspective view of the chest press machine in the start position.
Figure 10:
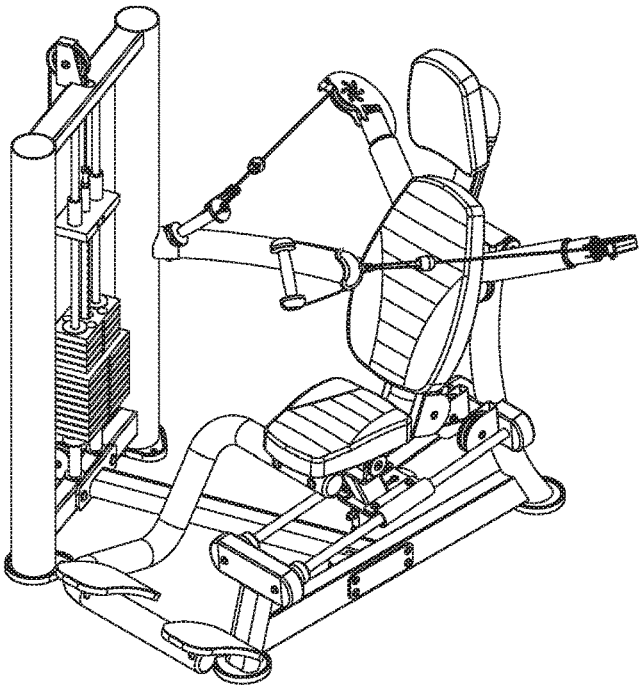
FIG. 10 illustrates a perspective view of the chest press machine in the end position.
Figure 11:
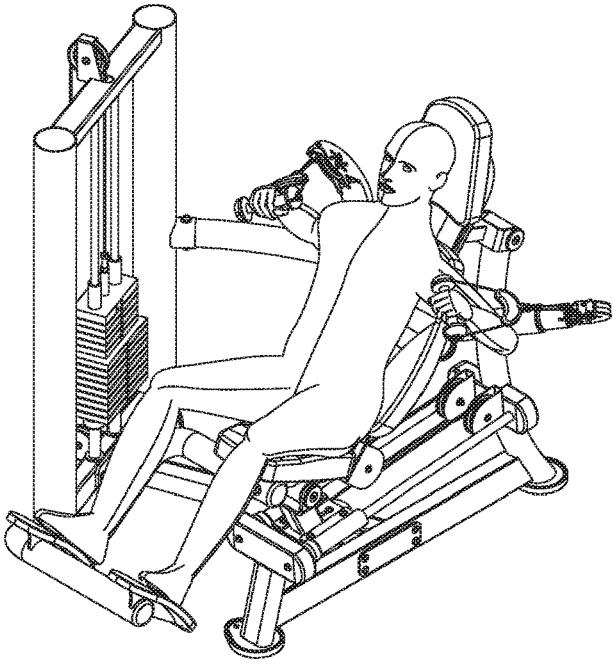
FIG. 11 illustrates a perspective view of the chest press machine in the start position during use.
Figure 12:
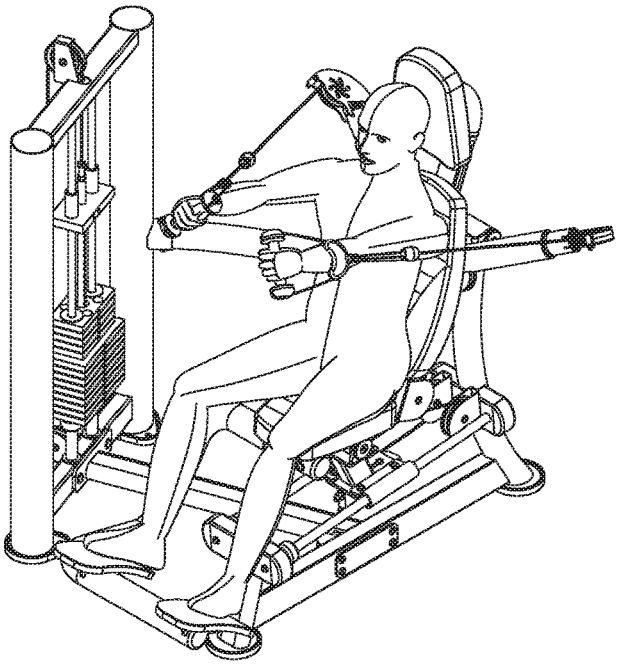
FIG. 12 illustrates a perspective view of the chest press machine in the end position during use.

FIG. 9 illustrates a perspective view of the chest press machine 100 in the start position. FIG. 10 illustrates a perspective view of the chest press machine 100 in the end position. FIG. 11 illustrates a perspective view of the chest press machine 100 in the start position during use. FIG. 12 illustrates a perspective view of the chest press machine 100 in the end position during use.

As shown, the cable resistance machine 100 may put the user in a seated starting position and, as the handles are moved away from the user's body, deliver a natural forward and return arcing progression applying a continuous and equal amount of resistance. Such a machine may engage the user's chest, shoulders, triceps and core stabilizing muscles during the movement.

The machine 100 may include an "L"-shaped user support 110 having a seat 110, back support 120, footrest, and headrest. Machine 100 may further include a first movement element having a carriage 130 and pair of columns 140 (and/or other appropriate element such as a shaft or rail), a second movement element having a moving attachment element 150 and a fixed column 160, a set of handles 170, a weight stack 180 (and/or other resistance element), and a cable system 190 (and/or other appropriate connecting elements able to couple the resistance element 180 to the handles 170).

The machine frame 100 may be formed by various appropriate elements such as beams, tubes, brackets, etc. The frame elements may be arranged in various appropriate ways, as shown. Many frame elements may be fixed-position elements used to support moving elements such as the user support (via the movement elements), a weight stack, cables, etc. Moving elements such as pulleys may be attached to the frame and included as part of a resistance path used by the machine.

The user support may be arranged in various appropriate ways (e.g., with different lengths, connection angles, etc.). In addition, in this example, the user support includes a footrest and headrest while other embodiments may omit either or both, as appropriate. In some embodiments, the supports may include adjustable elements that may allow a user to align a body part with a machine feature and/or otherwise adjust the user position (e.g., by raising or lowering the seat to adjust for a user's height).

The seat 110 may include a pivot axis associated with a connection to the carriage 130, as shown. In this example, the carriage may include multiple through-holes that are able to accept an axle attached to the seat 110. Such a pivot axis may include various appropriate mechanical components, such as rotary bearings, sleeves, caps, etc.

Likewise, the attachment element 150 may include a pivot axis, as shown. In this example, the pivot axis is associated with a connection to a frame support member of the machine 100 where the frame support member may include an axle and the attachment element 150 may include a pair of through-holes and/or other appropriate elements (e.g., bearings, guides, etc.).

The seat back 120 may substantially cover a sleeve portion of the attachment element 150 associated with column 160, needing only a linear slot to allow movement of the attachment element 150 along the column 160. In this view, part of the seat back 120 support has been cut away so that the complete attachment element 150 and column 160 are visible. In addition to cosmetic improvement, the concealed column approach increases user safety by exposing fewer moving parts.

As shown, the angle of the user support relative to the other machine components may change along the movement path while the position of the user relative to the user support remains consistent.

In some embodiments the second movement element may include a member having one or more bend angles and multiple pivot points. In some embodiments, a first pivot point may be associated with an attachment of one end of the angled member to the machine body and a second pivot point may be associated with an attachment of a second end of the angled member to the fixed user support. In some embodiments the second movement element may be integrated with the user interface element.

The carriage 130 may include any set of components that may allow the carriage to move along the rail 140. This example uses columns and sleeves, and other embodiments may include elements such as linear bearings, glides, rails, etc. In some embodiments, the first movement element may include one or more resistance elements (e.g., a linear resistance bar).

In this example, the columns 140 slope relative to the ground while the attachment element 150 forms an obtuse angle with the seat back 120. Different embodiments may include different specific configurations.

The movement path along the columns 140 may be at least partly defined by attributes of the columns (e.g., slope, length, etc.). Likewise, the movement path along the column 160 may be at least partly defined by attributes of the column (e.g., slope, length, etc.). In addition, the movement path of the user may be at least partly defined by placement of the pivot axis (or axes) relative to the attachment element 150 or seat back 120 and/or the pivot axis relative to the carriage 130 or seat 110. In some embodiments, any or all of these elements may be adjusted by a user (e.g., slope of the rail may be changed, a connection element may be repositioned, etc.).

The weight stack 180, in this example, is positioned to the side of the user support. Such an arrangement may allow a user to adjust the amount of resistance while seated on the machine 100. In addition, such an arrangement may reduce the floor space required by the machine.

A single machine may be used to perform multiple exercise movements. In some embodiments, the machine may be adjusted in various ways (e.g., support arms or other features may be arranged such that cable and/or handle positions are changed, a support angle or position may be changed, a movement element may be repositioned, etc.) to perform various different movements.

Alternatively, a user may apply a different movement path to use the same machine to perform different movements without any adjustments to the machine itself. For instance, a user may perform a chest fly movement rather than a press movement by varying arm position, elbow angle, etc.

Although the theory of operation has been described by reference to particular machines, one of ordinary skill in the art will recognize that different machines may be implemented in various different ways. Several such machines are described in Section II below.

II. Exemplary Machines

Sub-section II.A provides a conceptual description of an overhead press machine of some embodiments. Sub-section MB follows with a description of a biceps curl machine of some embodiments. Next, sub-section II.C describes an overhead pull machine of some embodiments. Sub-section II.D then describes a seated row machine of some embodiments. Next, Sub-section ILE then describes a triceps press machine of some embodiments. Sub-section II.F then describes a leg press machine of some embodiments. Sub-section II.G follows with a description of a leg extension machine of some embodiments. Next, sub-section II.H describes a leg curl machine of some embodiments. Lastly, sub-section II.I describes various other machines or elements that may be used by some embodiments.

A. Overhead Press

Figure 13:
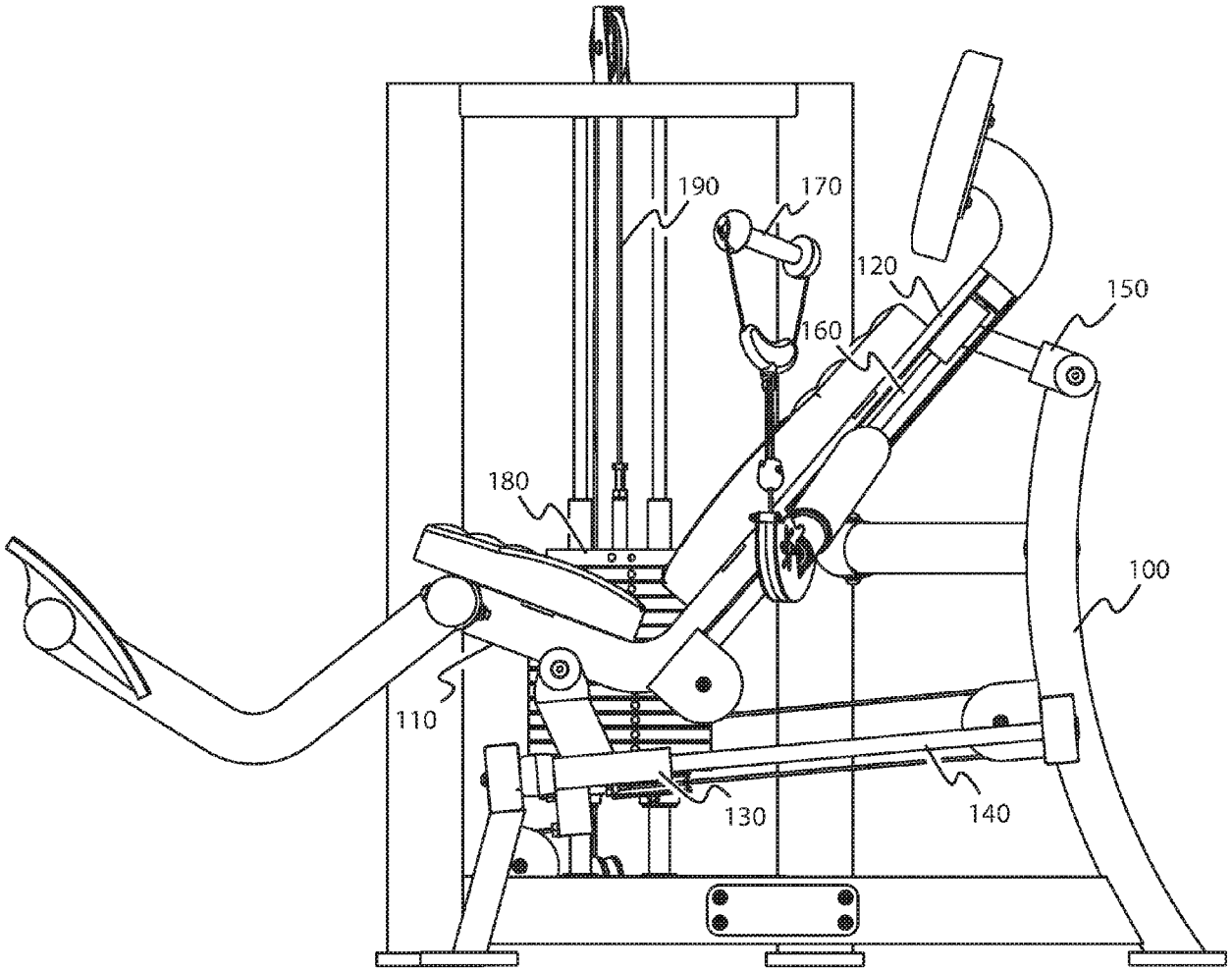
FIG. 13 illustrates a side view of an overhead press machine according to an exemplary embodiment in a start position.
Figure 14:
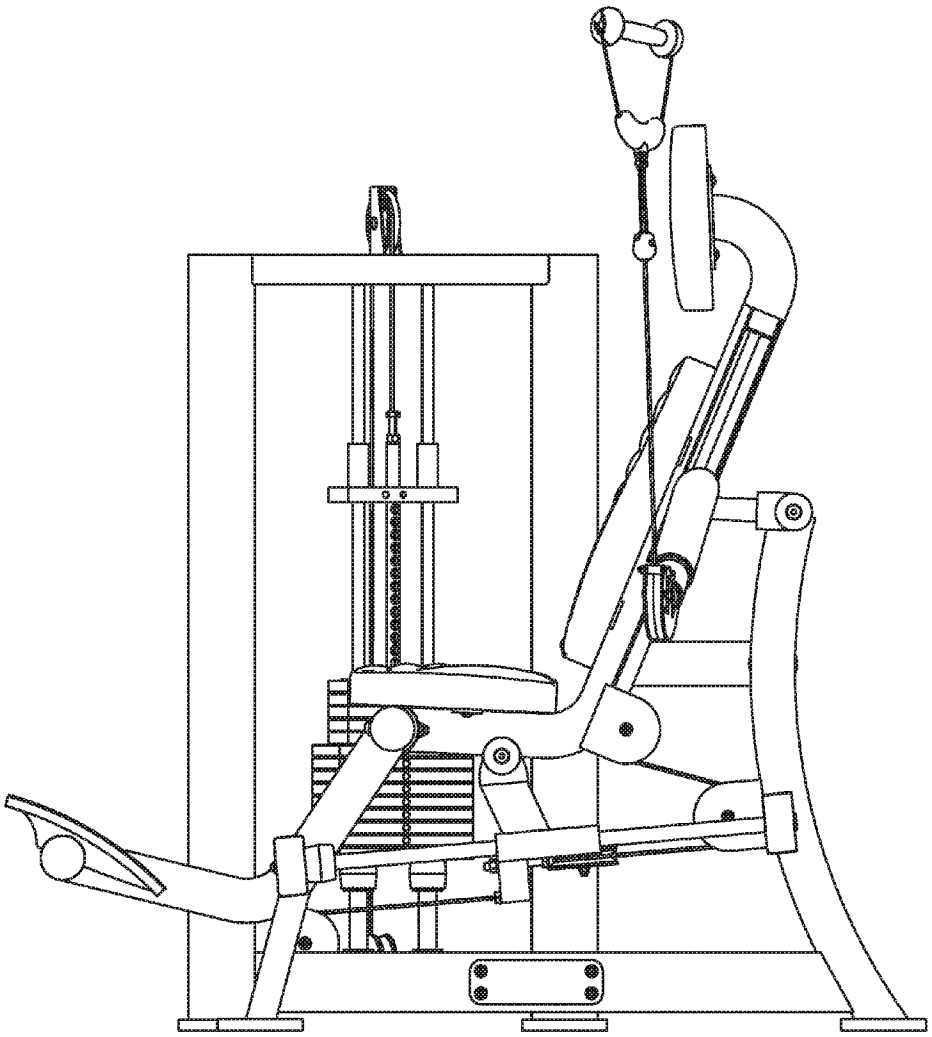
FIG. 14 illustrates a side view of the overhead press machine in an end position.
Figure 15:
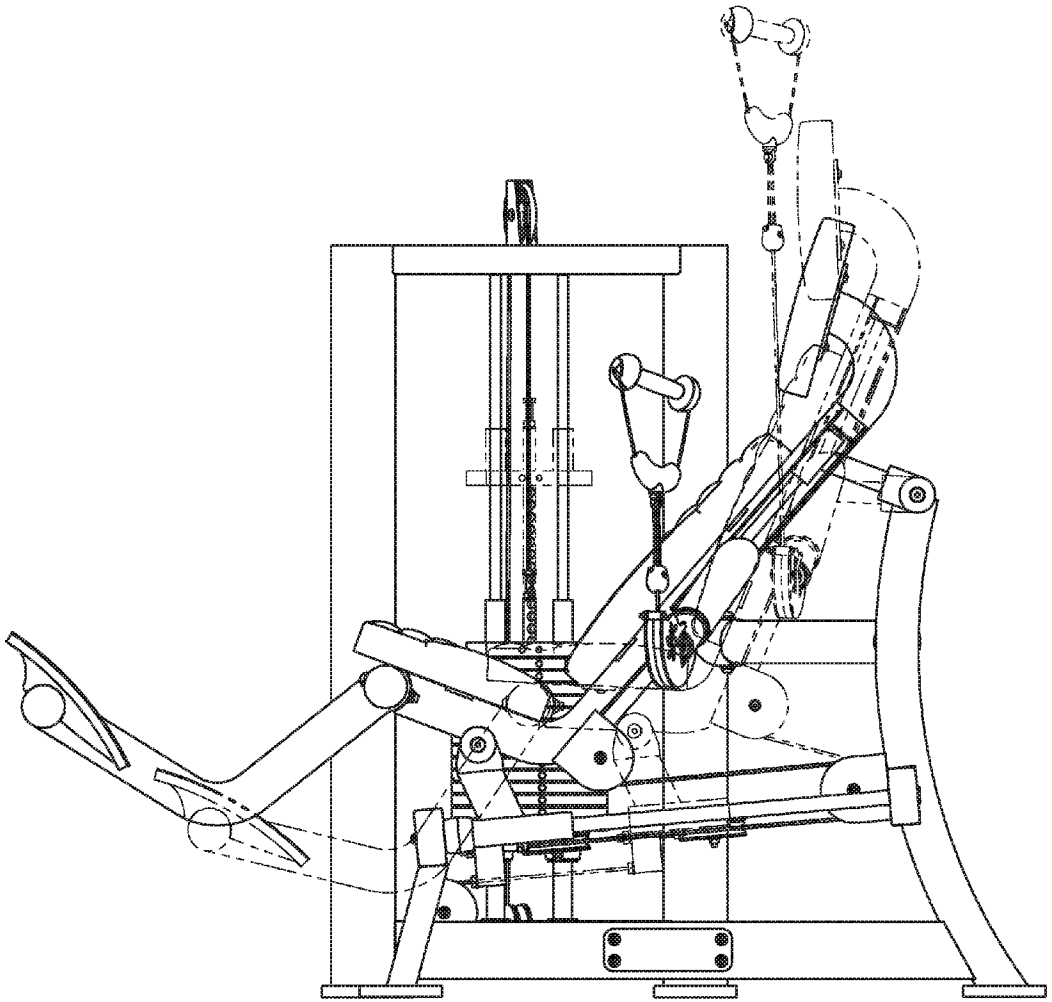
FIG. 15 illustrates a side view of the overhead press machine showing the relative arrangements of the start position and end position.
Figure 16:
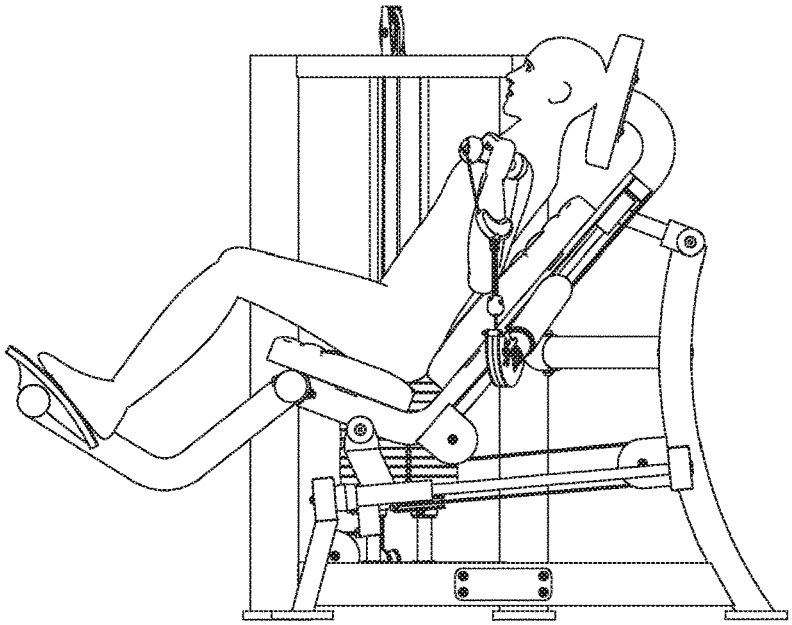
FIG. 16 illustrates a side view of the overhead press machine in the start position during use.
Figure 17:
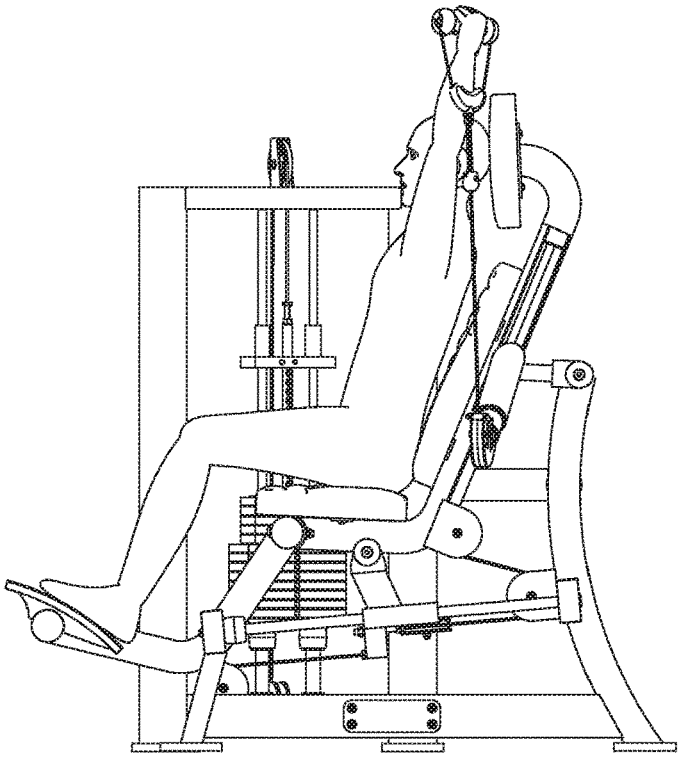
FIG. 17 illustrates a side view of the overhead press machine in the end position during use.
Figure 18:
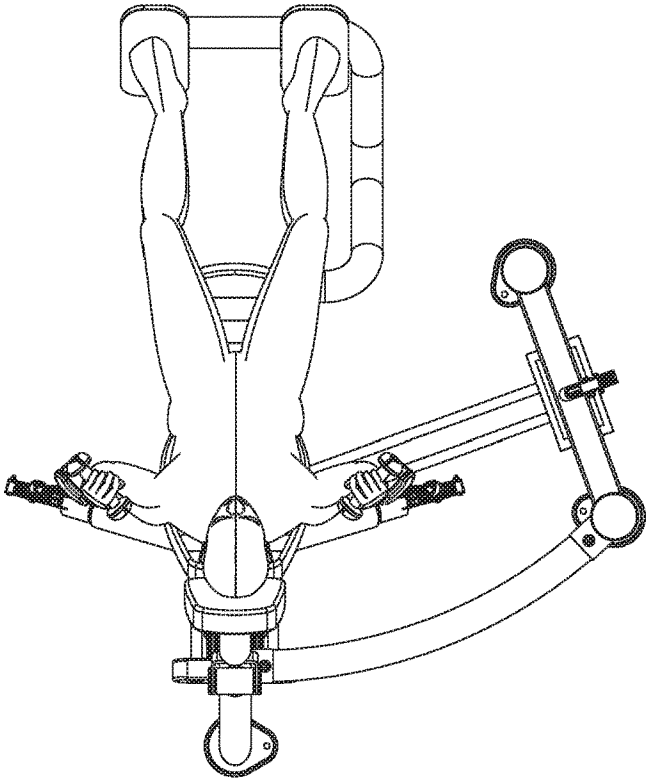
FIG. 18 illustrates a top view of the overhead press machine in the start position during use.
Figure 19:
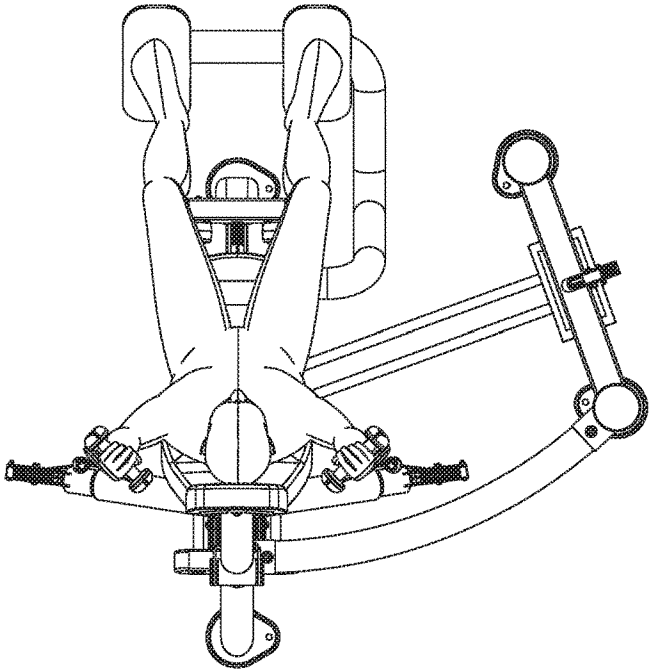
FIG. 19 illustrates a top view of the overhead press machine in the end position during use.
Figure 20:
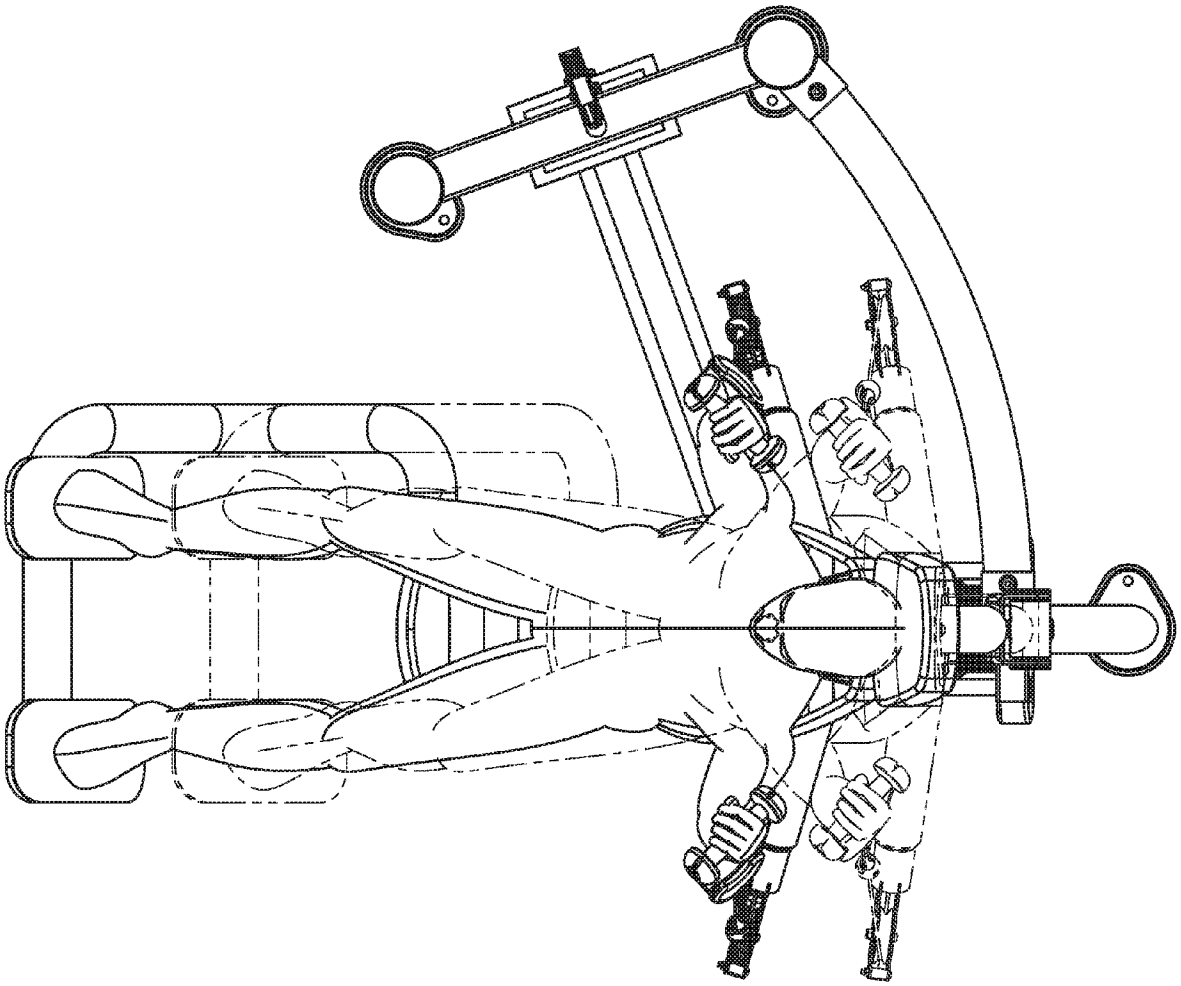
FIG. 20 illustrates a top view of the overhead press machine showing the relative arrangements of the start position and end position during use.
Figure 21:
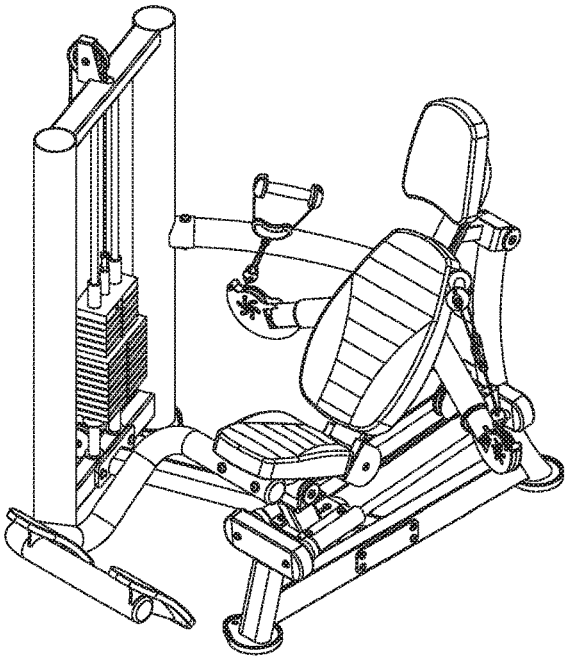
FIG. 21 illustrates a perspective view of the overhead press machine in the start position.
Figure 22:
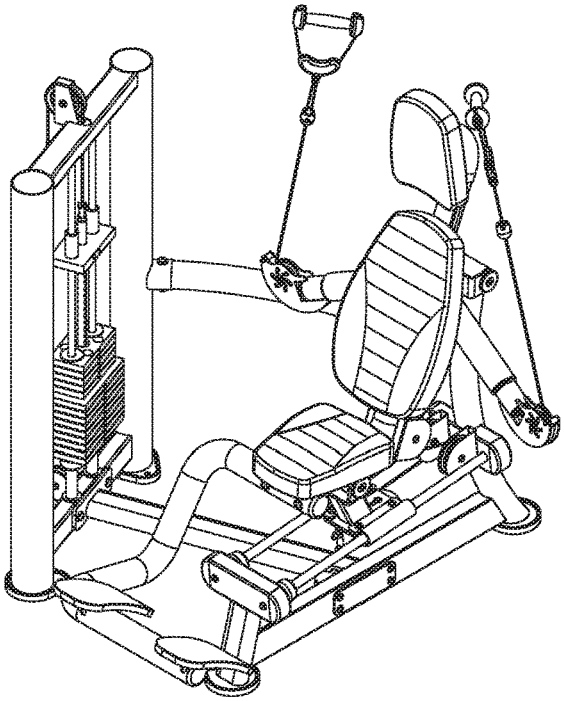
FIG. 22 illustrates a perspective view of the overhead press machine in the end position.
Figure 23:
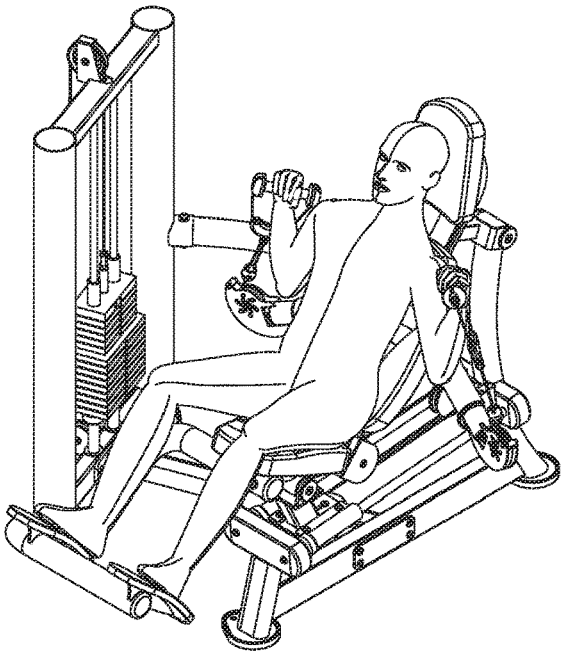
FIG. 23 illustrates a perspective view of the overhead press machine in the start position during use.
Figure 24:
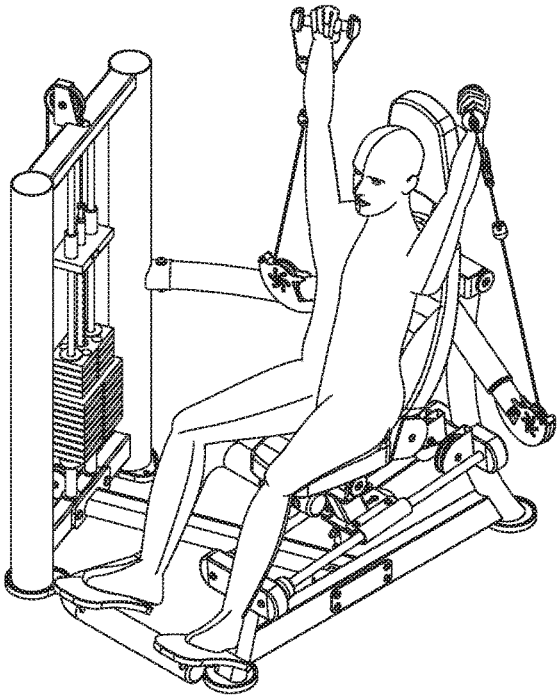
FIG. 24 illustrates a perspective view of the overhead press machine in the end position during use.

FIGS. 13-15 illustrate side views of an overhead press machine. FIGS. 16-20 illustrate side and top views of the overhead press machine during use. FIGS. 21-22 illustrate perspective views of the overhead press machine. FIGS. 23-24 illustrate perspective views of the overhead press machine during use.

In this example, the cable resistance machine puts the user in a seated starting position with arms bent at the elbow and hands positioned to the side of the shoulders. The movement includes an upward pressing motion with the unrestricted cable driven press handles to deliver a natural forward and return arcing progression while applying a continuous and equal amount of resistance. The user's shoulders, latissimus, triceps and core stabilizing muscles may be engaged during the movement.

The columns 140 (also referred to as a "rail" throughout this specification) in this example slope upward as the movement progresses, while the column 160 is aligned at an obtuse angle compared to the seat back 120.

B. Biceps Curl

Figure 25:
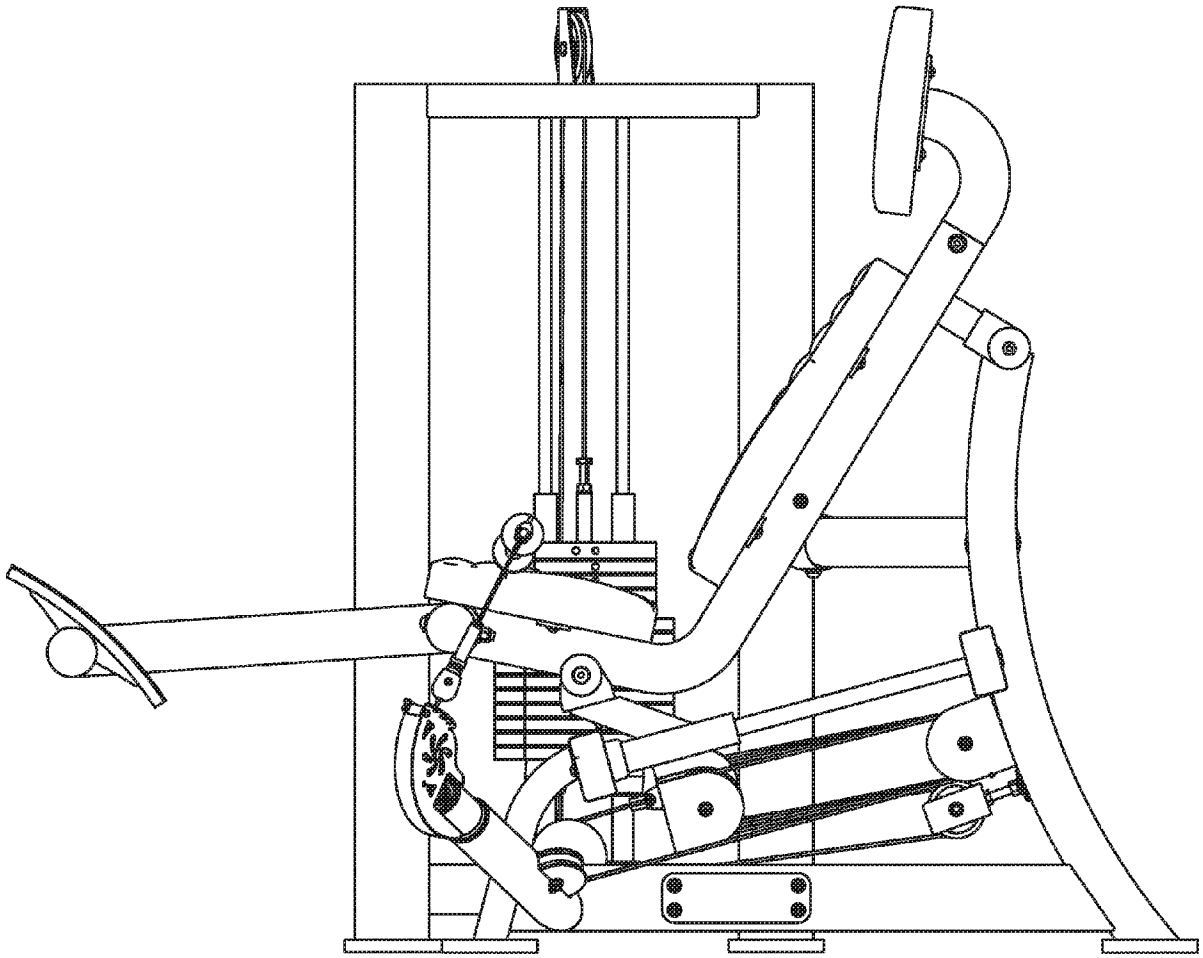
FIG. 25 illustrates a side view of a biceps curl machine according to an exemplary embodiment in a start position.
Figure 26:
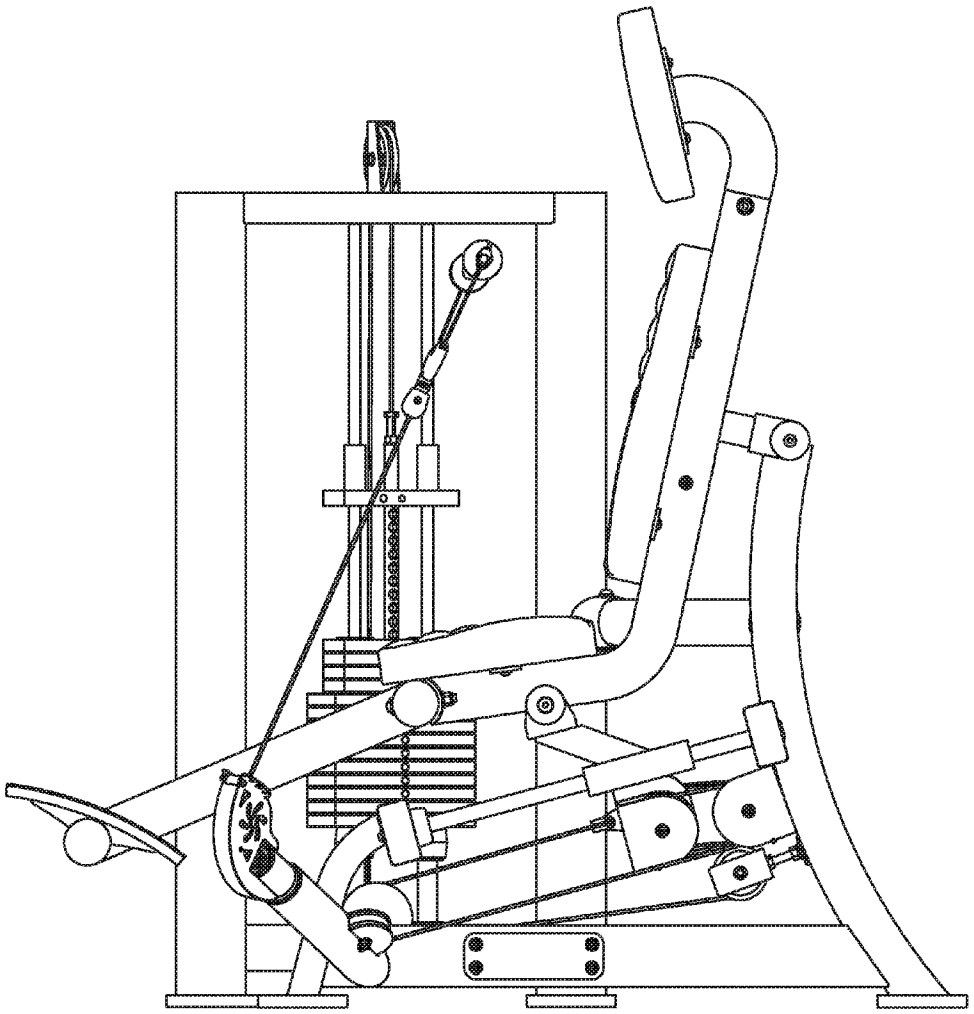
FIG. 26 illustrates a side view of the biceps curl machine in an end position.
Figure 27:
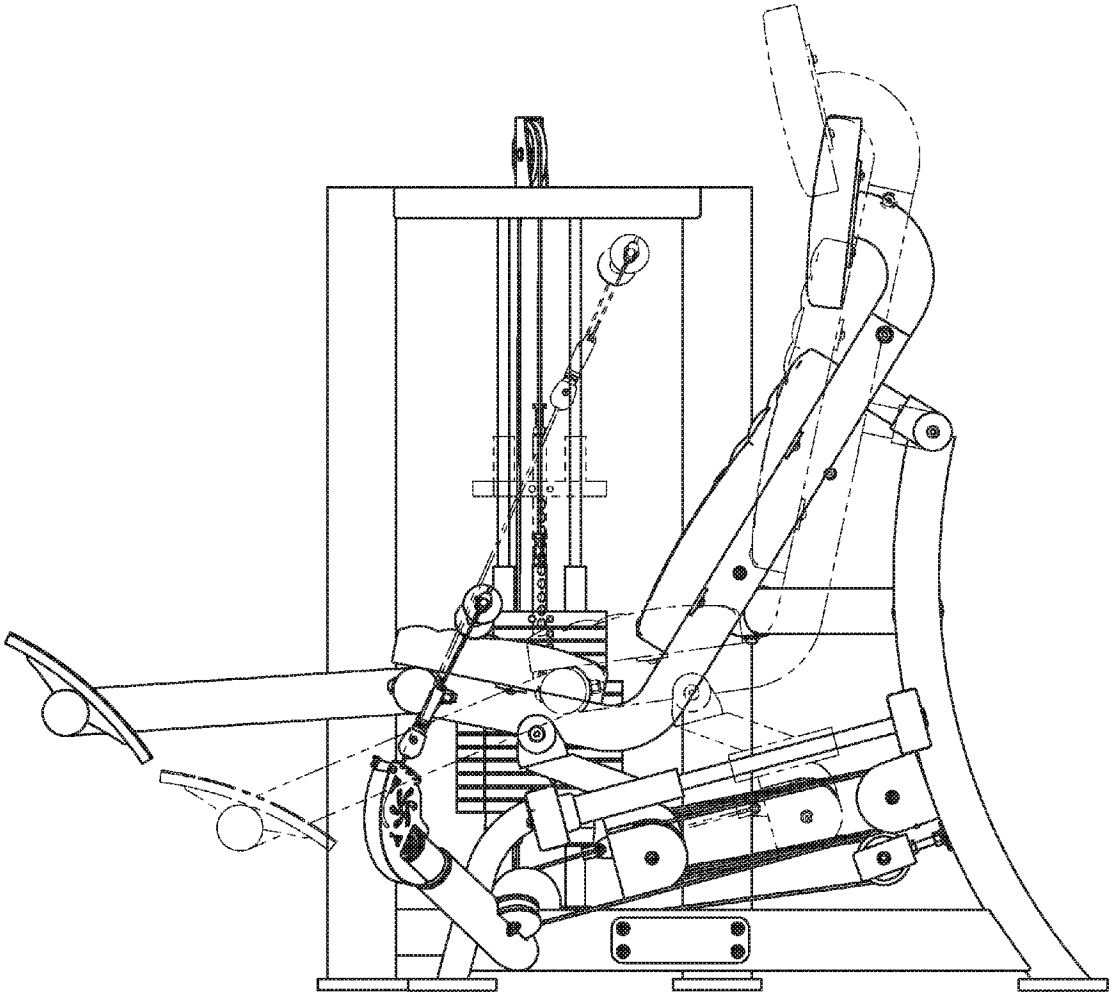
FIG. 27 illustrates a side view of the biceps curl machine showing the relative arrangements of the start position and end position.
Figure 28:
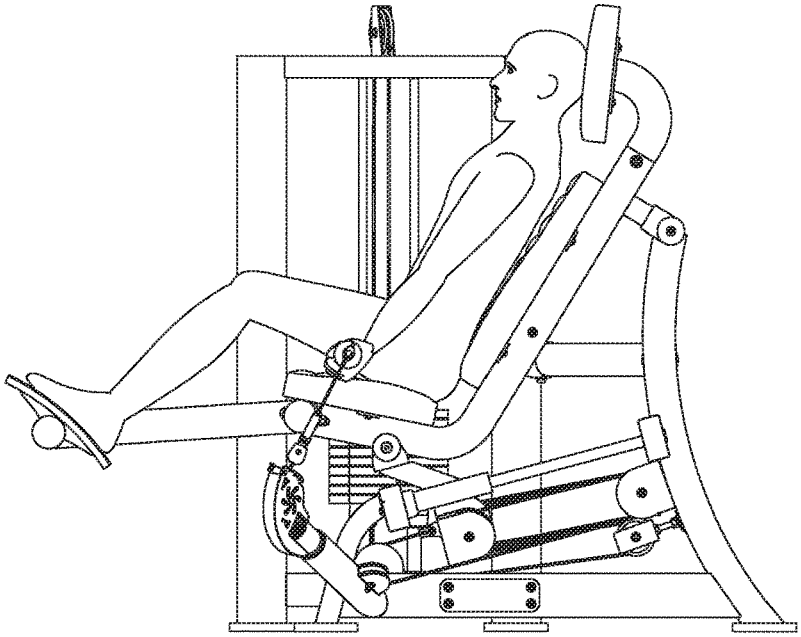
FIG. 28 illustrates a side view of the biceps curl machine in the start position during use.
Figure 29:
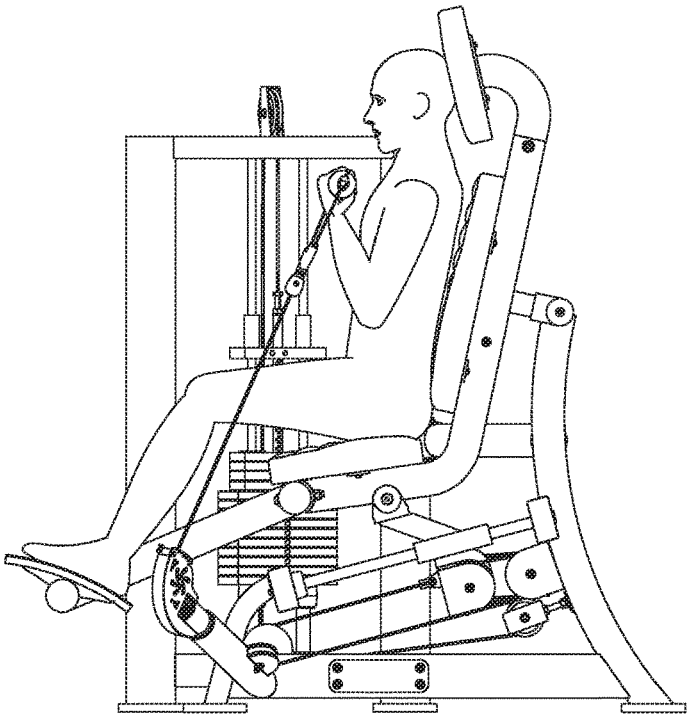
FIG. 29 illustrates a side view of the biceps curl machine in the end position during use.
Figure 30:
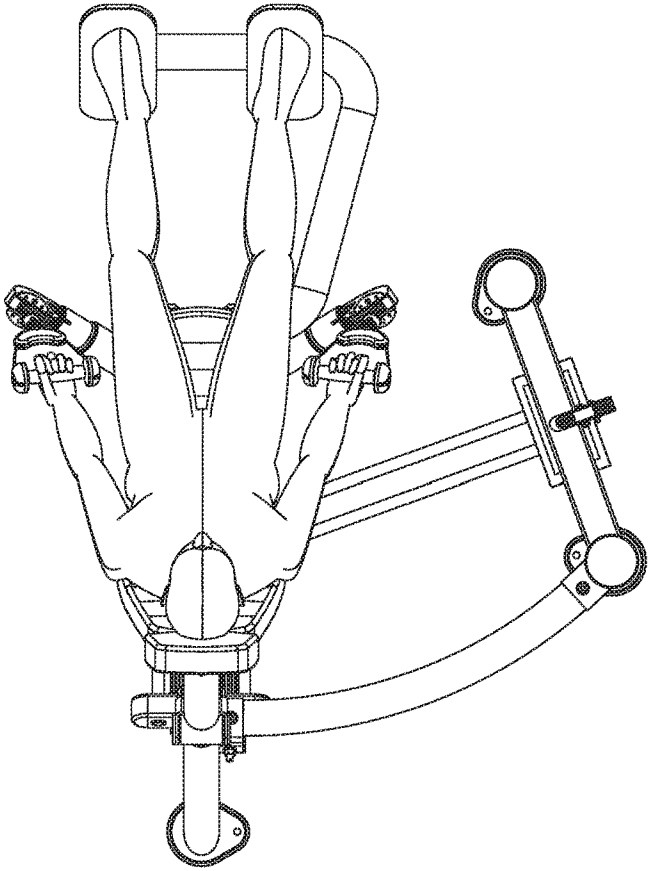
FIG. 30 illustrates a top view of the biceps curl machine in the start position during use.
Figure 31:
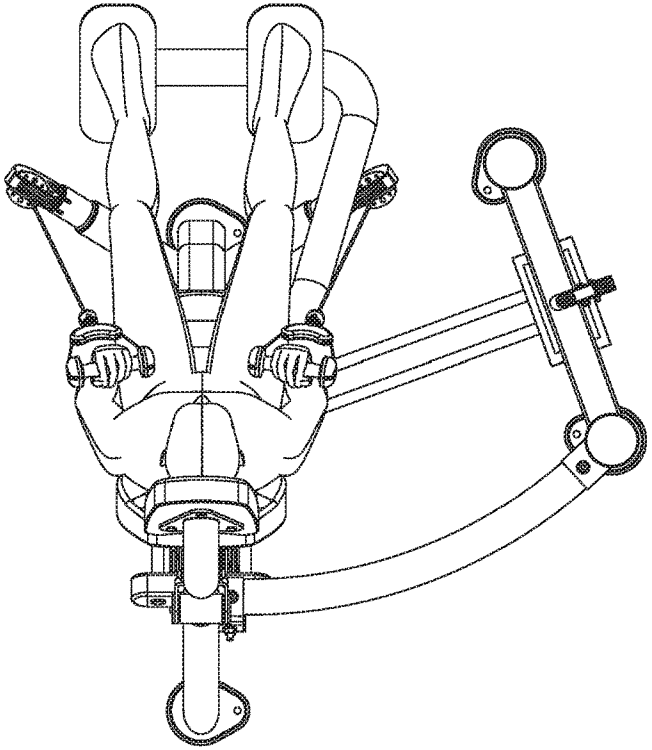
FIG. 31 illustrates a top view of the biceps curl machine in the end position during use.
Figure 32:
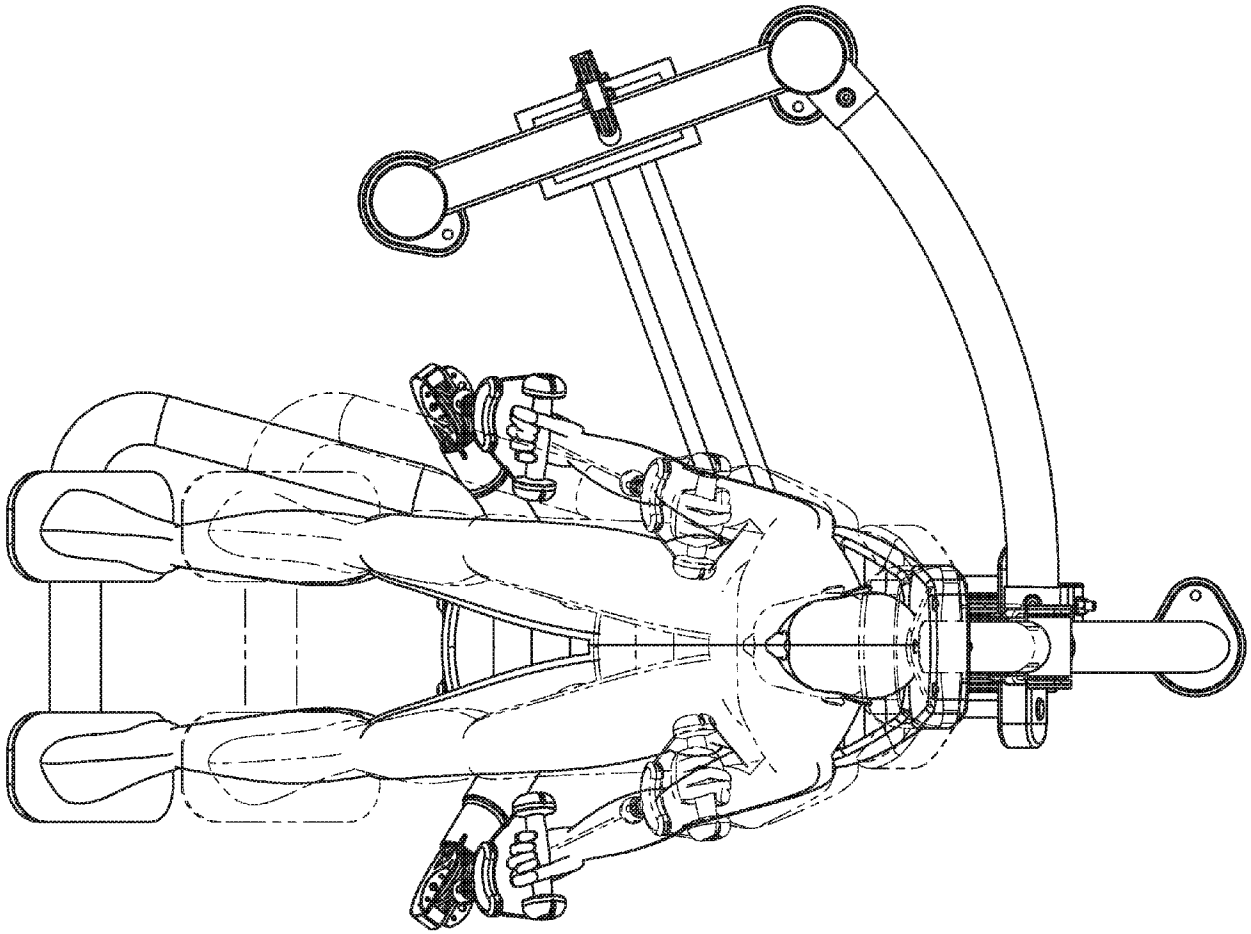
FIG. 32 illustrates a top view of the biceps curl machine showing the relative arrangements of the start position and end position during use.
Figure 33:
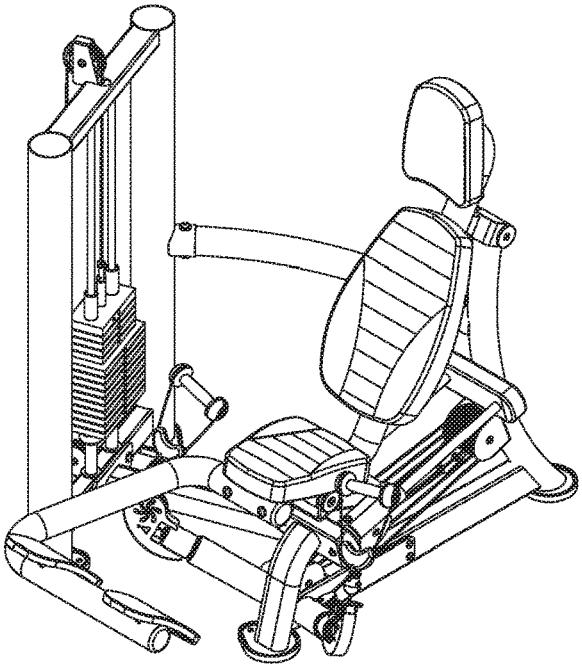
FIG. 33 illustrates a perspective view of the biceps curl machine in the start position.
Figure 34:
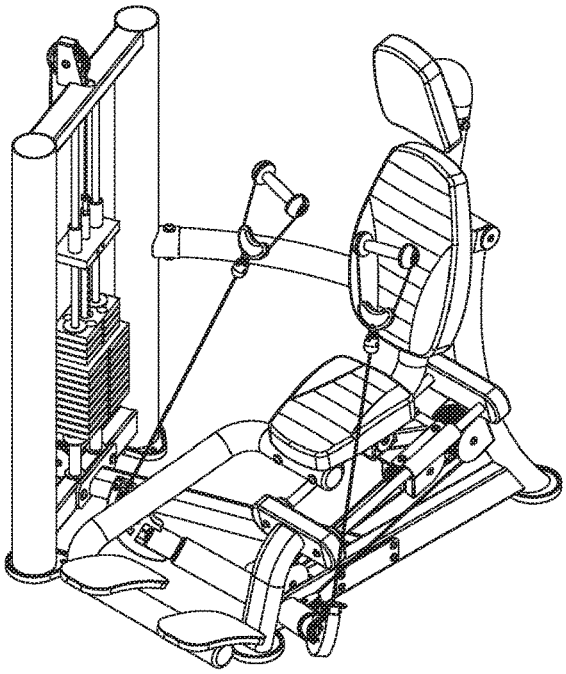
FIG. 34 illustrates a perspective view of the biceps curl machine in the end position.
Figure 35:
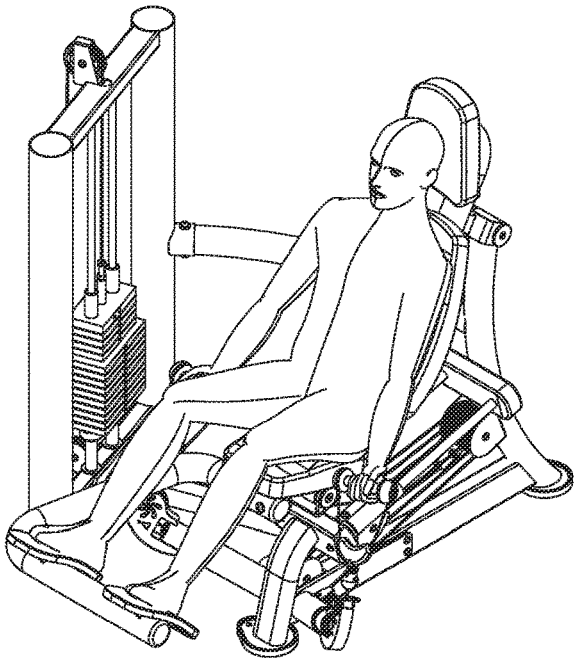
FIG. 35 illustrates a perspective view of the biceps curl machine in the start position during use.
Figure 36:
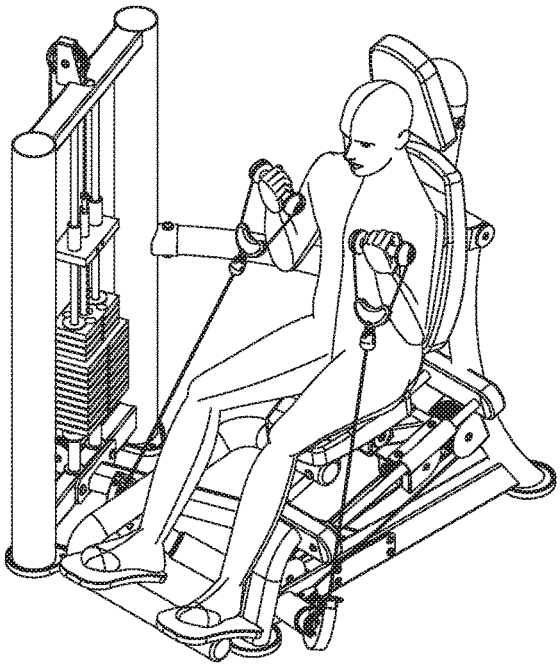
FIG. 36 illustrates a perspective view of the biceps curl machine in the end position during use.

FIGS. 25-27 illustrate side views of a biceps curl machine. FIGS. 28-32 illustrate side and top views of the biceps curl machine during use. FIGS. 33-34 illustrate perspective views of the biceps curl machine. FIGS. 35-36 illustrate perspective views of the biceps curl machine during use.

In this example, the cable resistance machine puts the user in a seated starting position and by the isolated upward curling at the pivot of the middle arm holding the "unrestricted" cable driven handles with the user's palms facing up, delivers a natural forward and return arcing progression applying a continuous and equal amount of resistance. The user's biceps, forearms and core stabilizing muscles may be engaged during the movement.

The rail 140 in this example slopes upward as the movement progresses, while the hidden column 160 is aligned at an obtuse angle compared to the seat.

C. Overhead Pull

Figure 37:
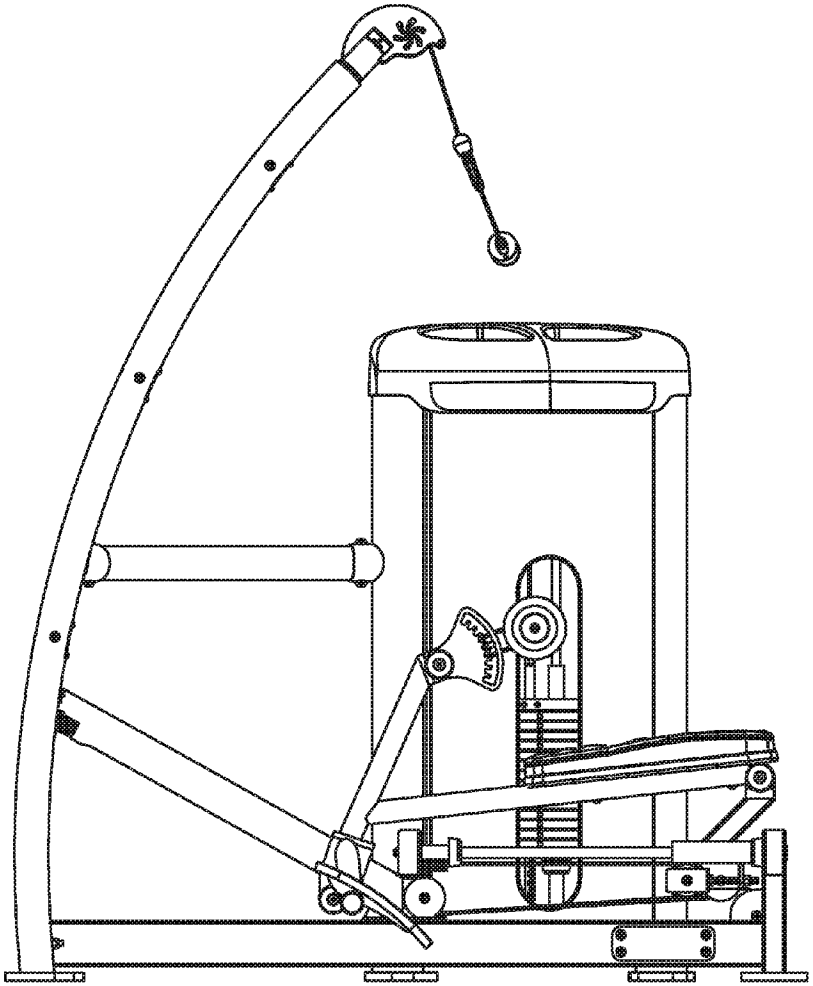
FIG. 37 illustrates a side view of an overhead pull machine according to an exemplary embodiment in a start position.
Figure 38:
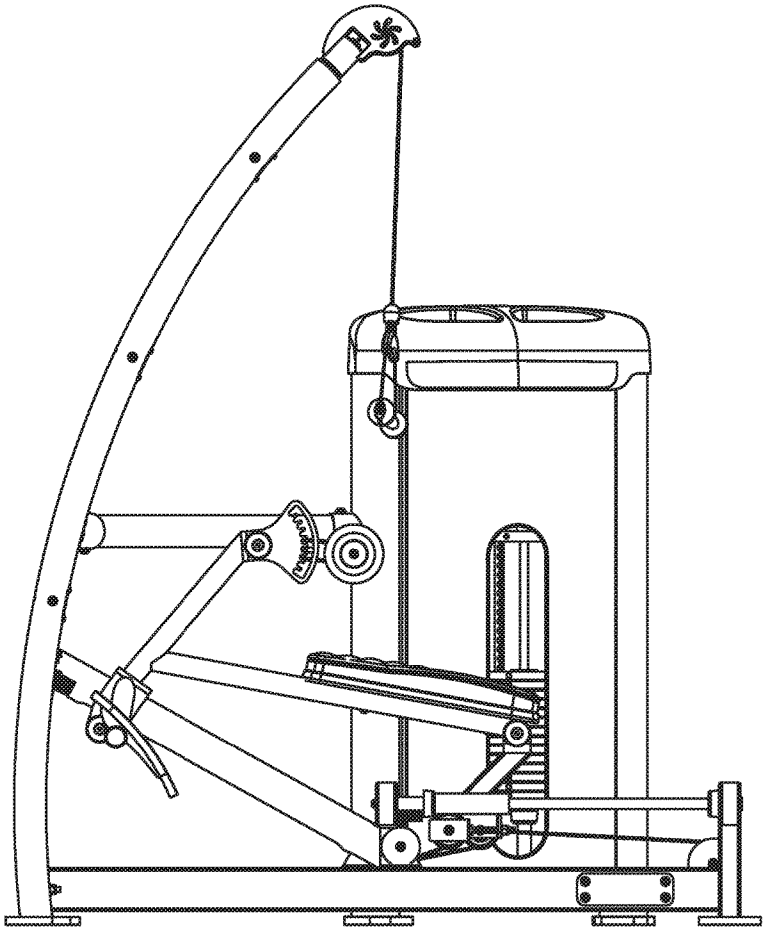
FIG. 38 illustrates a side view of the overhead pull machine in an end position.
Figure 39:
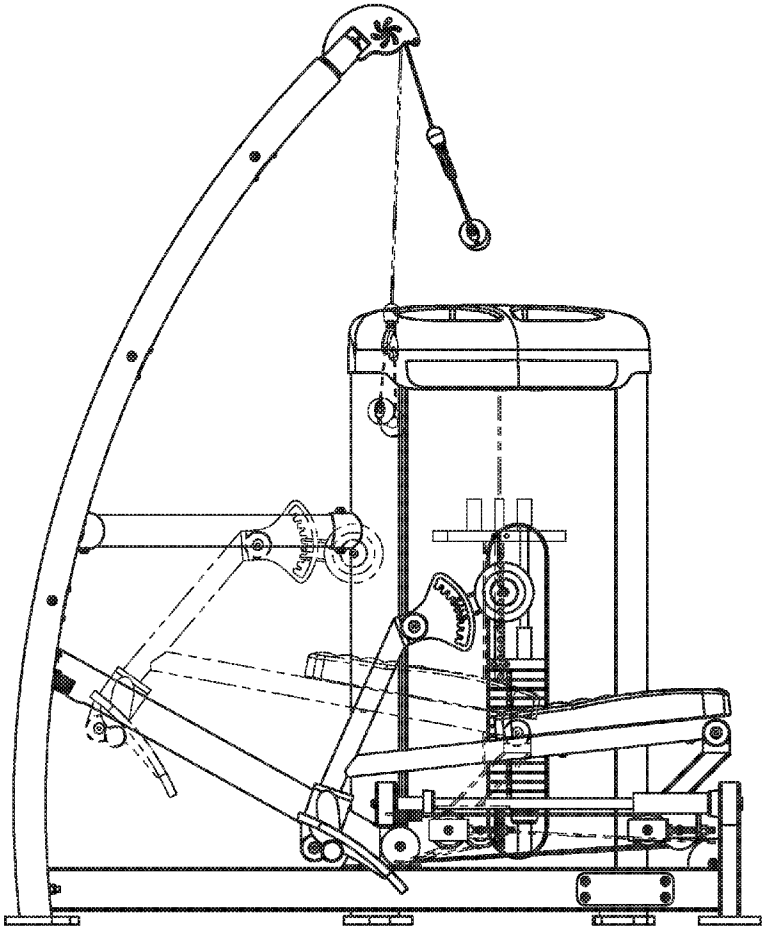
FIG. 39 illustrates a side view of the overhead pull machine showing the relative arrangements of the start position and end position.
Figure 40:
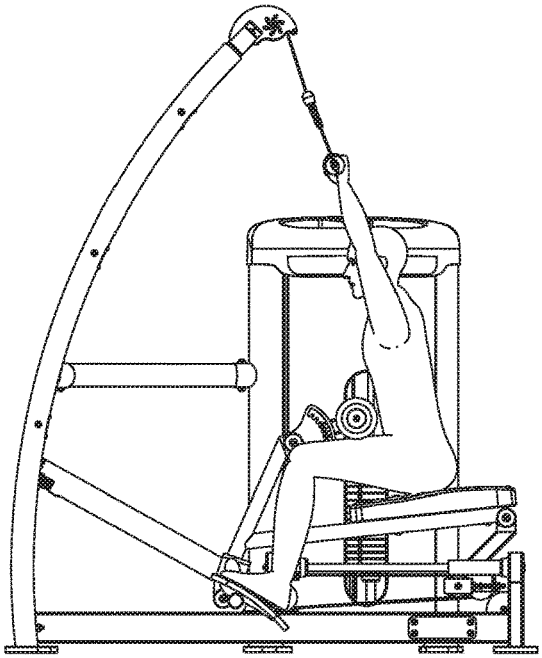
FIG. 40 illustrates a side view of the overhead pull machine in the start position during use.
Figure 41:
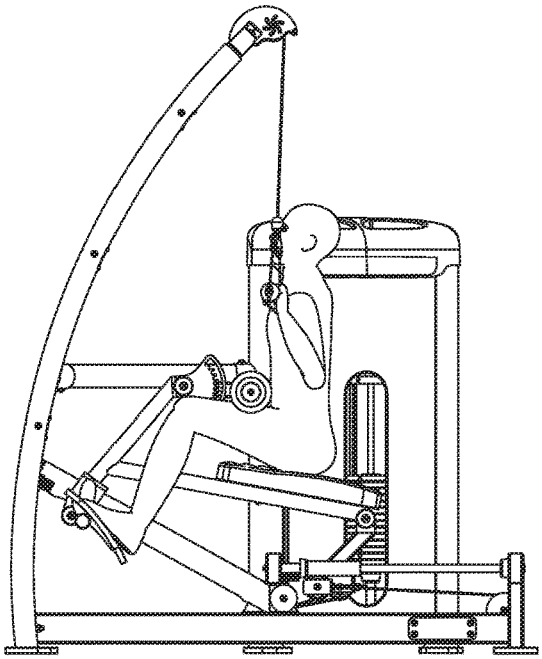
FIG. 41 illustrates a side view of the overhead pull machine in the end position during use.
Figure 42:
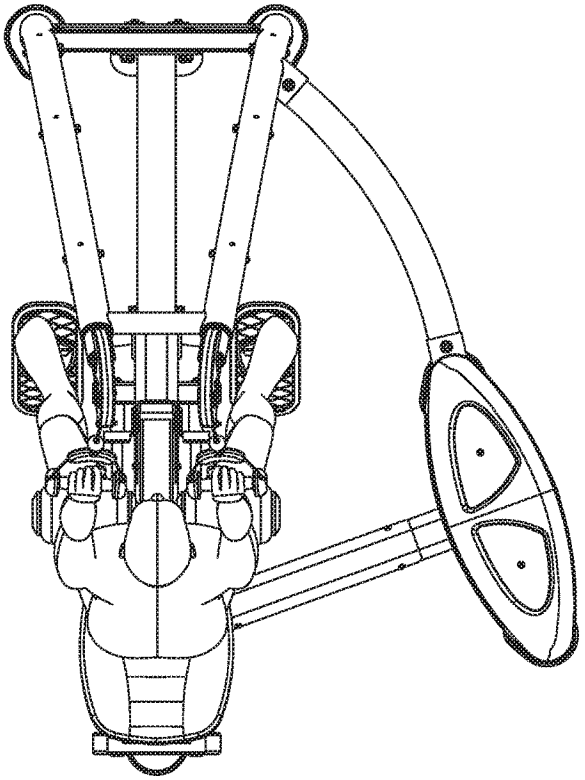
FIG. 42 illustrates a top view of the overhead pull machine in the start position during use.
Figure 43:
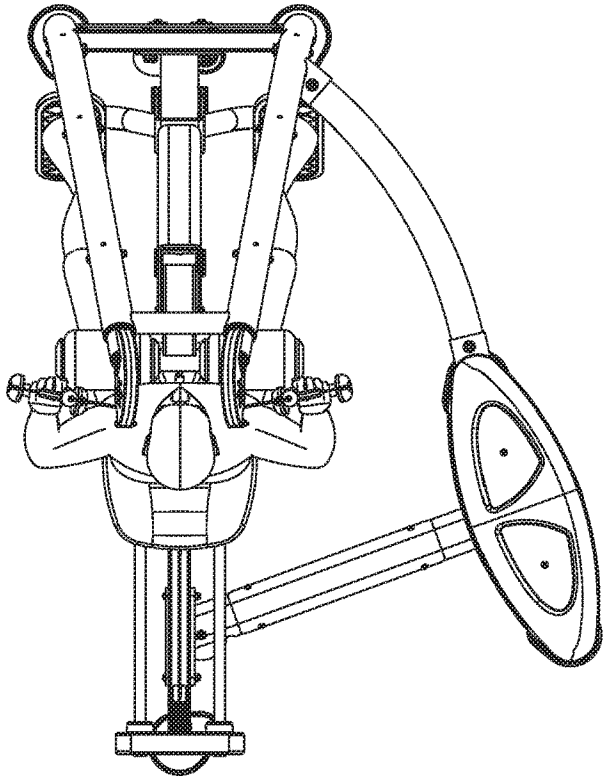
FIG. 43 illustrates a top view of the overhead pull machine in the end position during use.
Figure 44:
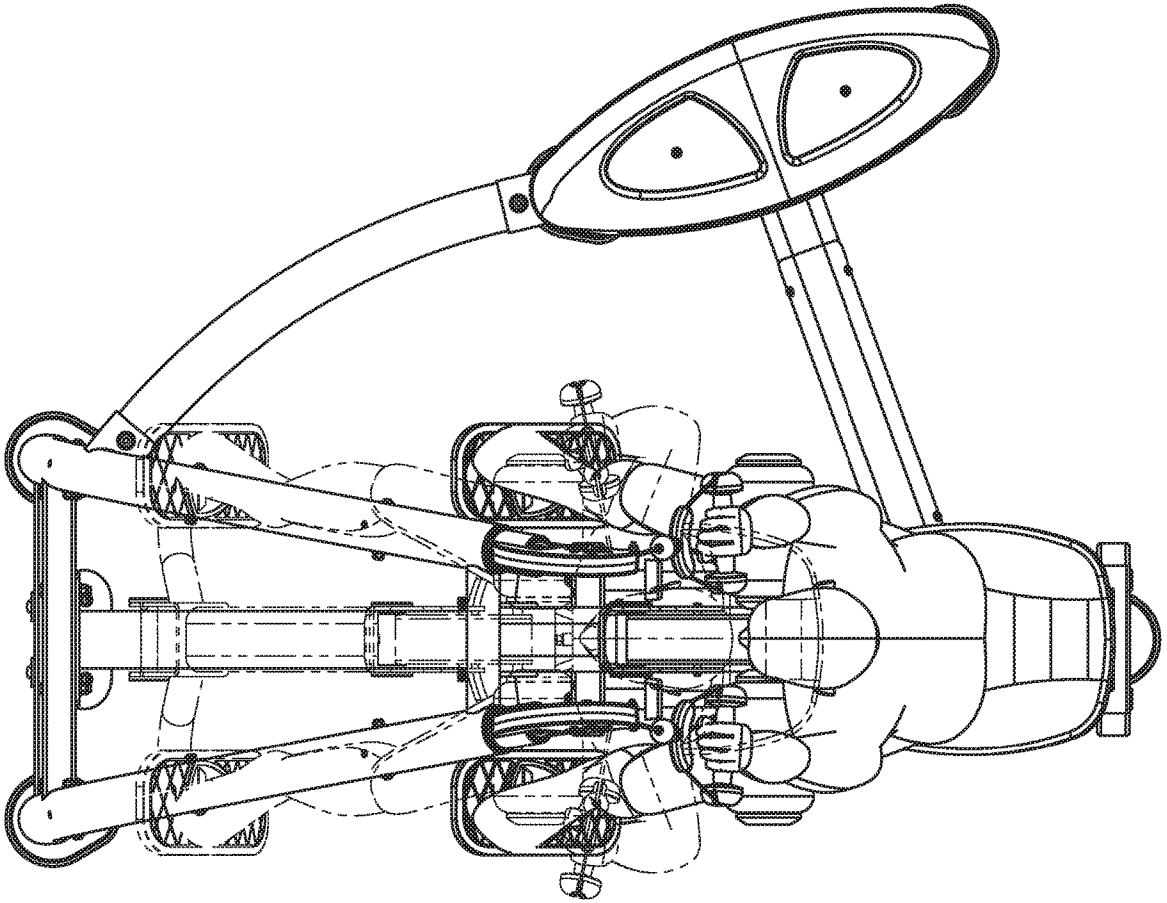
FIG. 44 illustrates a top view of the overhead pull machine showing the relative arrangements of the start position and end position during use.
Figure 45:
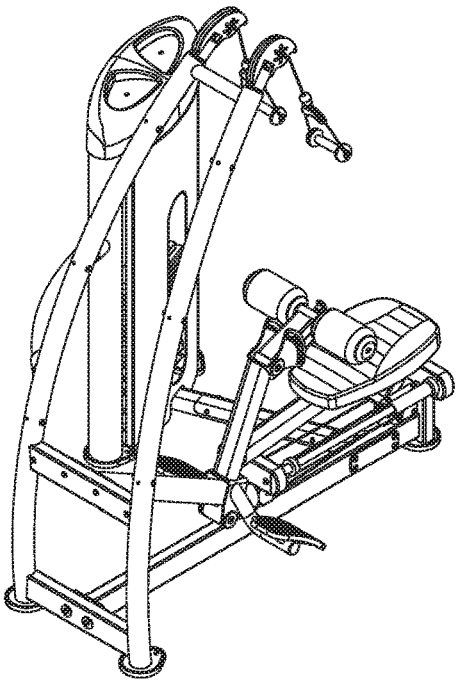
FIG. 45 illustrates a perspective view of the overhead pull machine in the start position.
Figure 46:
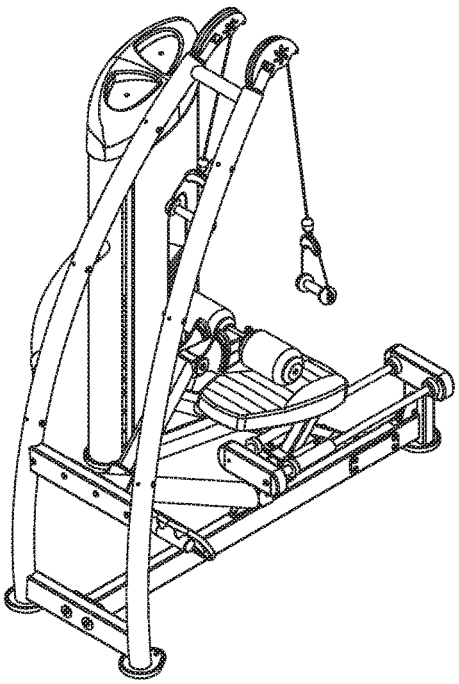
FIG. 46 illustrates a perspective view of the overhead pull machine in the end position.
Figure 47:
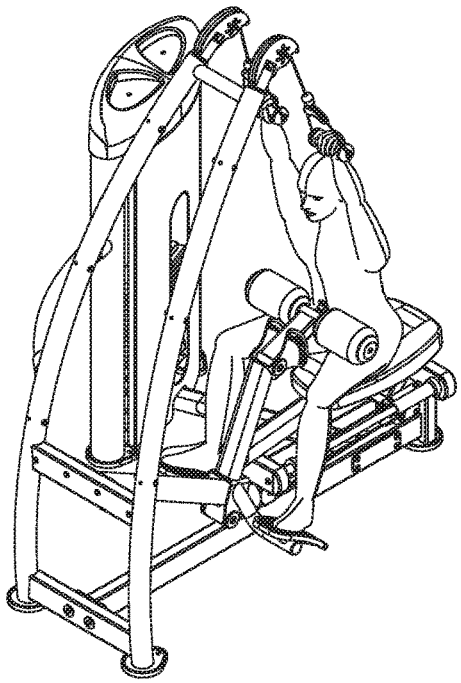
FIG. 47 illustrates a perspective view of the overhead pull machine in the start position during use.
Figure 48:
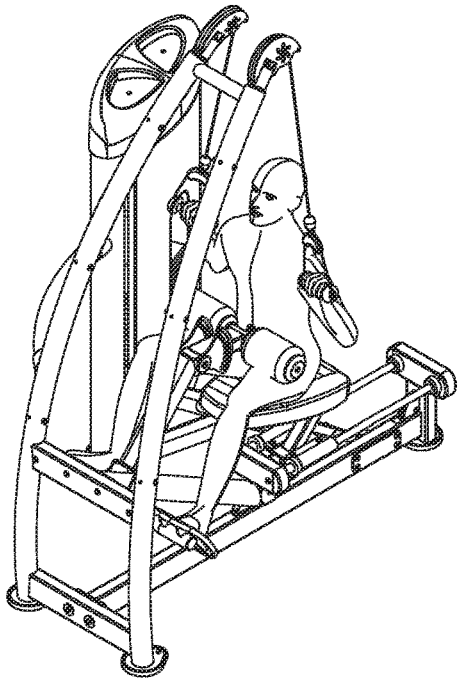
FIG. 48 illustrates a perspective view of the overhead pull machine in the end position during use.

FIGS. 37-39 illustrate side views of an overhead pull machine. FIGS. 40-44 illustrate side and top views of the overhead pull machine during use. FIGS. 45-46 illustrate perspective views of the overhead pull machine. FIGS. 47-48 illustrate perspective views of the overhead pull machine during use.

In this example, the cable resistance machine places the user in a seated position with legs bent in front and supported under hold-down rollers. The user may grasp the two cable driven handles suspended above and use a downward pulling motion to bring each handle down to the upper chest region. While performing the exercise, the seat bench may deliver a natural forward and return arcing progression applying a continuous and equal amount of resistance. The user's latissimus, triceps, deltoids, traps, triceps and core stabilizing muscles may be engaged during the movement.

The rail 140 in this example is flat compared to the ground, while the column 160 is aligned at an obtuse angle compared to the seat and is situated in front of the user during exercise. In addition, this example shows a machine that omits any back support element due to the nature of the exercise. Instead, the user is supported by a set of roller bars intended to hold the user's legs in place as the movement is performed.

The machine of FIGS. 37-48 illustrates an example of improved functionality using the system of some embodiments. Currently, many users have to lean out of the way of the bar when performing a pull down (e.g., by leaning back such that the user's head does not interfere with the path of the bar). In contrast, when using the machine of FIGS. 37-48 a user is automatically tilted such that the user's body is able to remain in a fixed position relative to the user support while also positioning the user such that a full repetition may be performed.

In some embodiments, the machine of FIGS. 37-48 may be used to perform a pullover exercise by modifying the arm position and movement during the exercise.

D. Seated Row

Figure 49:
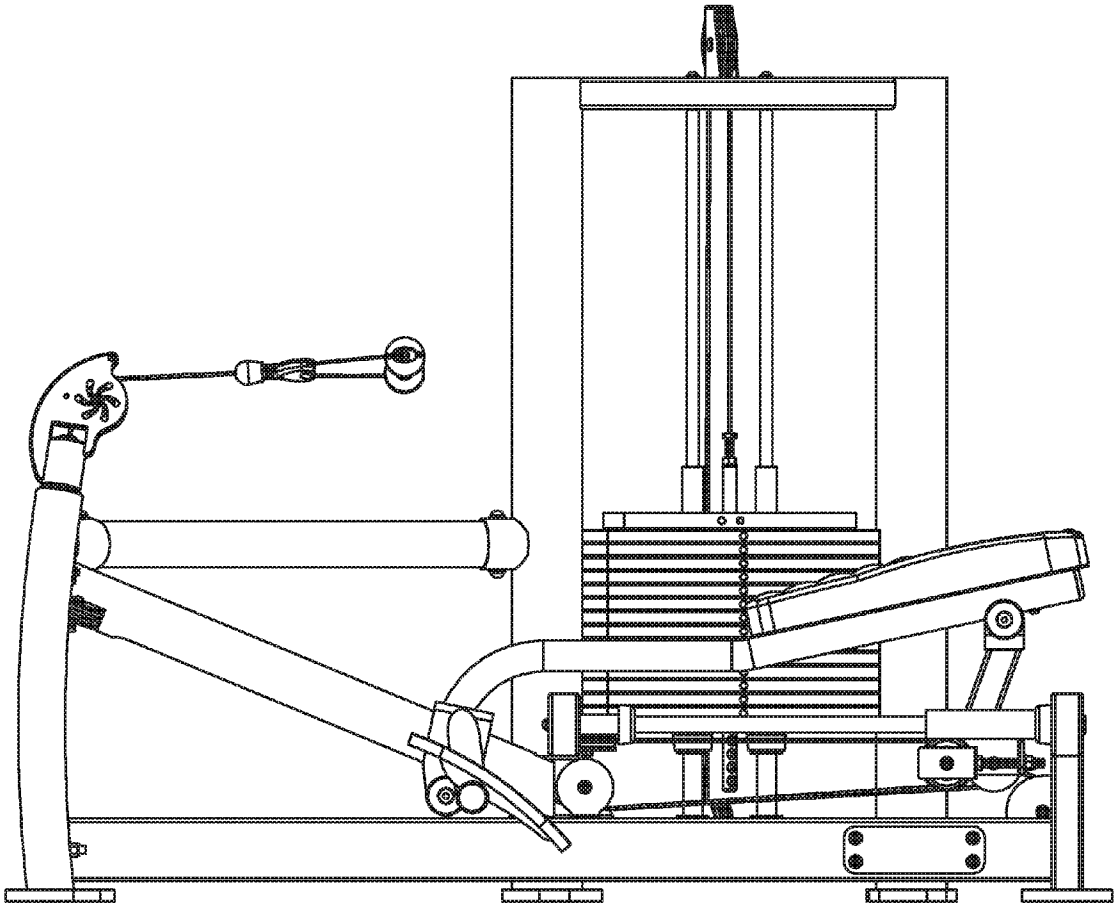
FIG. 49 illustrates a side view of a seated row machine according to an exemplary embodiment in a start position.
Figure 50:
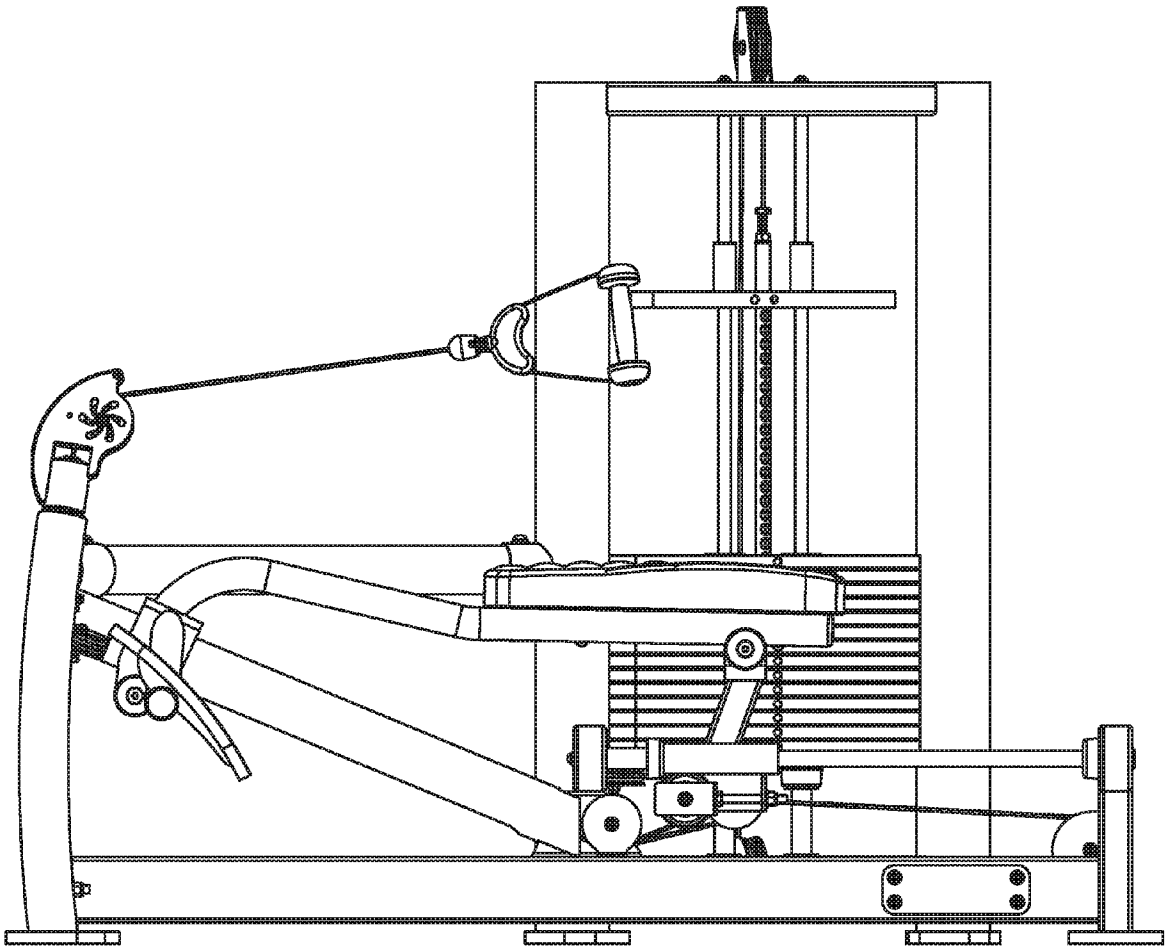
FIG. 50 illustrates a side view of the seated row machine in an end position.
Figure 51:
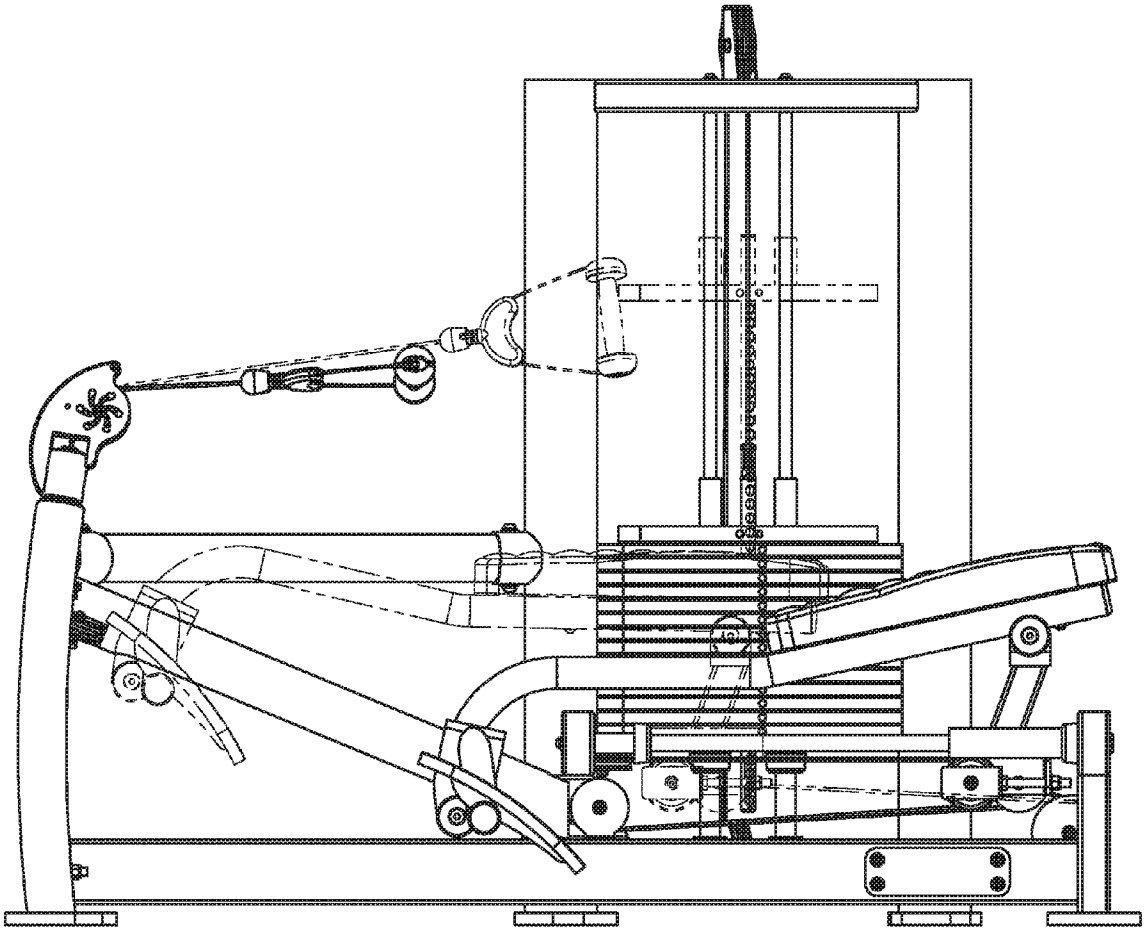
FIG. 51 illustrates a side view of the seated row machine showing the relative arrangements of the start position and end position.
Figure 52:
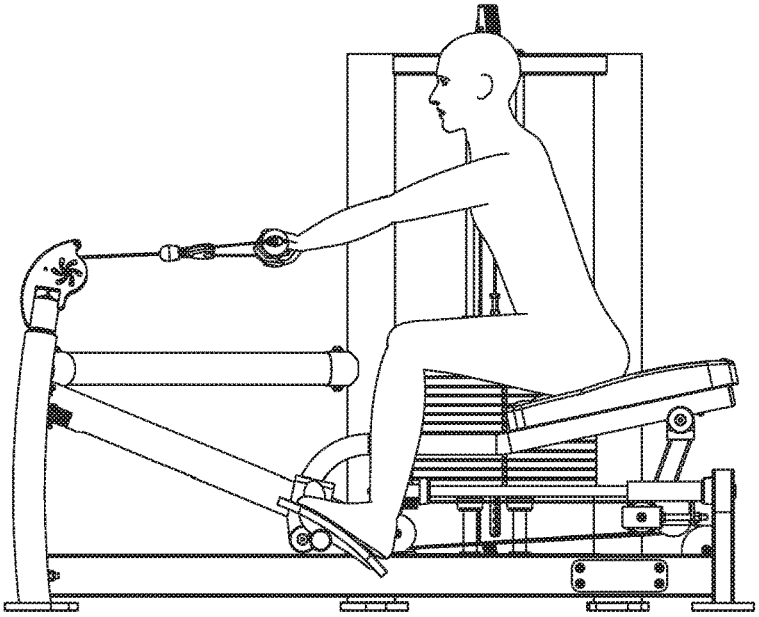
FIG. 52 illustrates a side view of the seated row machine in the start position during use.
Figure 53:
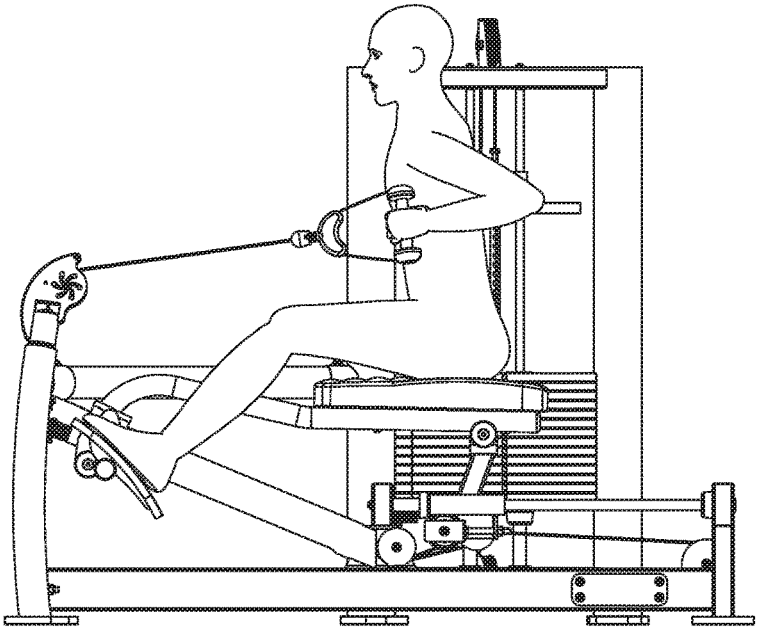
FIG. 53 illustrates a side view of the seated row machine in the end position during use.
Figure 54:
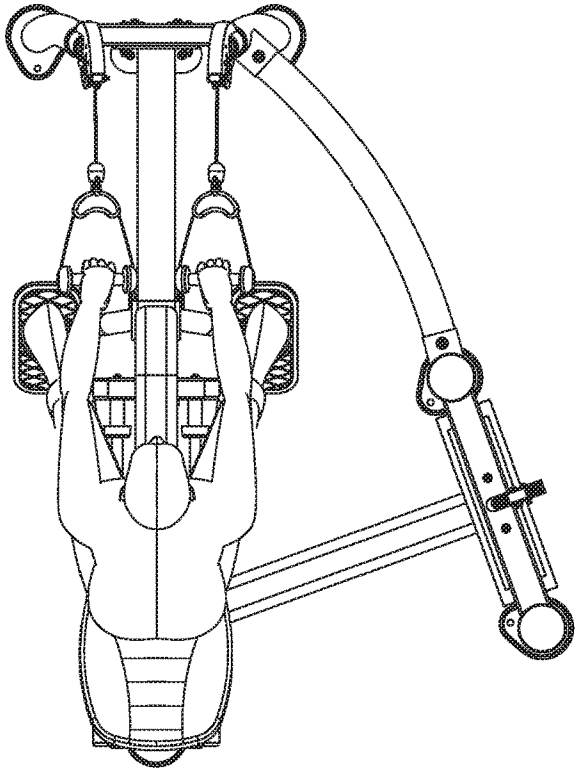
FIG. 54 illustrates a top view of the seated row machine in the start position during use.
Figure 55:
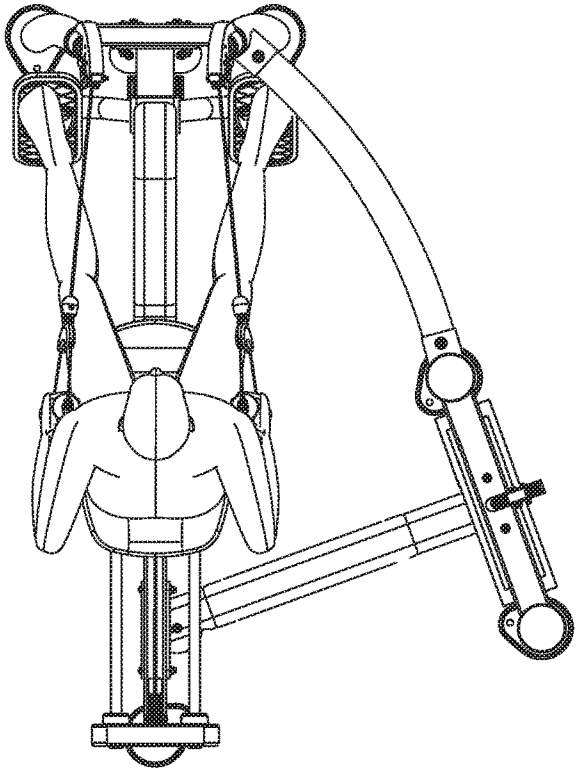
FIG. 55 illustrates a top view of the seated row machine in the end position during use.
Figure 56:
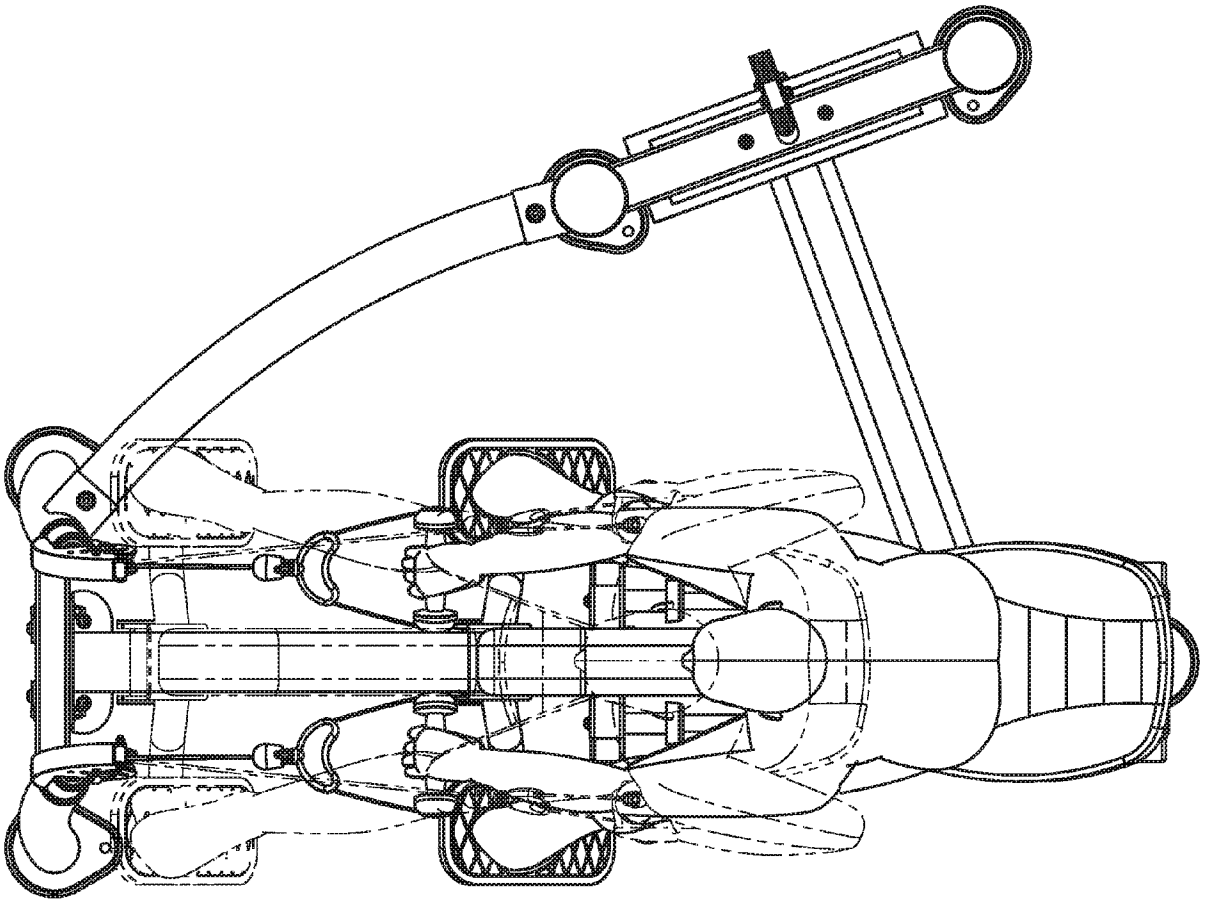
FIG. 56 illustrates a top view of the seated row machine showing the relative arrangements of the start position and end position during use.
Figure 57:
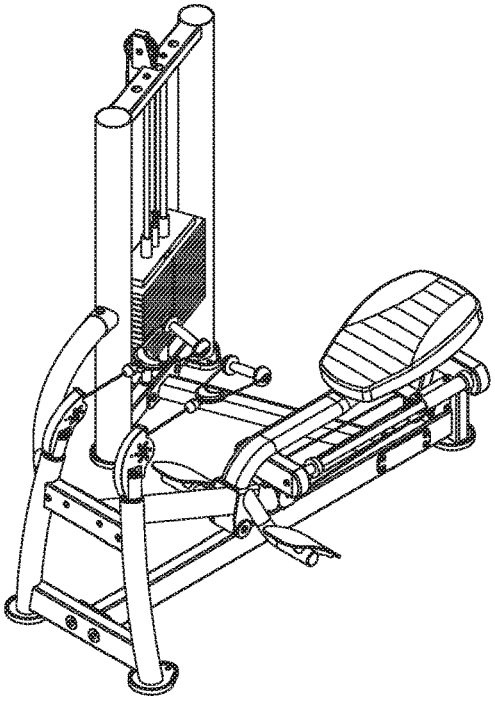
FIG. 57 illustrates a perspective view of the seated row machine in the start position.
Figure 58:
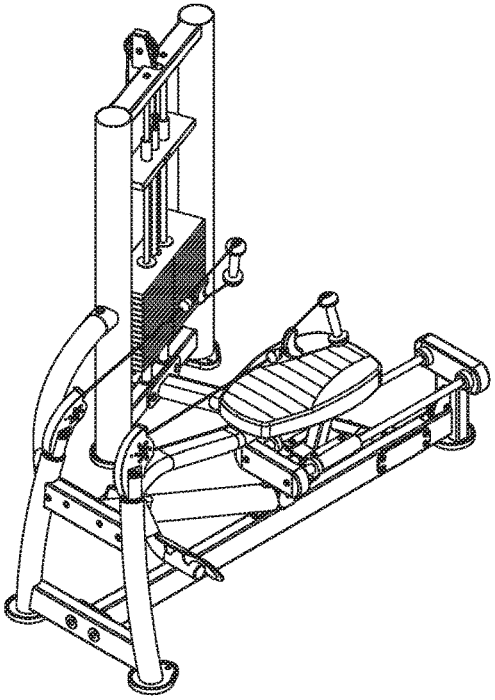
FIG. 58 illustrates a perspective view of the seated row machine in the end position.
Figure 59:
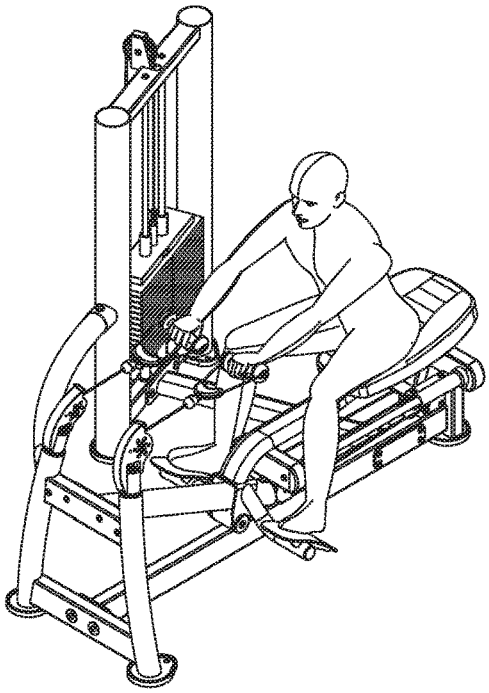
FIG. 59 illustrates a perspective view of the seated row machine in the start position during use.
Figure 60:
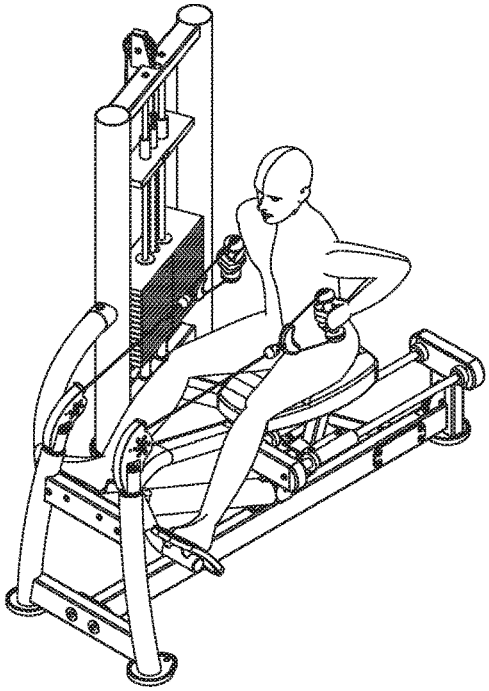
FIG. 60 illustrates a perspective view of the seated row machine in the end position during use.

FIGS. 49-51 illustrate side views of a seated row machine. FIGS. 52-56 illustrate side and top views of the seated row machine during use. FIGS. 57-58 illustrate perspective views of the seated row machine. FIGS. 59-60 illustrate perspective views of the seated row machine during use.

In this example, the cable resistance machine has the user seated on a flat bench with legs bent at the knees and extended in front while rested on foot supports. During the movement, the user bends from the mid-section, reaches forward to grab the two cable driven handles, and pulls the cables back toward the lower chest (using the legs for a pushing leverage to allow the upper body to assist in the pulling motion) and then allows the handles to return just short of the starting position. While performing the exercise, the seat bench delivers a natural arcing progression keeping the user in an optimal position to deliver a continuous resistance to each handle during the exercise. In addition, the user's shoulders, upper and lower back, triceps and core stabilizing muscles may be engaged during the movement.

The rail in this example is flat compared to the ground, while the column is aligned at an obtuse angle the seat. In addition, this example shows a machine that omits any back support element due to the nature of the exercise. Instead, the user is supported by a set of footrests intended to hold the user's legs in place as the movement is performed.

The machine of FIGS. 49-60 illustrates an example of improved functionality using the system of some embodiments. Currently, many users lean back at the end of a row motion to attempt to achieve a full contraction. In contrast, when using the machine of FIGS. 49-60 a user is automatically tilted such that the user's body is able to remain in a fixed position relative to the user support while also positioning the user such that a full repetition may be performed. In addition, the machine of FIGS. 49-60 simulates a sliding seat in real boat in a way that provides an improved functional exercise.

E. Triceps Press

Figure 61:
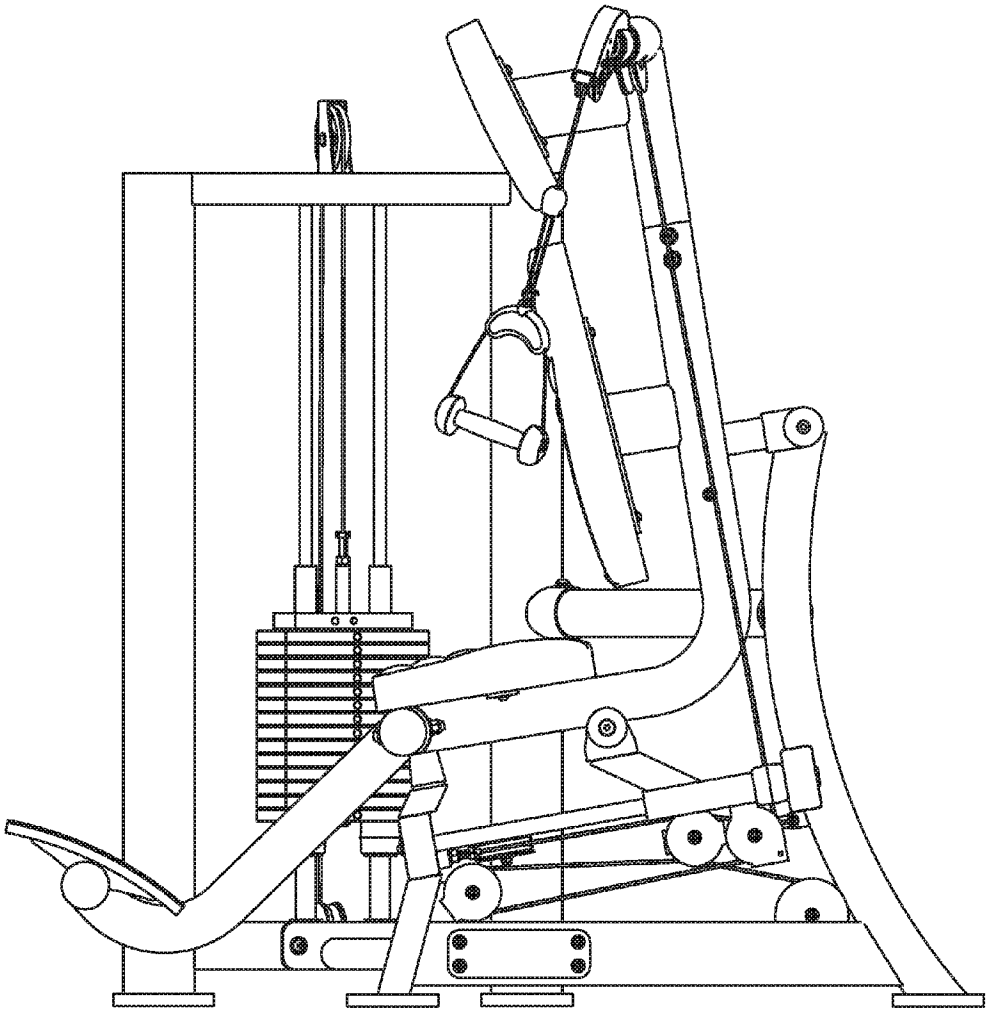
FIG. 61 illustrates a side view of a triceps press machine according to an exemplary embodiment in a start position.
Figure 62:
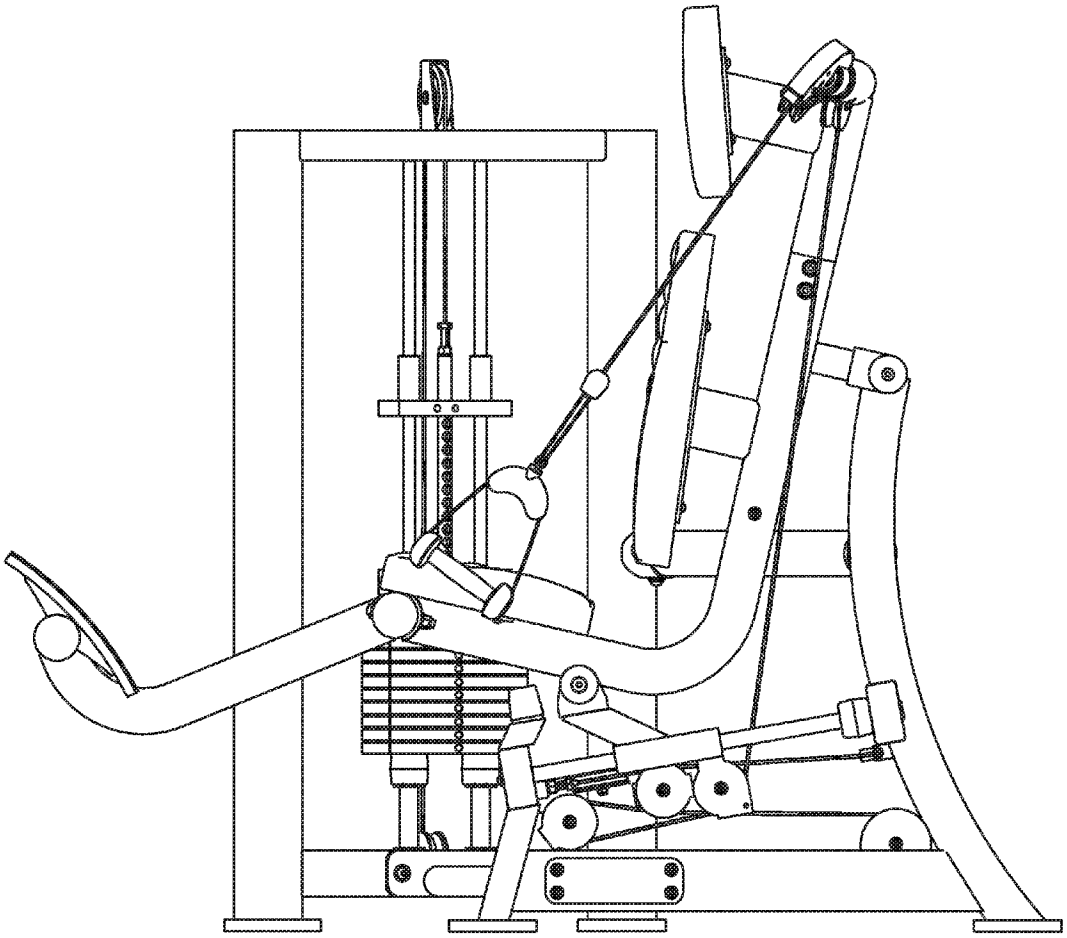
FIG. 62 illustrates a side view of the triceps press machine in an end position.
Figure 63:
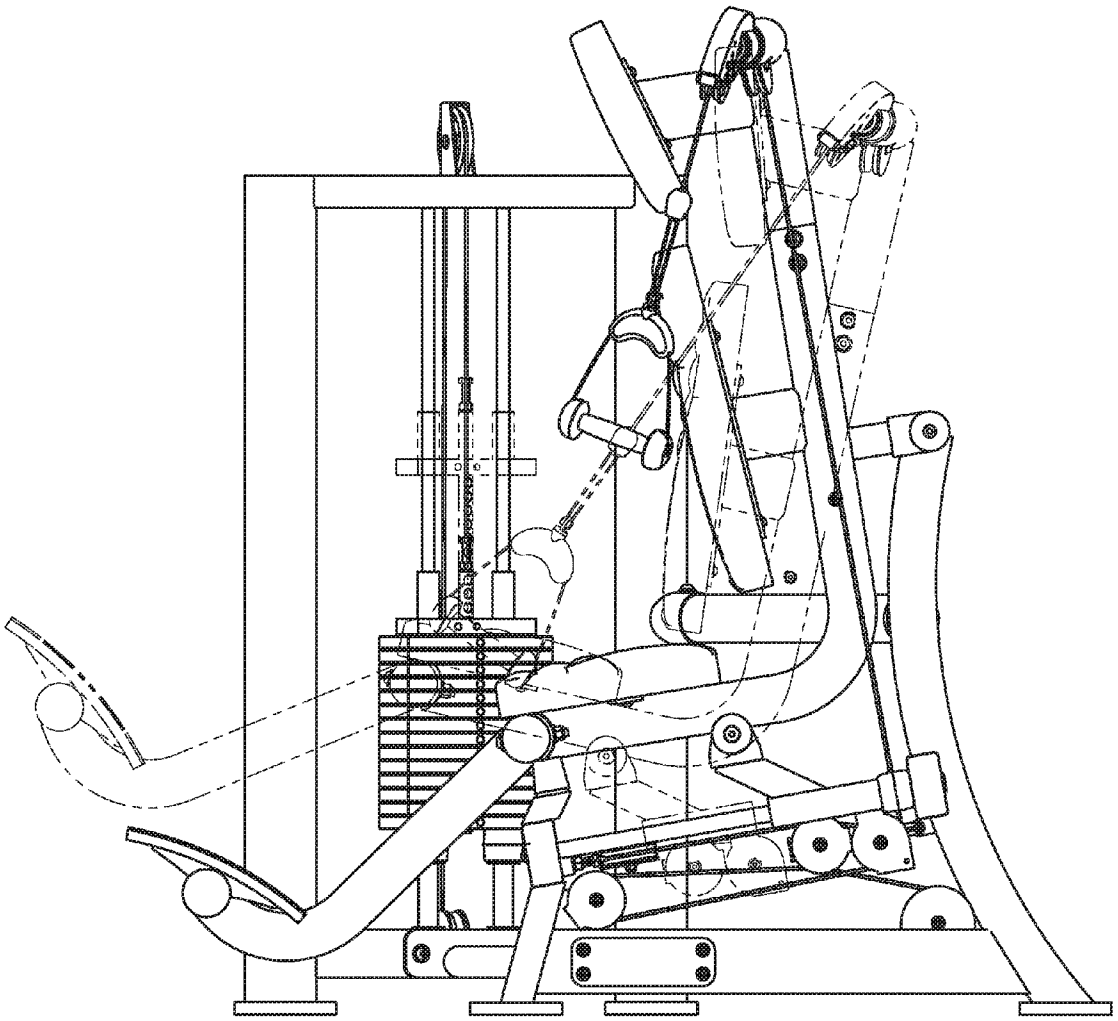
FIG. 63 illustrates a side view of the triceps press machine showing the relative arrangements of the start position and end position.
Figure 64:
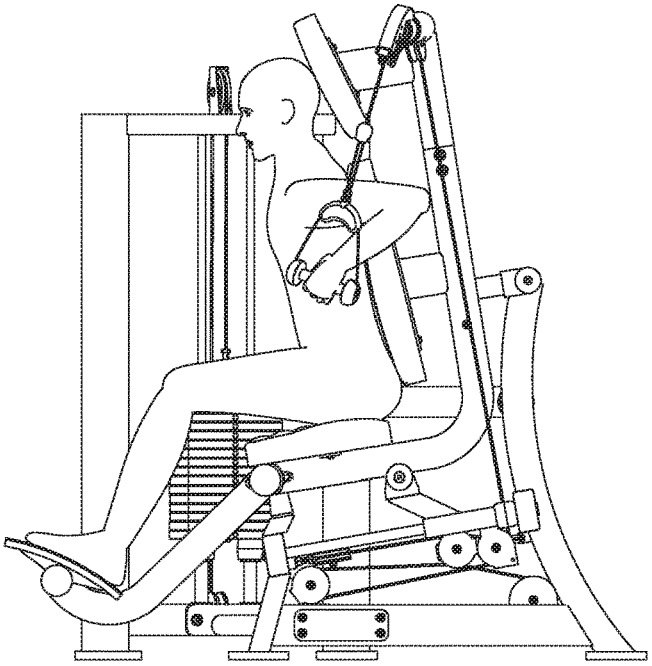
FIG. 64 illustrates a side view of the triceps press machine in the start position during use.
Figure 65:
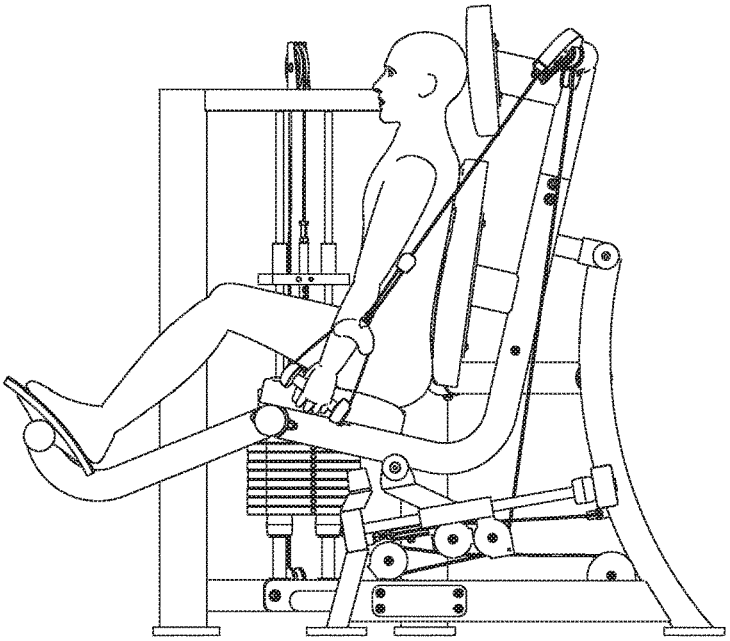
FIG. 65 illustrates a side view of the triceps press machine in the end position during use.
Figure 66:
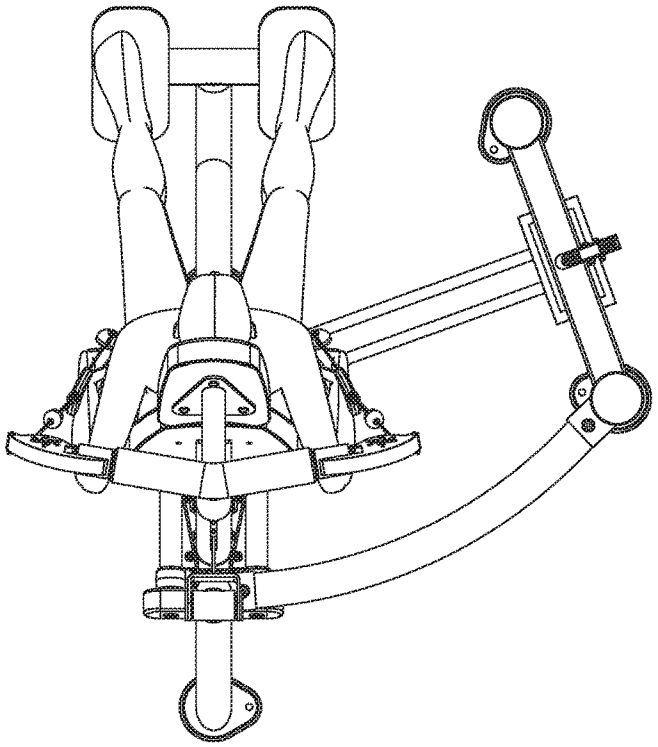
FIG. 66 illustrates a top view of the triceps press machine in the start position during use.
Figure 67:
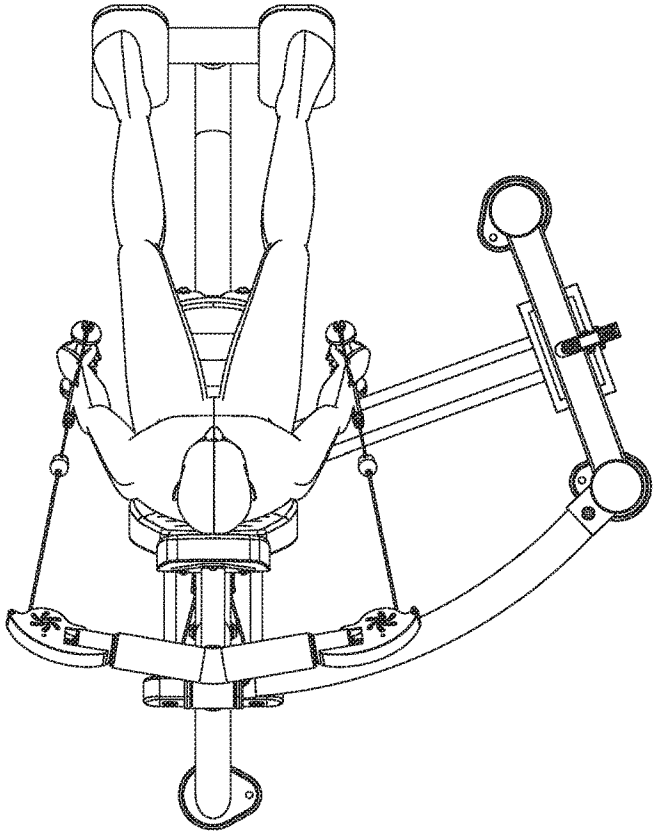
FIG. 67 illustrates a top view of the triceps press machine in the end position during use.
Figure 68:
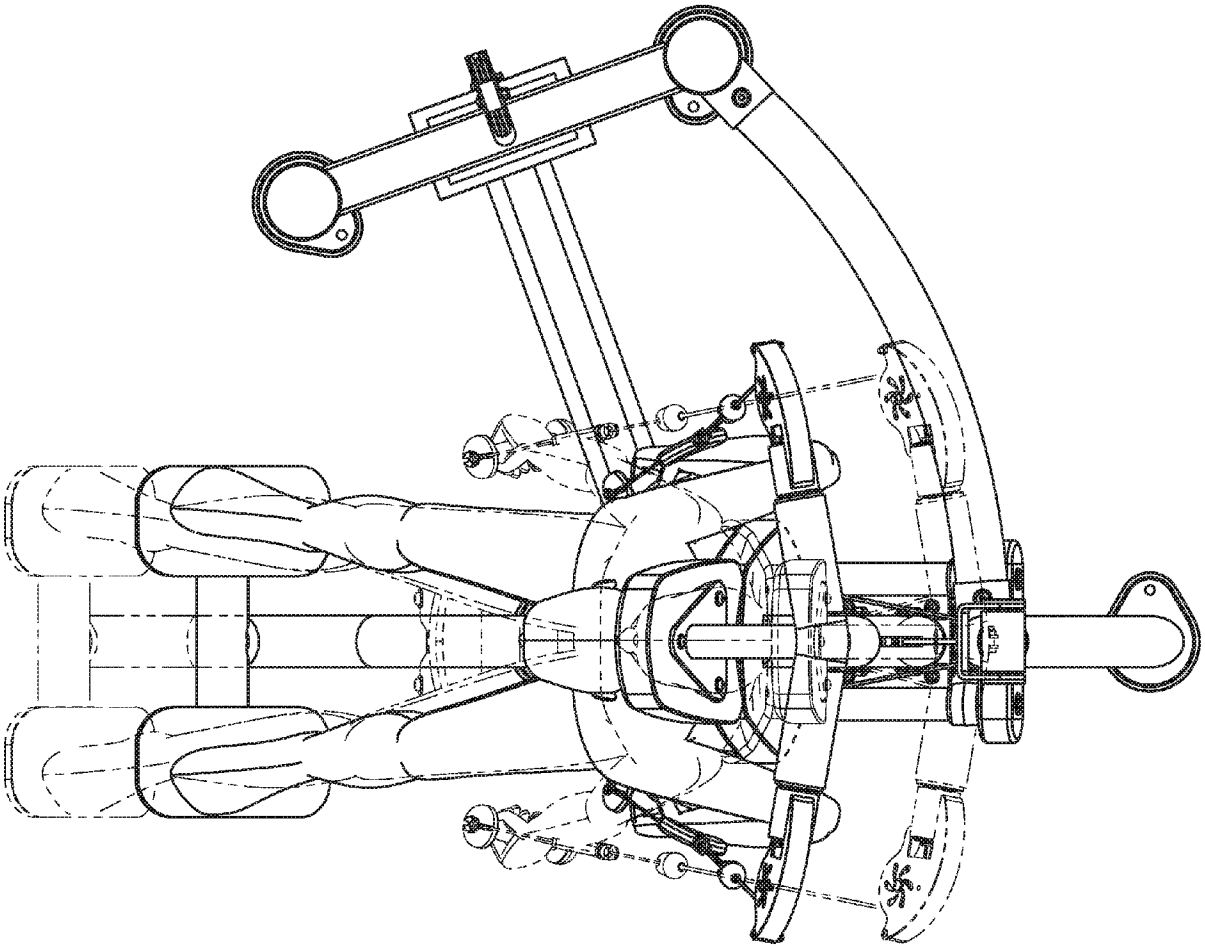
FIG. 68 illustrates a top view of the triceps press machine showing the relative arrangements of the start position and end position during use.
Figure 69:
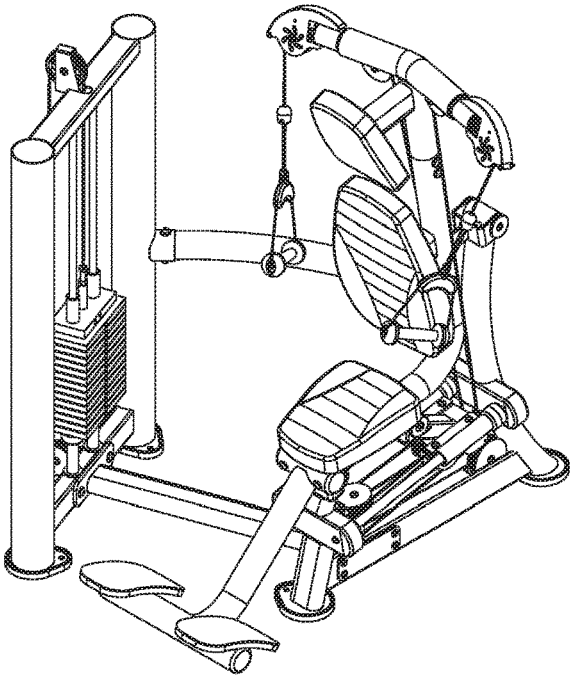
FIG. 69 illustrates a perspective view of the triceps press machine in the start position.
Figure 70:
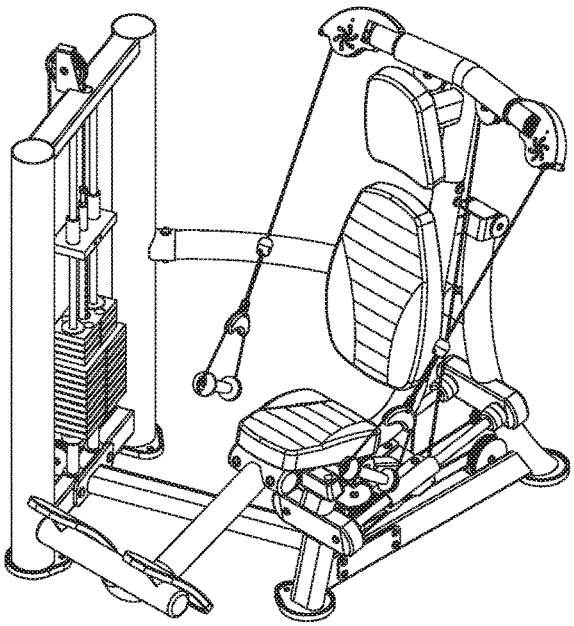
FIG. 70 illustrates a perspective view of the triceps press machine in the end position.
Figure 71:
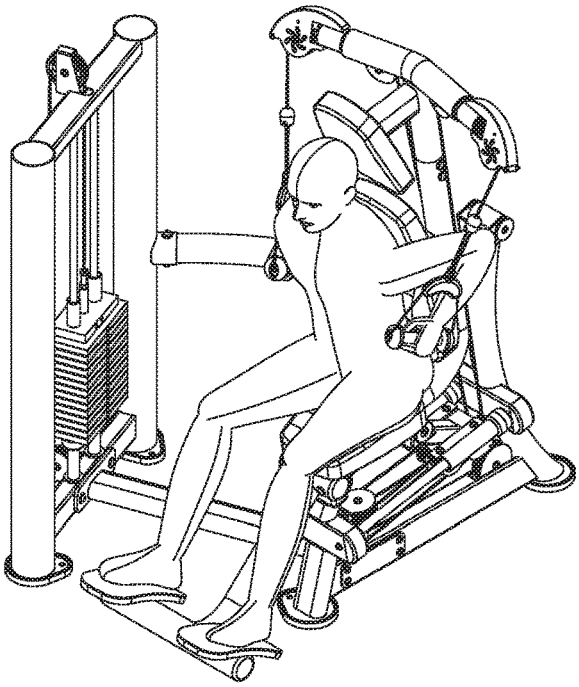
FIG. 71 illustrates a perspective view of the triceps press machine in the start position during use.
Figure 72:
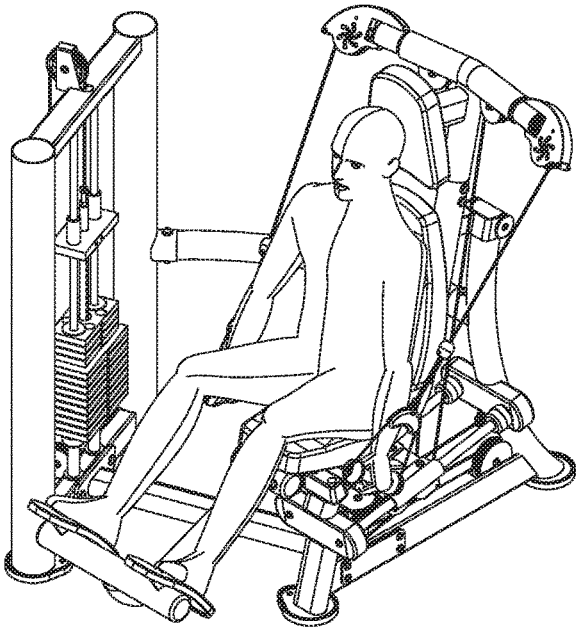
FIG. 72 illustrates a perspective view of the triceps press machine in the end position during use.

FIGS. 61-63 illustrate side views of a triceps press machine. FIGS. 64-68 illustrate side and top views of the triceps press machine during use. FIGS. 69-70 illustrate perspective views of the triceps press machine. FIGS. 71-72 illustrate perspective views of the triceps press machine during use.

In this example, the cable resistance machine places the user in a seated starting position and as the user grasps the two cable driven handles, with arms bent, elbows rotated back behind the side of their body, and hands positioned tight to the body just under the shoulders. The user may then push the handles in a downward motion with the unrestricted cable driven press handles and then return to the start position. The movement of the exercise machine may deliver a natural forward and return arcing progression applying a continuous and equal amount of resistance. In addition, the user's triceps, chest, shoulders and core stabilizing muscles may be engaged during the movement.

The rail in this example slopes downward as the movement progresses, while the column is aligned at a right angle compared to the seat.

F. Leg Press

Figure 73:
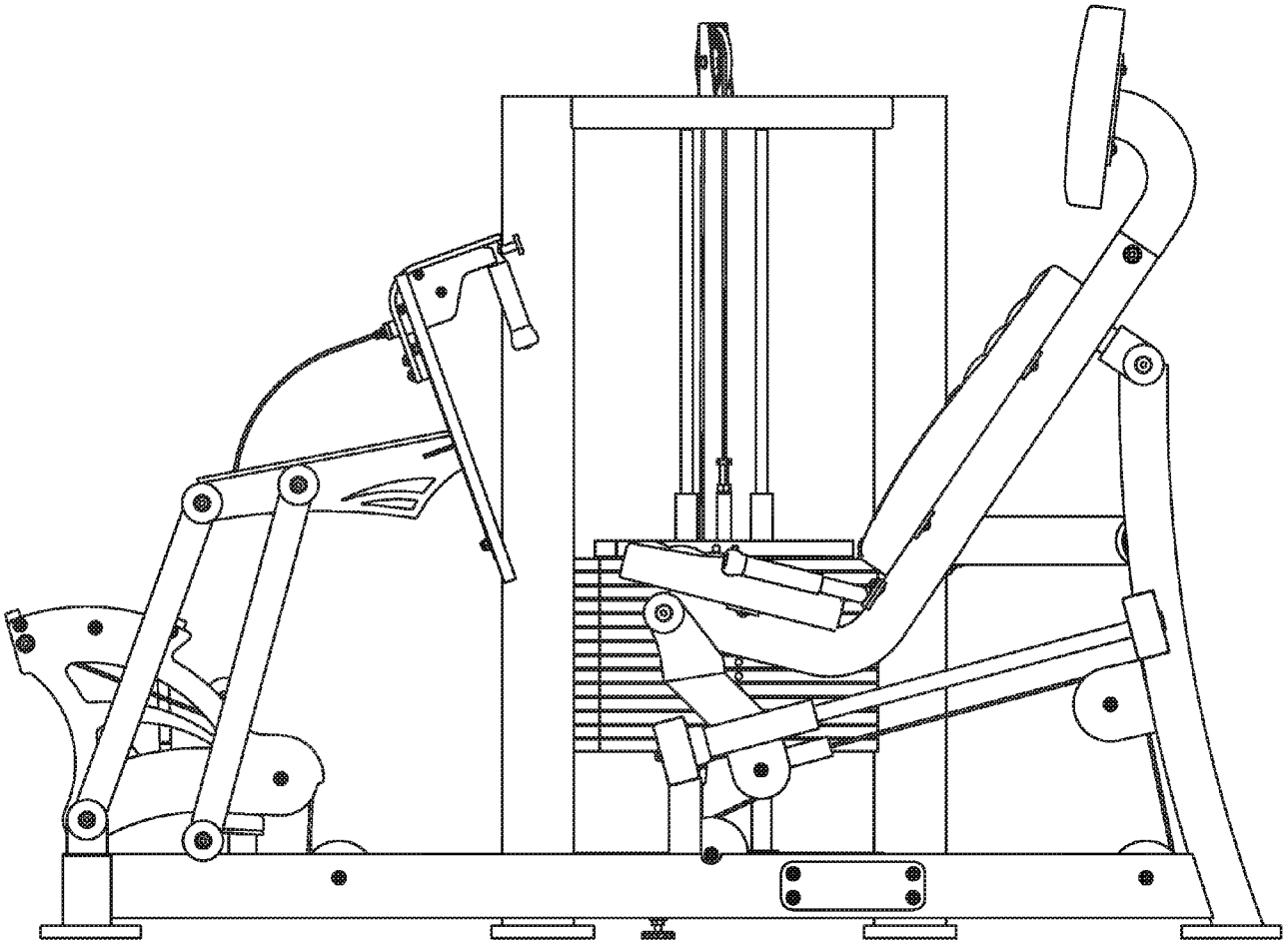
FIG. 73 illustrates a side view of a leg press machine according to an exemplary embodiment in a start position.
Figure 74:
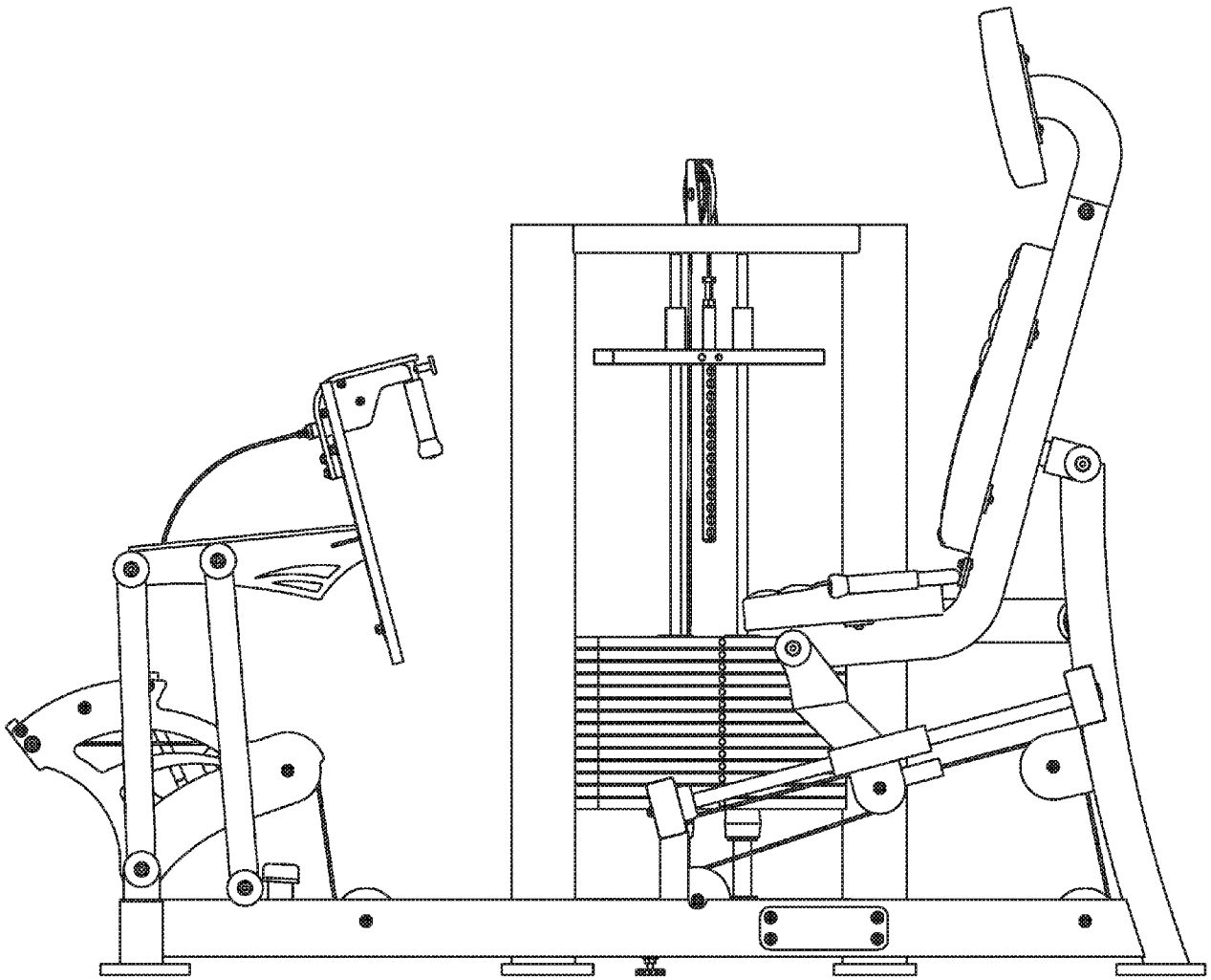
FIG. 74 illustrates a side view of the leg press machine in an end position.
Figure 75:
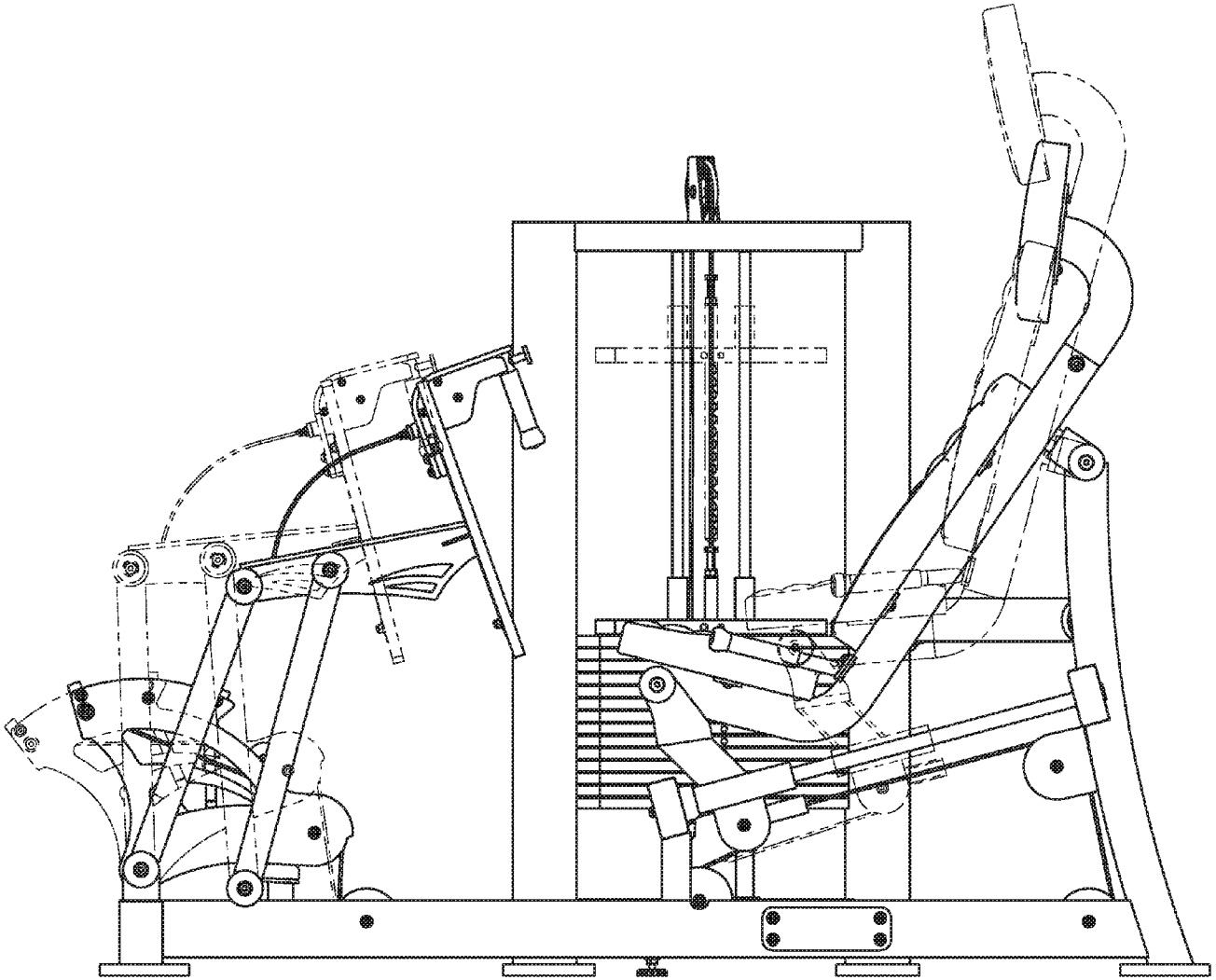
FIG. 75 illustrates a side view of the leg press machine showing the relative arrangements of the start position and end position.
Figure 76:
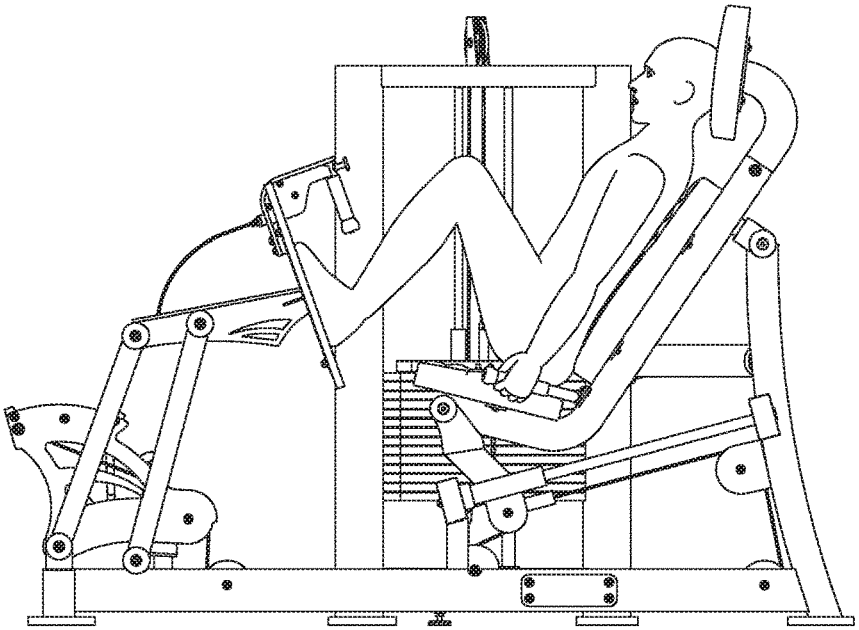
FIG. 76 illustrates a side view of the leg press machine in the start position during use.
Figure 77:
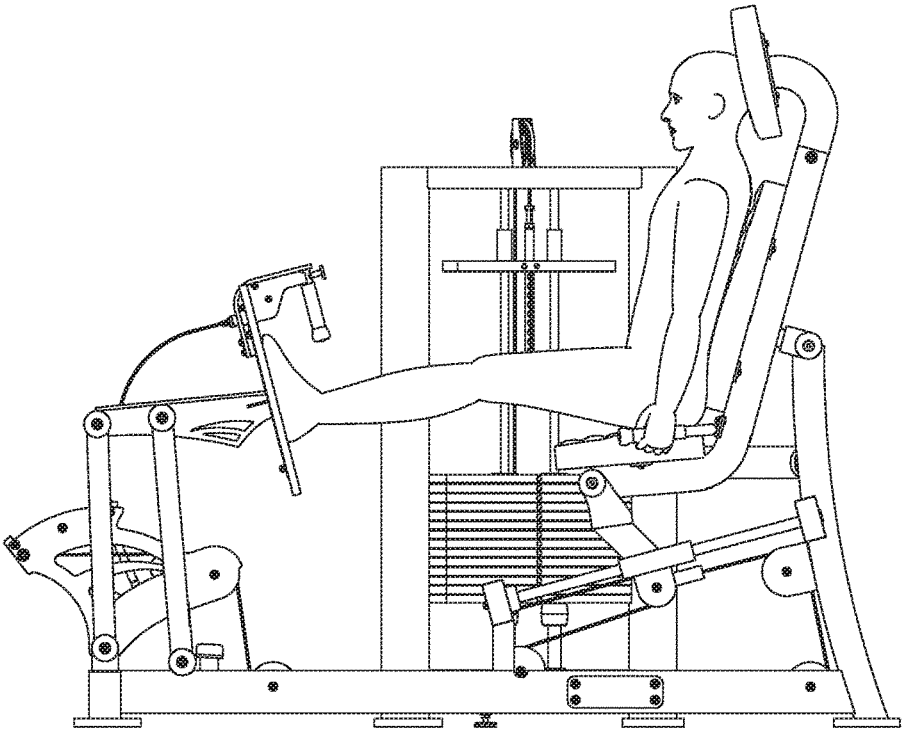
FIG. 77 illustrates a side view of the leg press machine in the end position during use.
Figure 78:
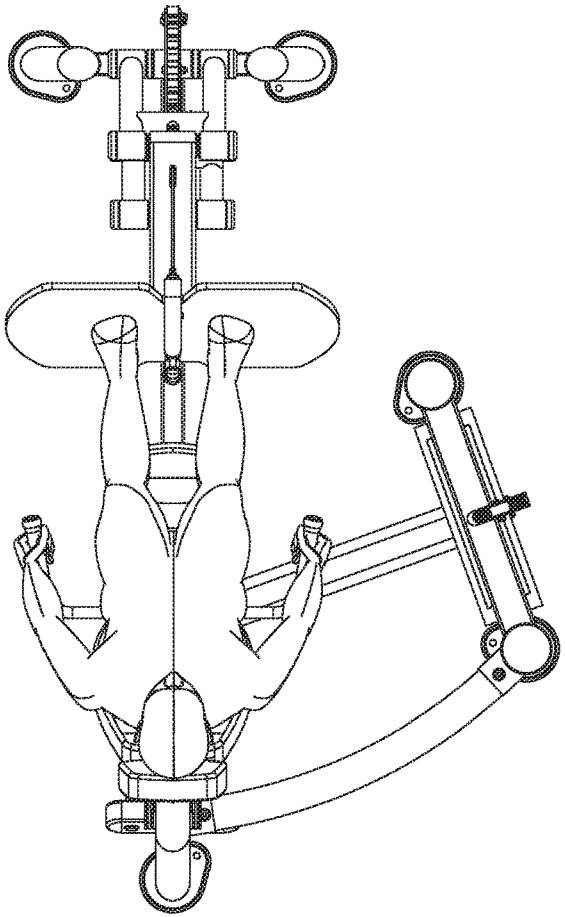
FIG. 78 illustrates a top view of the leg press machine in the start position during use.
Figure 79:
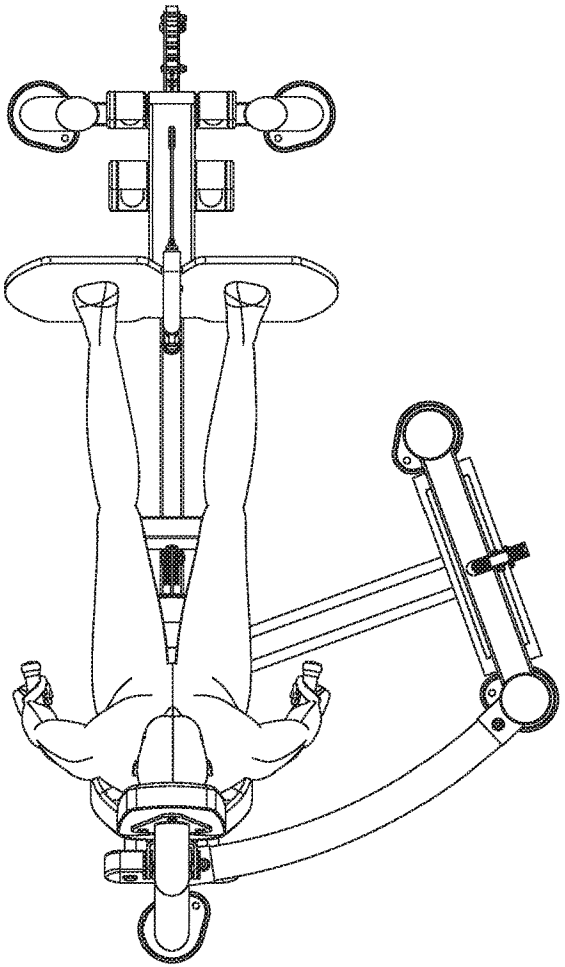
FIG. 79 illustrates a top view of the leg press machine in the end position during use.
Figure 80:
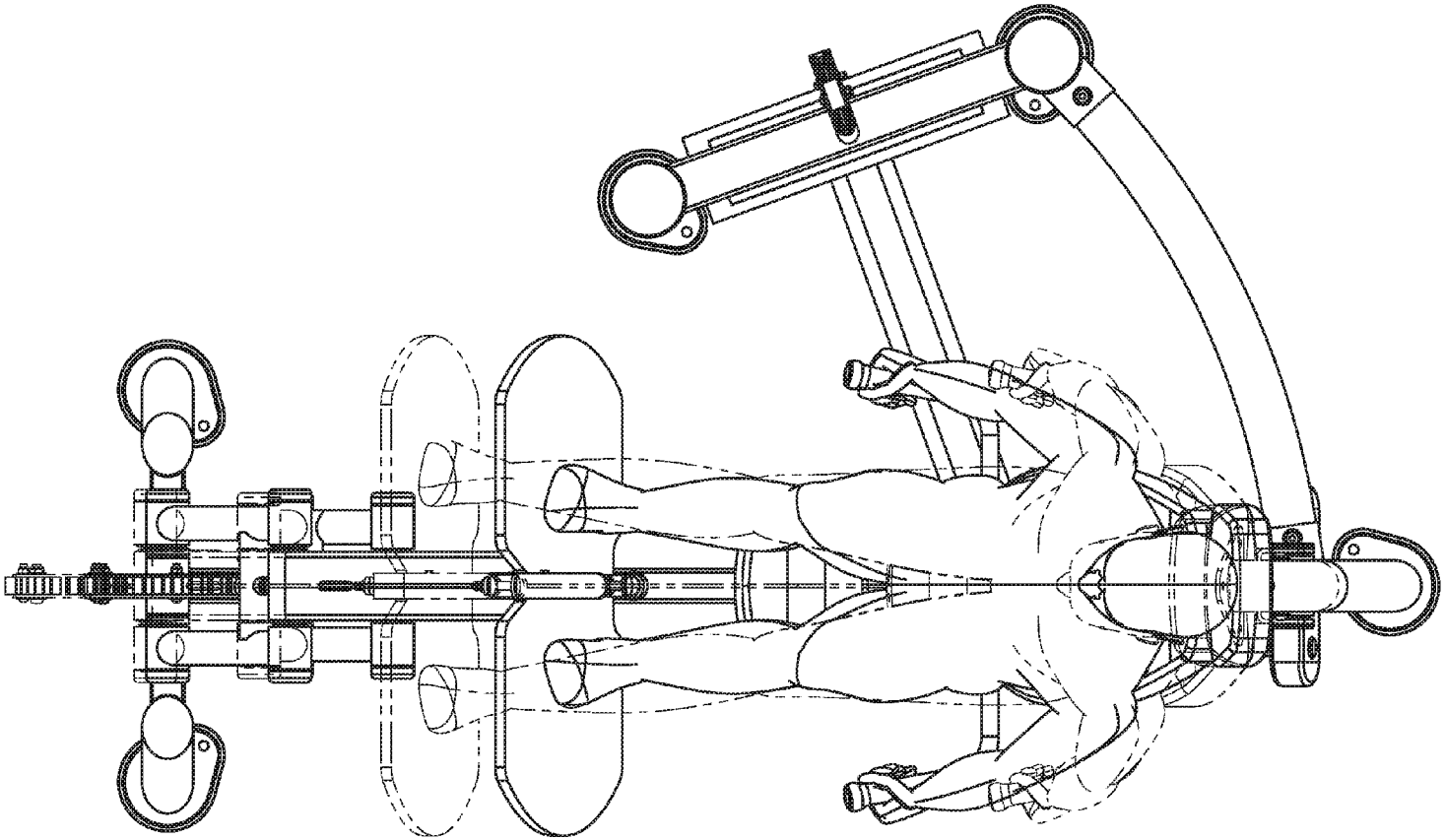
FIG. 80 illustrates a top view of the leg press machine showing the relative arrangements of the start position and end position during use.
Figure 81:
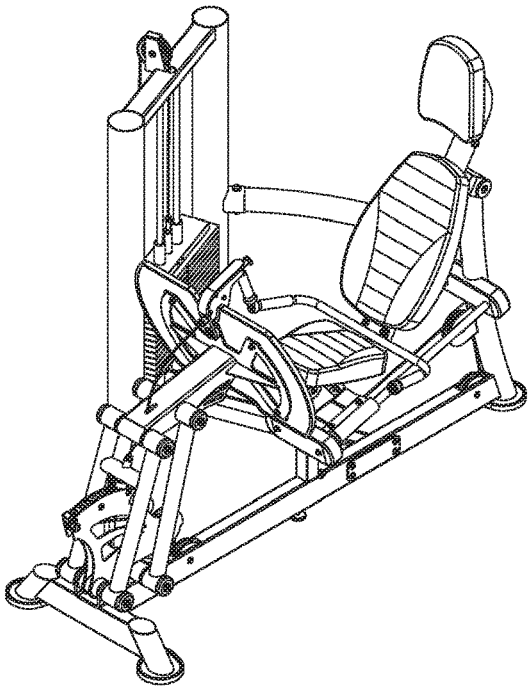
FIG. 81 illustrates a perspective view of the leg press machine in the start position.
Figure 82:
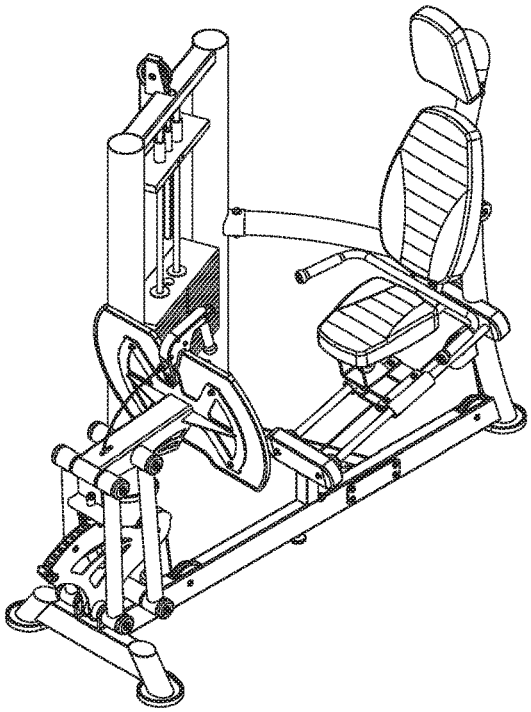
FIG. 82 illustrates a perspective view of the leg press machine in the end position.
Figure 83:
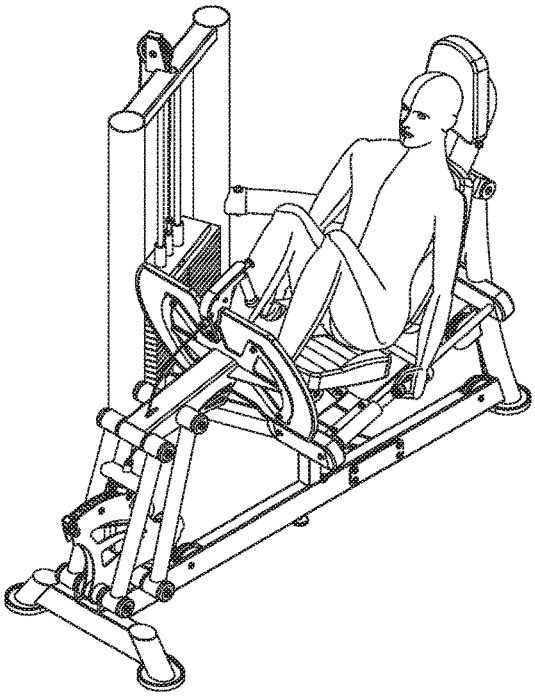
FIG. 83 illustrates a perspective view of the leg press machine in the start position during use.
Figure 84:
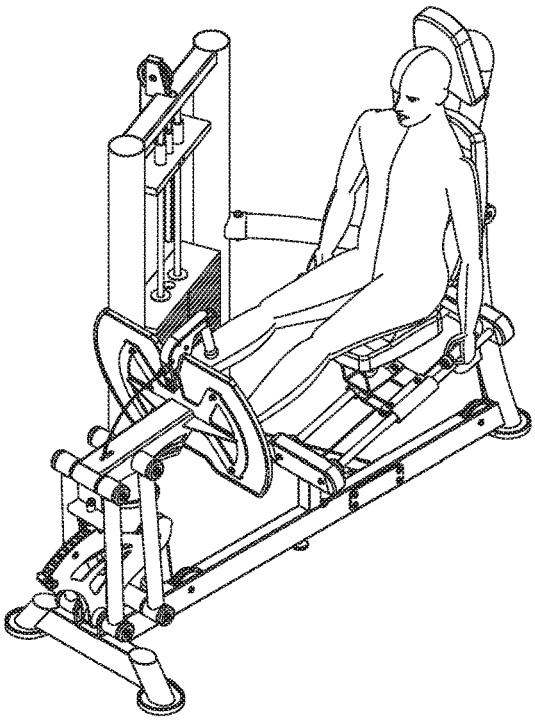
FIG. 84 illustrates a perspective view of the leg press machine in the end position during use.

FIGS. 73-75 illustrate side views of a leg press machine. FIGS. 76-80 illustrate side and top views of the leg press machine during use. FIGS. 81-82 illustrate perspective views of the leg press machine. FIGS. 83-84 illustrate perspective views of the leg press machine during use.

In this example, the cable resistance machine has the user in a seated position with legs extended straight out and placed flat on a foot plate. During the movement, the user pushes out on the plate, while in a simultaneous movement, both the upper and lower portions of the body extend away from each other in a natural forward and return arcing progression applying a continuous and equal amount of resistance. In addition, the user's quadriceps, hamstrings, lower back, calves and core stabilizing muscles may be engaged during the movement.

The rail in this example slopes upward as the movement progresses, while the column is aligned at an obtuse angle compared to the seat. In this example, the resistance element includes a flat footrest that is coupled to the cable system via a multi-point connection element as shown.

G. Leg Extension

Figure 85:
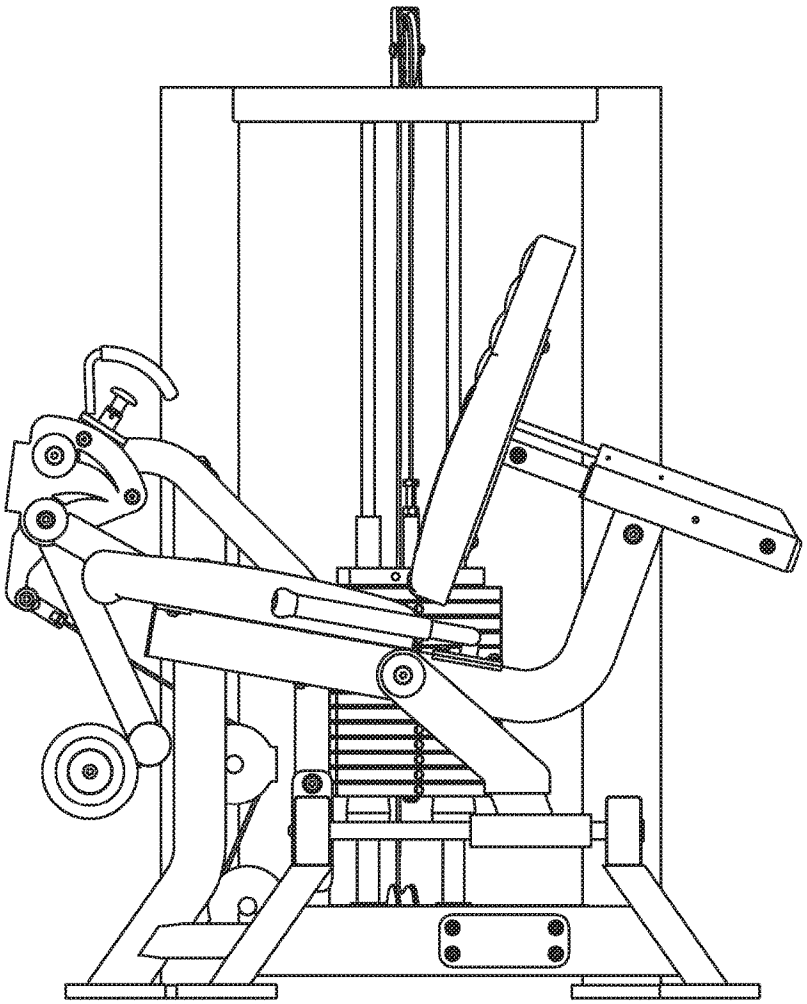
FIG. 85 illustrates a side view of a leg extension machine according to an exemplary embodiment in a start position.
Figure 86:
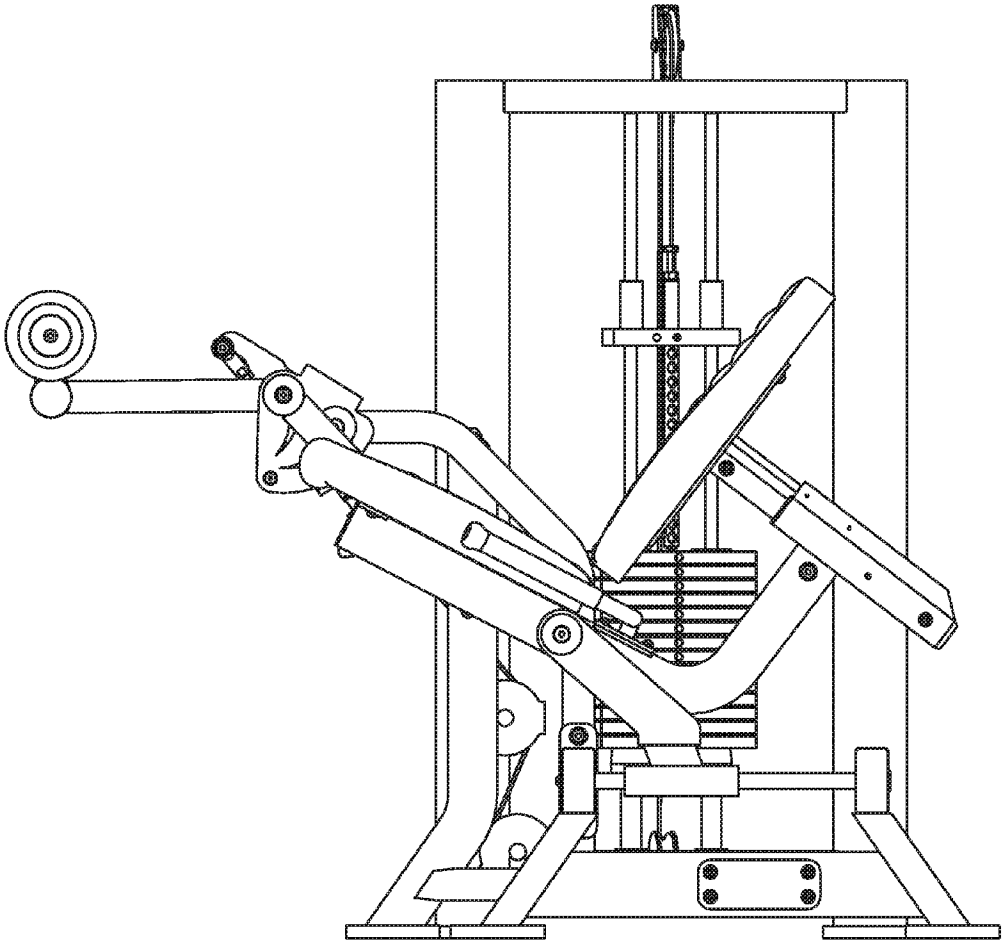
FIG. 86 illustrates a side view of the leg extension machine in an end position.
Figure 87:
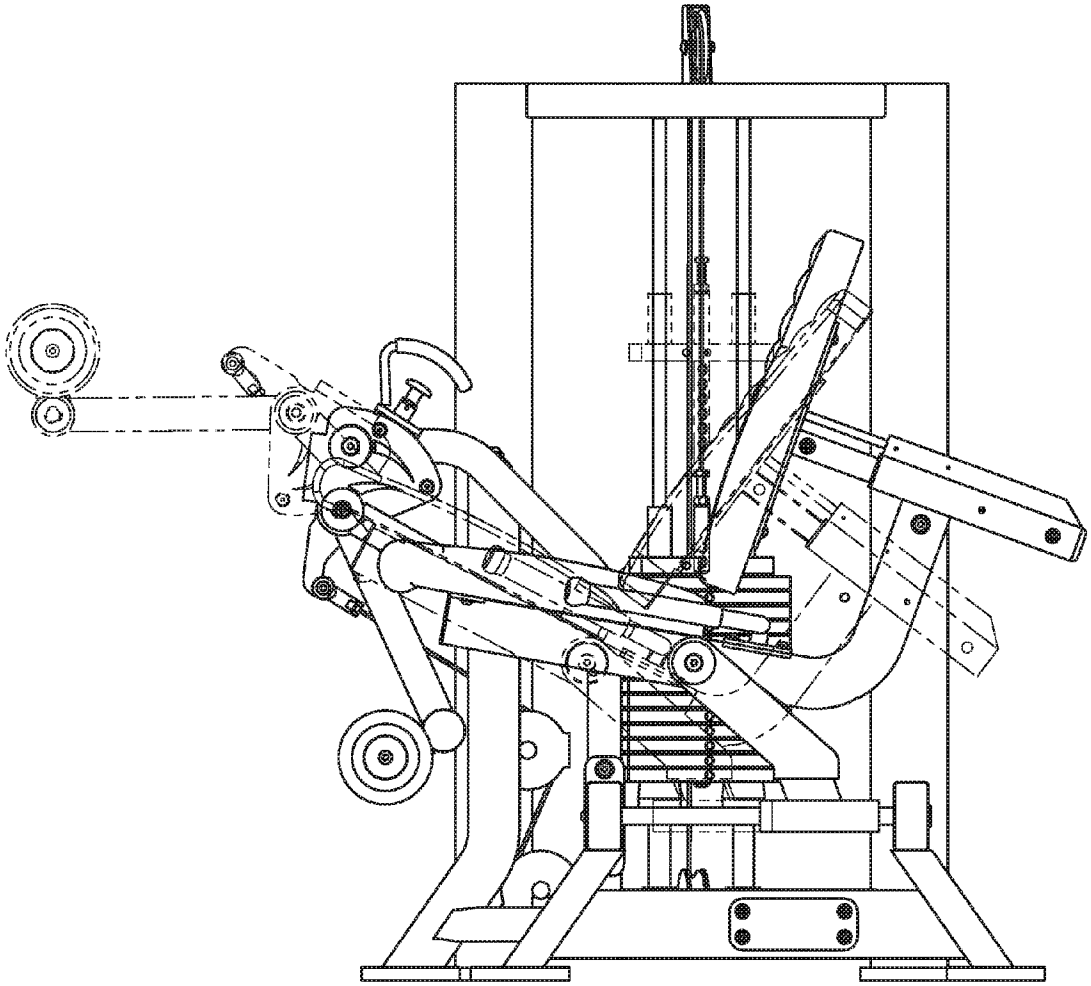
FIG. 87 illustrates a side view of the leg extension machine showing the relative arrangements of the start position and end position.
Figure 88:
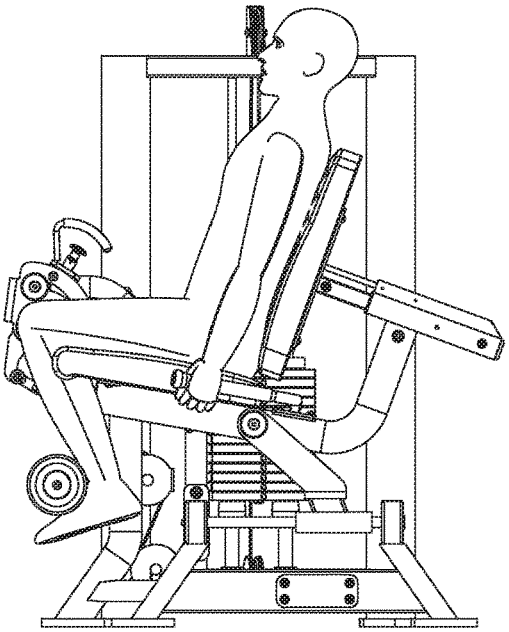
FIG. 88 illustrates a side view of the leg extension machine in the start position during use.
Figure 89:
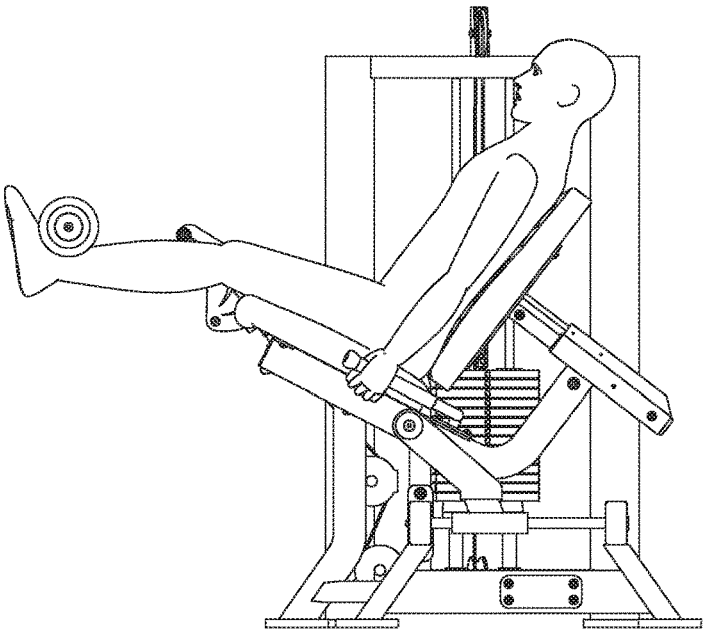
FIG. 89 illustrates a side view of the leg extension machine in the end position during use.
Figure 90:
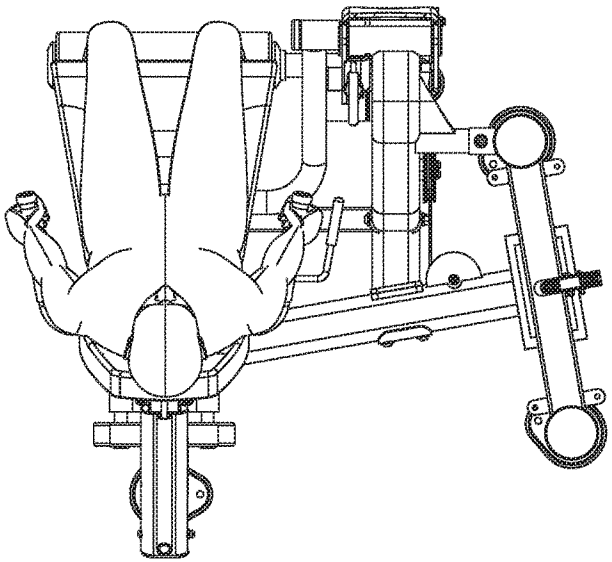
FIG. 90 illustrates a top view of the leg extension machine in the start position during use.
Figure 91:
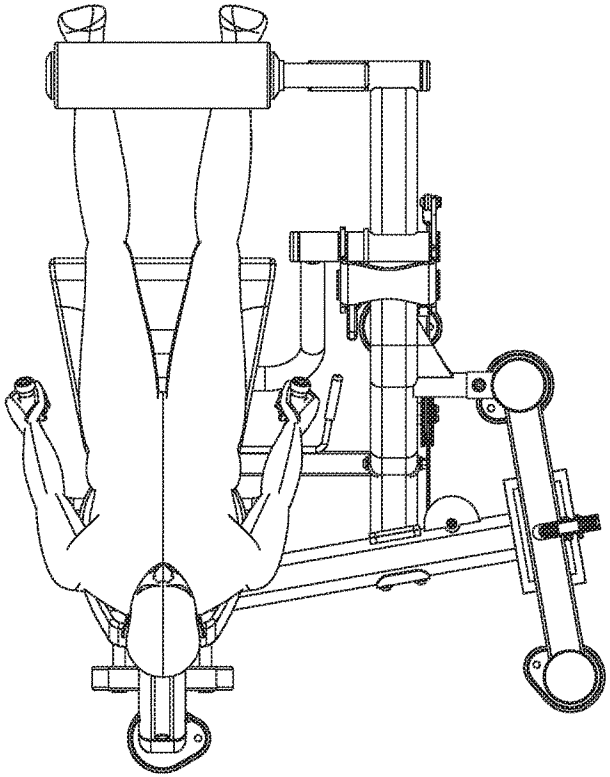
FIG. 91 illustrates a top view of the leg extension machine in the end position during use.
Figure 92:
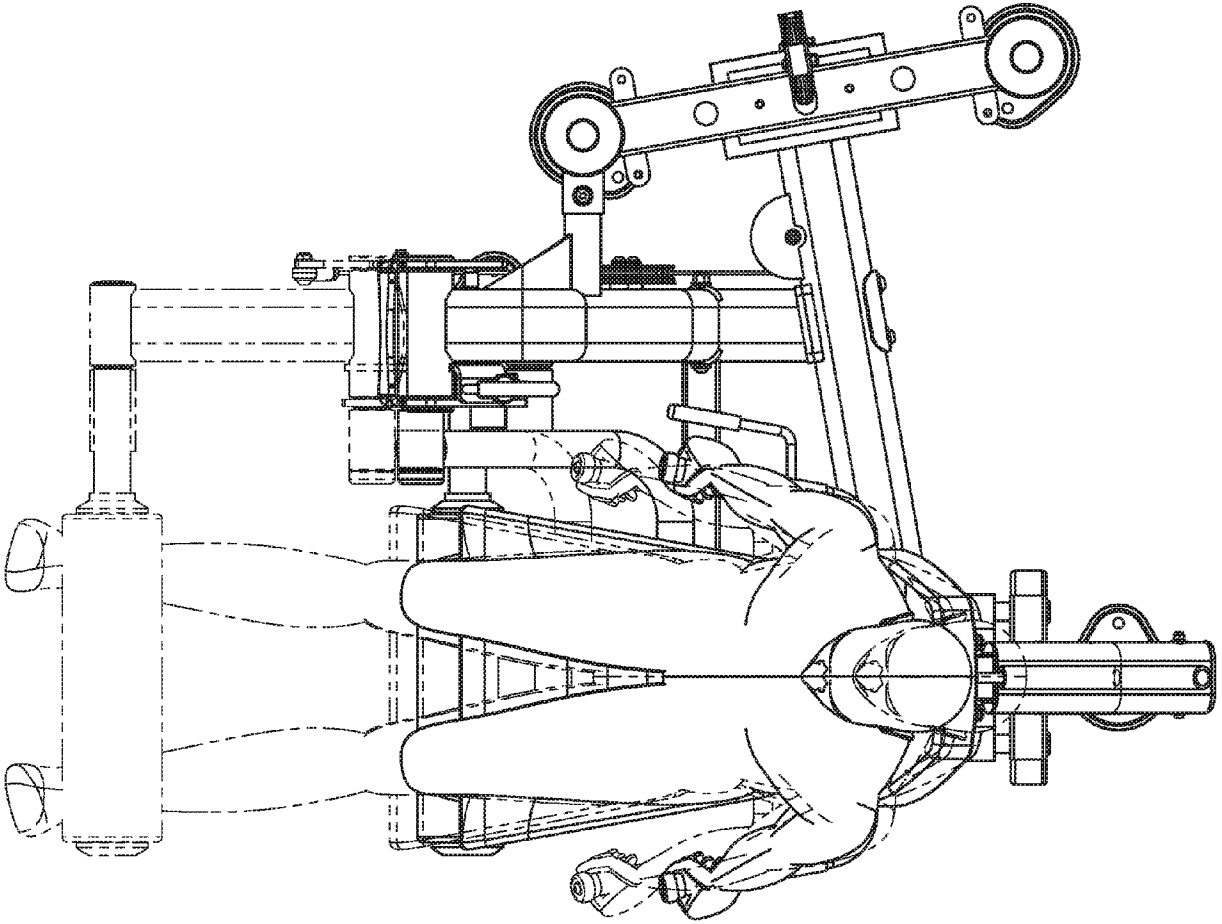
FIG. 92 illustrates a top view of the leg extension machine showing the relative arrangements of the start position and end position during use.
Figure 93:
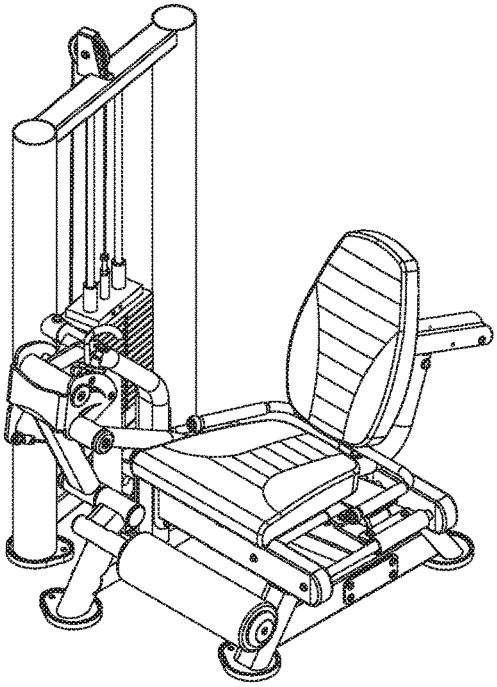
FIG. 93 illustrates a perspective view of the leg extension machine in the start position.
Figure 94:
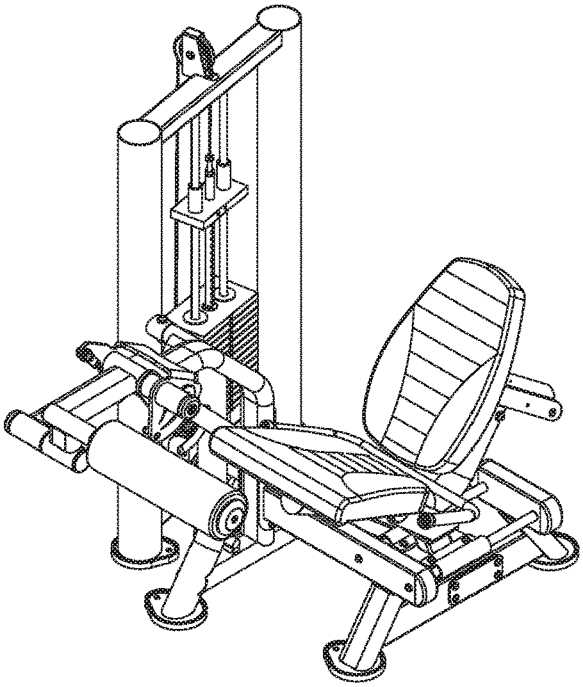
FIG. 94 illustrates a perspective view of the leg extension machine in the end position.
Figure 95:
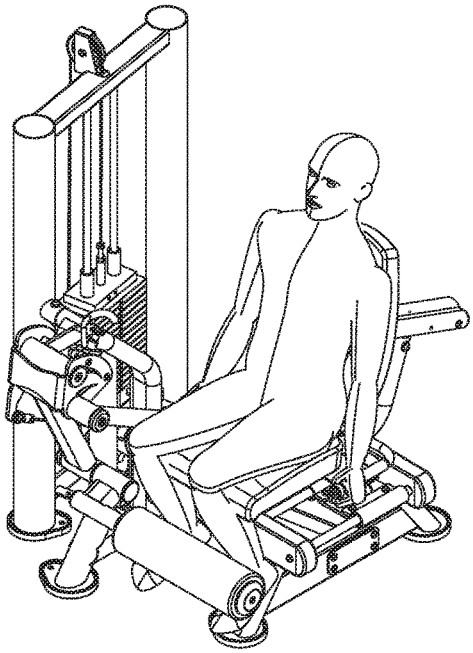
FIG. 95 illustrates a perspective view of the leg extension machine in the start position during use.
Figure 96:
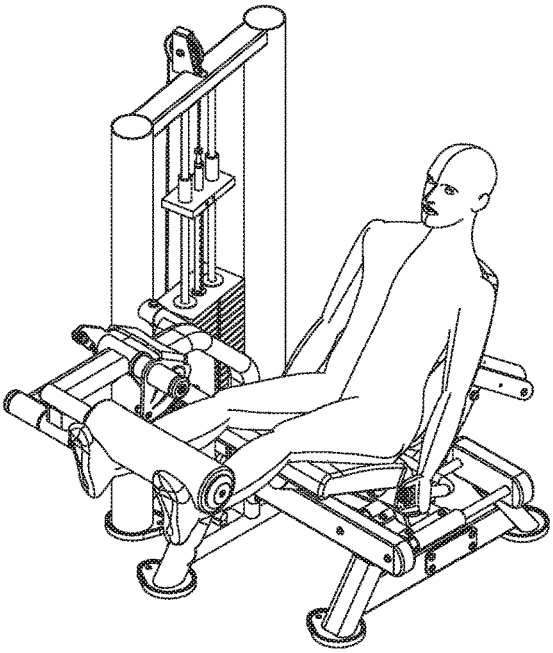
FIG. 96 illustrates a perspective view of the leg extension machine in the end position during use.

FIGS. 85-87 illustrate side views of a leg extension machine. FIGS. 88-92 illustrate side and top views of the leg extension machine during use. FIGS. 93-94 illustrate perspective views of the leg extension machine. FIGS. 95-96 illustrate perspective views of the leg extension machine during use.

In this example, the cable resistance machine places the user in a seated position with legs bent back underneath the seat and the padded rotational arm. During the movement, the user lifts in an upward motion with the leg or legs to rotate the padded arm forward and arcing up in front of the body. During the exercise, the user is rotated upward in a natural forward and return arcing progression applying a continuous and equal amount of resistance. In addition, the user's hamstrings, hip flexor, knee joints, muscles and tendons, lower back and core stabilizing muscles may be engaged during the movement.

The rail in this example is flat compared to the ground, while the second movement element includes multiple pivot points along the member and is integrated into the resistance path as shown. Thus, when a user performs the movement, body position is automatically adjusted by the position of the member as defined by the position of the user engagement element.

The machine of FIGS. 85-96 illustrates an example of improved functionality using the system of some embodiments. Users may find it easier to get full extension when tilting back as the exercise progresses.

H. Leg Curl

Figure 97:
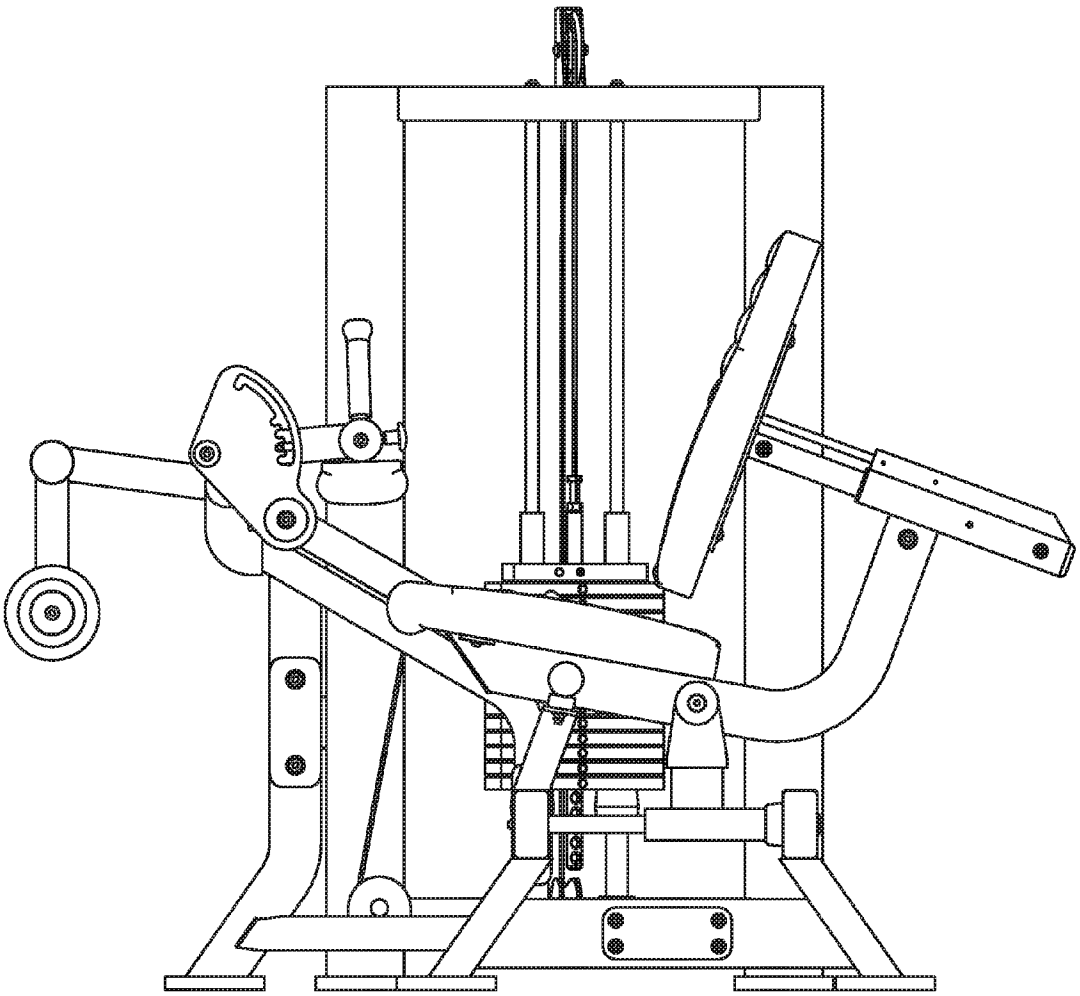
FIG. 97 illustrates a side view of a leg curl machine according to an exemplary embodiment in a start position.
Figure 98:
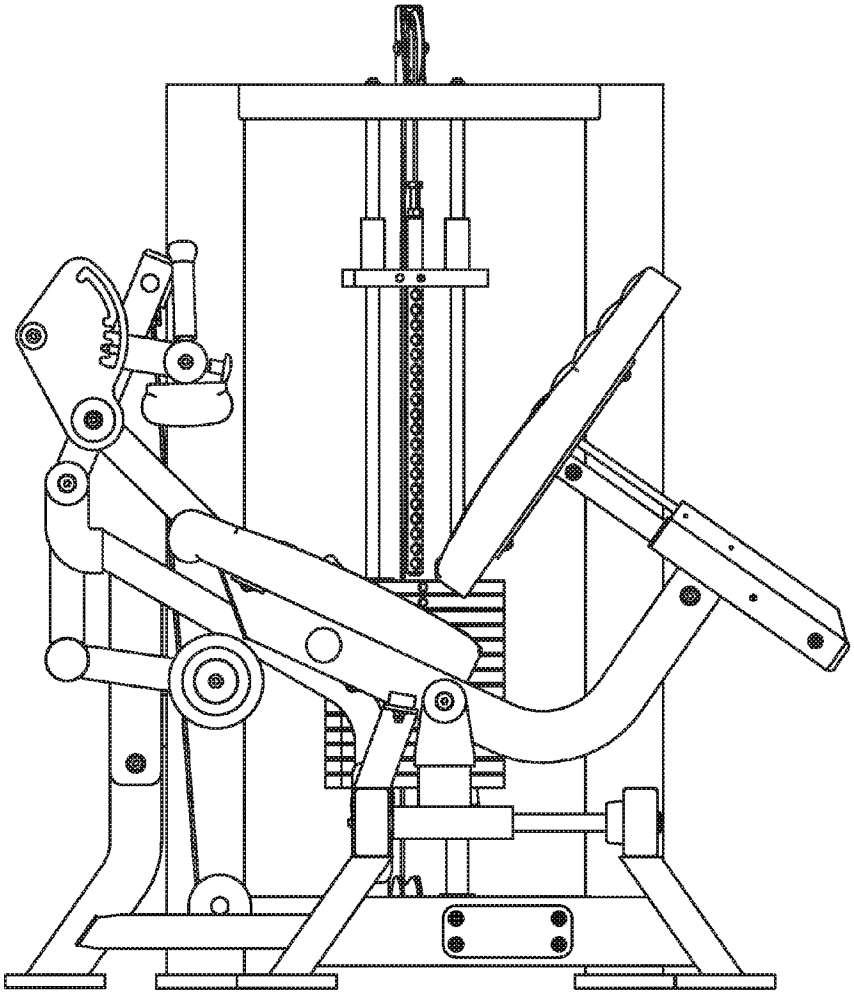
FIG. 98 illustrates a side view of the leg curl machine in an end position.
Figure 99:
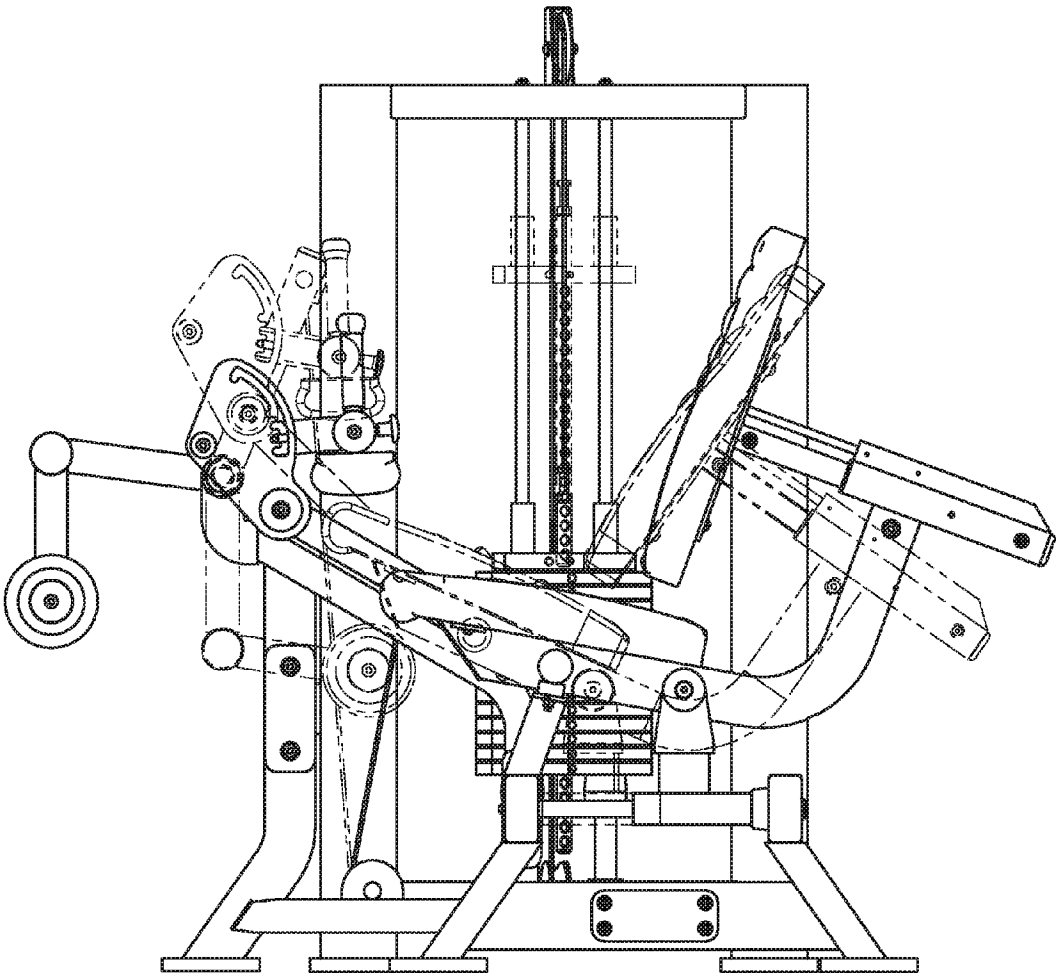
FIG. 99 illustrates a side view of the leg curl machine showing the relative arrangements of the start position and end position.
Figure 100:
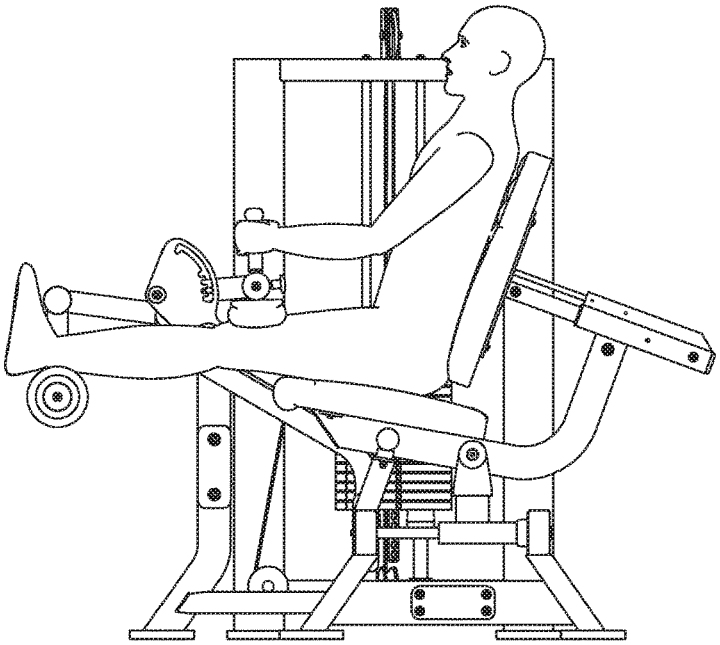
FIG. 100 illustrates a side view of the leg curl machine in the start position during use.
Figure 101:
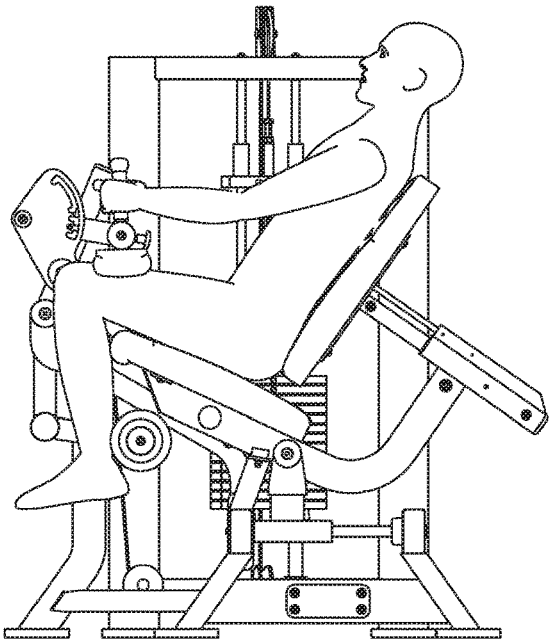
FIG. 101 illustrates a side view of the leg curl machine in the end position during use.
Figure 102:
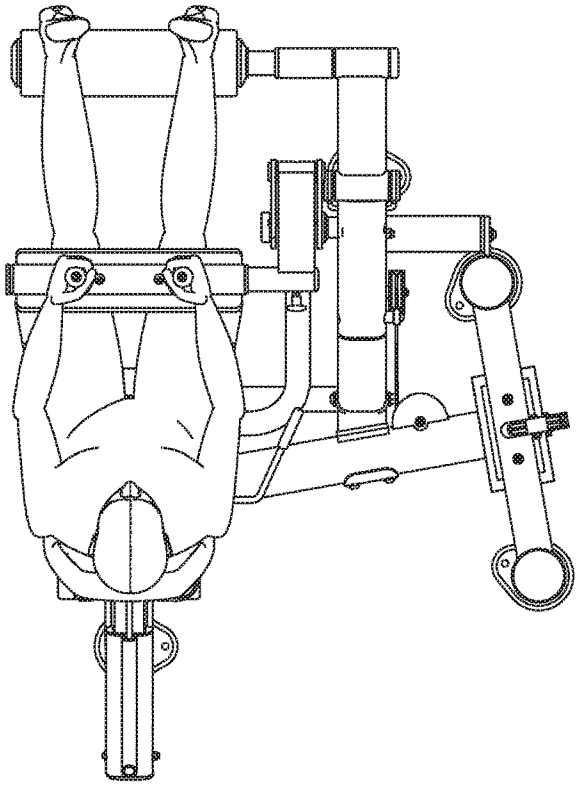
FIG. 102 illustrates a top view of the leg curl machine in the start position during use.
Figure 103:
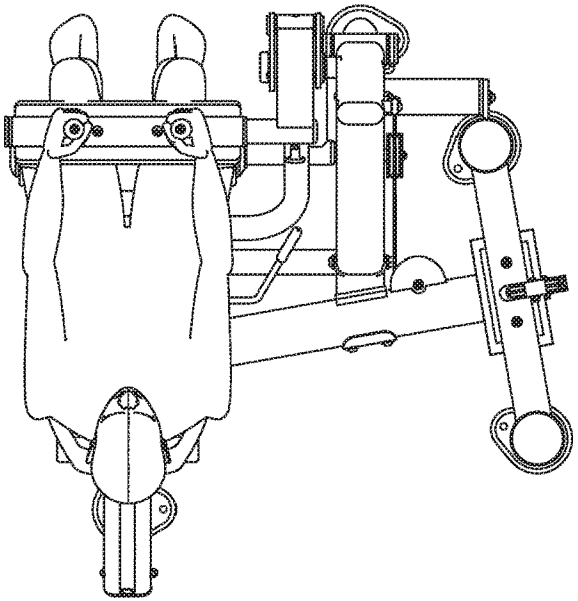
FIG. 103 illustrates a top view of the leg curl machine in the end position during use.
Figure 104:
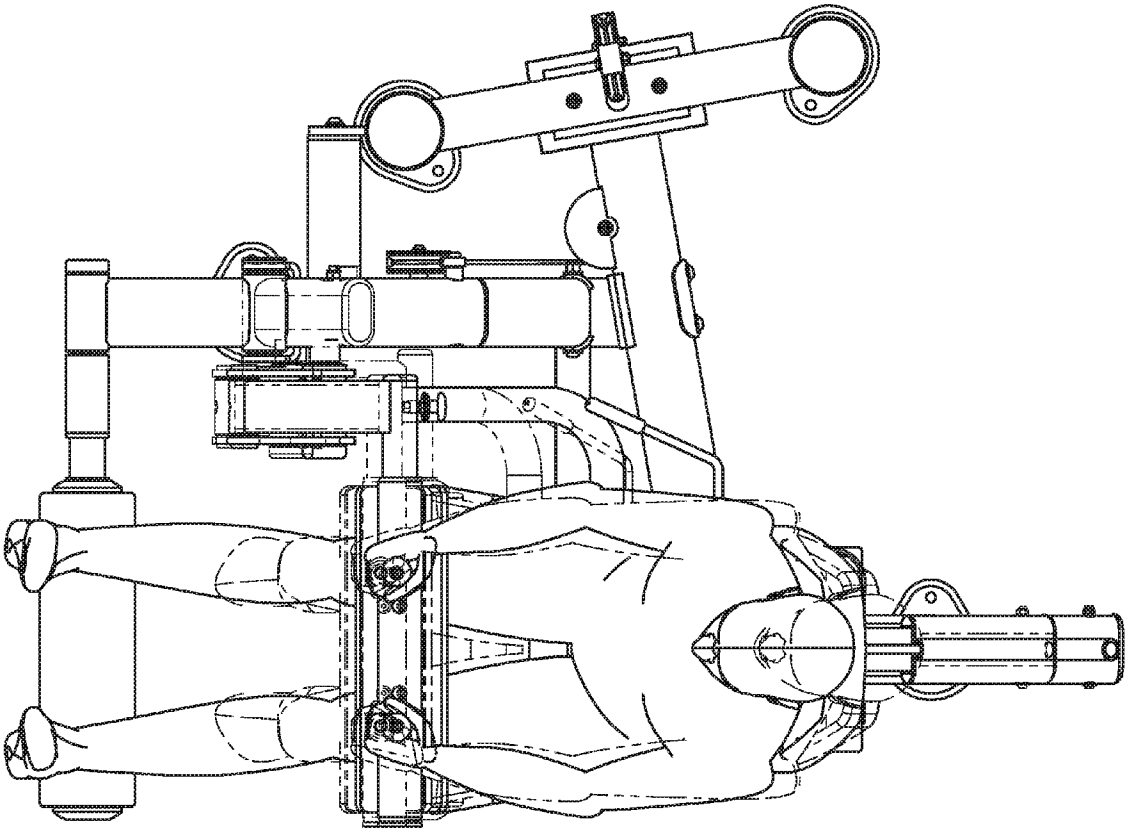
FIG. 104 illustrates a top view of the leg curl machine showing the relative arrangements of the start position and end position during use.
Figure 105:
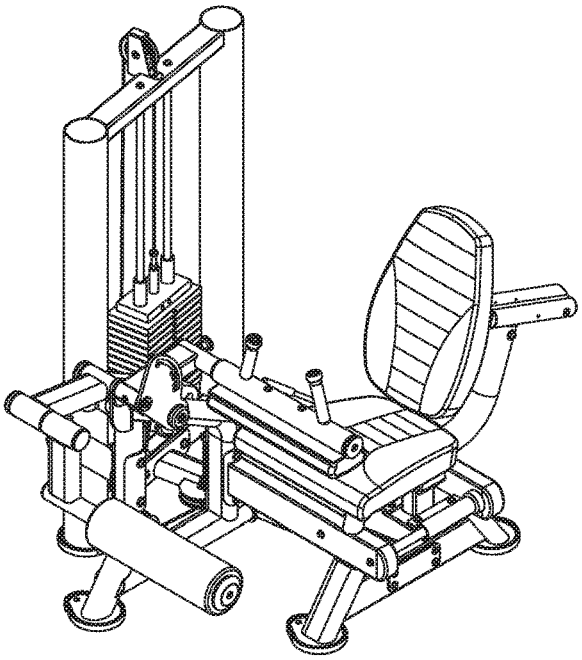
FIG. 105 illustrates a perspective view of the leg curl machine in the start position.
Figure 106:
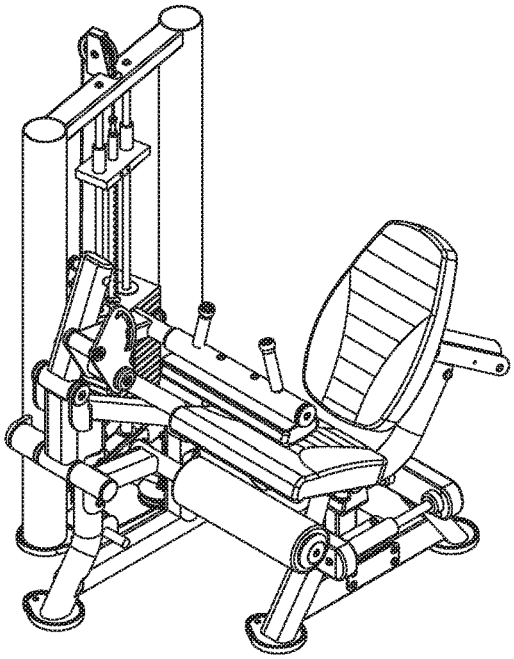
FIG. 106 illustrates a perspective view of the leg curl machine in the end position.
Figure 107:
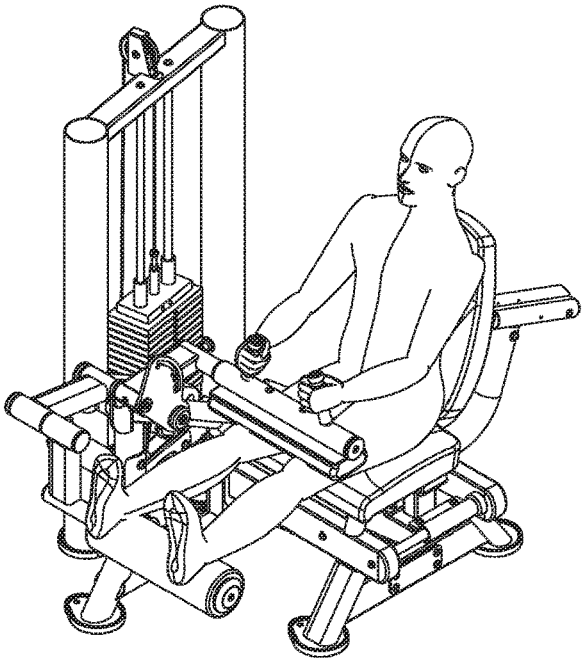
FIG. 107 illustrates a perspective view of the leg curl machine in the start position during use.
Figure 108:
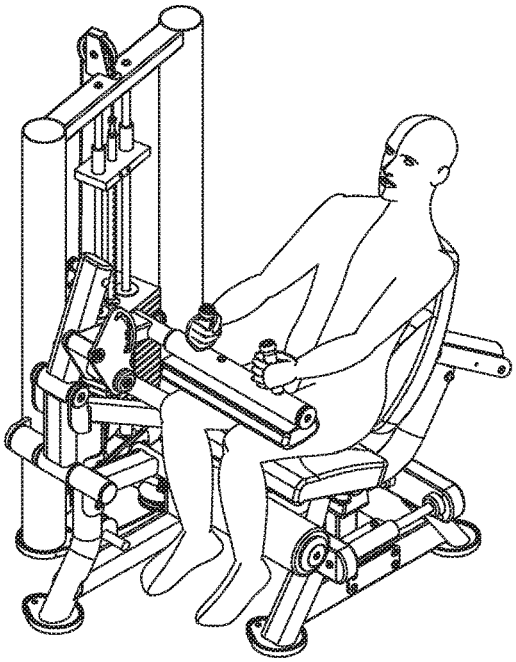
FIG. 108 illustrates a perspective view of the leg curl machine in the end position during use.

FIGS. 97-99 illustrate side views of a seated leg curl machine. FIGS. 100-104 illustrate side and top views of the seated leg curl machine during use. FIGS. 105-106 illustrate perspective views of the seated leg curl machine. FIGS. 107-108 illustrate perspective views of the seated leg curl machine during use.

In this example, the cable resistance machine places the user in a seated position with legs extended over the rotational padded arm directly in front, as the user pulls in a downward motion with one or both legs to rotate the padded arm back underneath their body. The user is rotated upward in a natural forward and return arcing progression applying a continuous and equal amount of resistance. In addition, the user's quadriceps, gluteus, knee joints, muscles and tendons, lower back, and core stabilizing muscles may be engaged during the movement.

The rail in this example is flat compared to the ground, while the second movement element includes multiple pivot points along the member and is integrated into the resistance path as shown. Thus, when a user performs the movement, body position is automatically adjusted by the position of the member as defined by the position of the user engagement element.

The machine of FIGS. 97-108 illustrates an example of improved functionality using the system of some embodiments. The tilting movement may help some users to perform a complete movement.

I. Alternative Implementations

One of ordinary skill in the art will realize that the machines described in Section I and/or sub-sections II.A-II.H are presented for exemplary purposes and different embodiments may be implemented in various different ways.

For instance, some embodiments may provide machines that target different muscle groups than those described above (e.g., a gluteus machine). As another example, different embodiments may include different cable and/or handle configurations than those shown (e.g., instead of using independent handles, some embodiments may use a bar). In addition, various embodiments may be configured in various different ways (e.g., with different slopes, different connecting element, different resistance elements, etc.). In some embodiments, various features may be configured in various different ways by the user (e.g., using different connection points, by adjusting the length of an element, by replacing one or more elements, etc.).

The foregoing relates to illustrative details of exemplary embodiments of the invention and modifications may be made without departing from the spirit and scope of the invention as defined by the following claims.

We claim:

1. A biceps curl machine comprising:
- a resistance element;
- a user support coupled to the resistance element;
- a first movement element coupled to the user support, the first movement element comprising:
  - a first column disposed below the user support; and
  - a first connecting element comprising a first pivot point such that the user support is able to pivot about a first axis associated with the first connecting element, wherein the first connecting element is movably coupled to the first column such that the first connecting element is able to move along the first column; and
- a second movement element coupled to a back of the user support, the second movement element comprising:
  - a second column disposed parallel to and proximal to the back of the user support; and
  - a second connecting element comprising a second pivot point such that the user support is able to pivot about a second axis associated with the second connecting element, wherein the second connecting element is movably coupled to the second column such that the second connecting element is able to move along the second column.

2. The biceps curl machine of claim 1, wherein the resistance element comprises at least one handle, at least one cable, at least one pulley, and a selectable load.

3. The biceps curl machine of claim 1, wherein the first column defines a first path and the second column defines a linear path and wherein the first path and the linear path determine a movement path of the user support from a start position to an end position.

4. The biceps curl machine of claim 3, wherein the movement path causes the user support to arc forward when moving along the movement path from the start position to the end position.

5. The biceps curl machine of claim 4, wherein the user support moves along the movement path from the start position to the end position when external force is applied to the resistance element.

6. The biceps curl machine of claim 5, wherein the user support moves along the movement path from the end position to the start position when external force is released from the resistance element.

7. The biceps curl machine of claim 1, wherein the first movement element is coupled to a seat of the user support.

8. The biceps curl machine of claim 1, wherein the second column is housed within a member of the user support.

9. The biceps curl machine of claim 1, wherein the first column slopes upward from the start position to the end position.

10. A biceps curl machine comprising:
- a resistance element;
- a user support coupled to the resistance element;
- a first movement element coupled to the user support, the first movement element comprising:
  - a first column disposed below the user support; and
  - a first carriage movably coupled to the first column such that the first movement element is able to move along the first column; and
- a second movement element coupled to the user support, the second movement element comprising:
  - a second column disposed parallel to and proximal to the back of the user support; and a second carriage movably coupled to the second column such that the second movement element is able to move along the second column.

11. The biceps curl machine of claim 10, wherein the first carriage comprises a first pivot axis associated with a connection point between the first carriage and a seat of the user support.

12. The biceps curl machine of claim 11, wherein the second carriage comprises a second pivot axis associated with a connection point between the second carriage and a back of the user support.

13. The biceps curl machine of claim 10, wherein the first column comprises two parallel linear members and the first carriage comprises two parallel sleeves associated with the parallel linear members.

14. The biceps curl machine of claim 10, wherein the user support comprises at least one of a footrest and a headrest.

* * * * *